US006978961B2

(12) United States Patent
Hashikawa

(10) Patent No.: US 6,978,961 B2
(45) Date of Patent: Dec. 27, 2005

(54) BAND SHEET COILING TENSION APPLYING APPARATUS AND ENDLESS BELTS FOR THE BAND SHEET COILING TENSION APPLYING APPARATUS, AND AN ENDLESS BELT LUBRICANT FOR THE BAND SHEET COILING TENSION APPLYING APPARATUS

(75) Inventor: Yoshito Hashikawa, Nagasaki-ken (JP)

(73) Assignee: Japan Development Consultants, Inc., Nagasaki-ken (JP)

( * ) Notice: Subject to any disclaimer, the term of this patent is extended or adjusted under 35 U.S.C. 154(b) by 0 days.

(21) Appl. No.: 10/458,411

(22) Filed: Jun. 11, 2003

(65) Prior Publication Data

US 2004/0004148 A1 Jan. 8, 2004

(30) Foreign Application Priority Data

Jul. 2, 2002 (JP) ..... P.2002-193826
Jul. 2, 2002 (JP) ..... P.2002-193827

(51) Int. Cl.[7] ..... B65H 23/10
(52) U.S. Cl. ..... 242/419.8; 242/419.5; 242/420.2
(58) Field of Search ..... 424/419.8, 419.5, 424/420.2

(56) References Cited

U.S. PATENT DOCUMENTS

| | | | | | |
|---|---|---|---|---|---|
| 3,386,679 | A | * | 6/1968 | Foulon et al. | 242/419.5 |
| 3,433,398 | A | * | 3/1969 | Moore et al. | 226/93 |
| 3,735,937 | A | | 5/1973 | Plantard | |
| 5,265,817 | A | * | 11/1993 | Gaudin | 242/419.5 |
| 5,454,502 | A | * | 10/1995 | Hashikawa | 226/195 |

FOREIGN PATENT DOCUMENTS

| | | | | | |
|---|---|---|---|---|---|
| EP | 0 427 580 | A1 | | 5/1991 | |
| EP | 0 456 536 | A1 | | 11/1991 | |
| EP | 1 136 144 | A1 | | 9/2001 | |
| GB | 2072152 | A | * | 9/1981 | B65H 23/10 |
| JP | 56-082755 | A | | 7/1981 | |
| JP | 63017761 | A | * | 1/1988 | B65H 23/10 |
| JP | 01130817 | A | * | 5/1989 | B21C 47/26 |
| JP | 02052844 | A | * | 2/1990 | B65H 23/10 |
| JP | 03147665 | A | * | 6/1991 | B65H 23/10 |
| JP | 04305315 | A | * | 10/1992 | B21C 47/00 |
| JP | 2651891 | B | | 5/1997 | |

* cited by examiner

*Primary Examiner*—Kathy Matecki
*Assistant Examiner*—Sang Kim
(74) *Attorney, Agent, or Firm*—Sughrue Mion, PLLC

(57) ABSTRACT

It is an object of this invention to eliminate the necessity of using pulleys which will bring about cost increase, trouble and reduction of service life, and give rise to the positional irregularity of the coil edge.

Two sets of endless belts 1 are disposed one above the other, each set of endless belts being laterally arranged side by side. Pressure applying members 2 and 3 which hold each the endless belts 1 in a state that the endless belts freely circulate in an oval shape state, press the inner surfaces 1*a* of the endless belts 1, and are passed through the inner part of the endless belts 1. Each pressure applying member 2 (3) includes at least a belt pressing part 21 (31) which has a linear shaped side surface for directly pressing the inner surfaces 1*a* of the endless belts, and belt reversing parts 23 (33) being arcuate in cross section. A coefficient of friction of an outer surface 1*b* of each the endless belt 1 is larger than that of the inner surface 1*a* thereof to thereby generate a tension in the slit band sheet "a".

6 Claims, 39 Drawing Sheets

BAND SHEET COILING TENSION APPLYING APPARATUS AND ENDLESS BELTS FOR THE BAND SHEET COILING TENSION APPLYING APPARATUS, AND AN ENDLESS BELT LUBRICANT FOR THE BAND SHEET COILING TENSION APPLYING APPARATUS

BACKGROUND OF THE INVENTION

1. Field of the Invention

The present invention relates to a band sheet coiling tension applying apparatus in use for a slitter line for slitting a wide metallic sheet into multi slit band sheets, which the apparatus adjusts for correction a non-uniformity of tension generated when the slit band sheets are coiled following the slitting of the metallic sheet, to thereby uniformly apply a coiling tension to the slit band sheets without generating rubbed flaw on the surface of the slit band sheets, and endless belts for use with the band sheet coiling tension applying apparatus, and an endless belt Lubricant for the band sheet boiling tension applying apparatus.

2. Description of the Related Art

There is known a metallic band sheet or plastic sheet coiling tension applying band sheet coiling tension applying apparatus as disclosed in the specifications of Japanese patent Publication JP56-082755 A by the applicant of the present patent application (BELTBRIDELE, trade name) and Japanese patent No. 2651891 by the same applicant (ROBELTOR, trade name).

"Tension pads" of the felt pressing type are frequently used for coiling such a material that creates no problem when the surface of the band sheet suffers from rubbed flaw, patterns by impression or the like. The BELTBRIDLE apparatus with pulleys and endless belts, developed by the applicant of the present patent application, is used for coiling a glossy, plated material, stainless or nonferrous metal finished to high gloss.

In the BELTBRIDLE apparatus for a slitter line having the coil base material width of 5 feet, the number of endless belts used is about 100, and to tension the endless belts, about 200 number of pulleys are required.

The same number of parts as of those pulleys are assembled into the pulleys. Those parts are, for example, ball bearings to be installed to the center shafts of the pulleys, and intermediate spacer parts.

With the intention of eliminating the large number of pulleys, the applicant of the present patent application proposed the device for applying circular metallic strip with tensile force (Japanese Patent No. 2651891). In the patent, slit band sheets "a" are nipped with circular drums. The sheet pressing parts are linear in shape and narrow in area. Accordingly, in this patent, there is a limit increasing the generated tension. Further, there is a limit to the thickness of the band sheets to be passed (at present, it is limited to 2 mm or less). The patented technique cannot deal with the materials failing to satisfy such limitation requirements. For this reason, the BELTBRIDLE apparatus is reluctantly used for the band sheet coiling.

Also, in a general slitter line, coils having been subjected to high grade surface treatment and coils not having been subjected to such are both present. To deal with those coils of different grades, an equipment (of the combination type) equipped with the BELTBRIDELE apparatus and the tension pad, vertically arranged in the two stages, was developed by the applicant of the present patent application. In operation, the belt type function or the felt type function is selected in accordance with the grade of material to be processed.

In the device for applying circular metallic strip with tensile force (Japanese Patent No. 2651891), the endless belts are compressed between upper and lower pressure applying members each having a substantially complete round shape. The endless belts as drawn by the slit band sheets to be coiled are repeatedly subjected to deformations of compression and recovery. Intermolecular friction violently occurs in the belt material. As a result, the belts are greatly deteriorated by heat generation of the belts per se and their repetitive deformation of compression and recovery. A limit is put on the tolerable surface pressure of the endless belt under this condition. To handle the processed materials of a broad range of thickness values, a pressure receiving area of the belt, i.e., a pressing area of the belt corresponding to the sheet pressing part, must be large; otherwise, it is impossible to handle the band sheet of a large thickness. In this respect, the circular drum has a limit in its applications.

Thus, the device for applying circular metallic strip with tensile force (Japanese Patent No. 2651891) can handle limited kinds of processed materials. For this reason, the BELTBRIDELE apparatus is reluctantly used for the slitter line to slit those band sheets out of the limited kinds of band sheets. As described above, the BELTBRIDELE apparatus needs a number of purchased parts and manufacturing parts, and cost of assembling is high. This high cost of the BELTBRIDELE apparatus hinders the wide use of the belt type apparatus.

The BELTBRIDELE apparatus is such an apparatus that the upper and lower pressure applying members, which nip the band sheets, presses the pressing plates on both sides of the endless belt, and friction resistance thereat is utilized for the coiling tension for coiling the band sheets. At the pressing plate, friction heat is generated depending the amount of work. To remove the friction heat, the cooling water is circulated near the pressing plates. The friction heat is generated in the endless belts, and temperature rises in the belts per se. The heat transfers to the pulley side. When the BELTBRIDELE apparatus is continuously operated, the pulley is overheated. This leads to trouble of ball bearings assembled, and reduction of service life of the endless belts.

In the BELTBRIDELE apparatus, the endless belts are tensioned in a manner that the belts are stretched between a couple of pulleys located on both sides thereof, with the pressing plates and the frame structure being interposed therebetween. The endless belts are not guided over a range of about 500 mm at their mid parts. Accordingly, the endless belts are rotated while taking a course alternately to one side and to the other. In the work of coiling the slit, narrow band sheets, the band sheets take zig-zag courses (turns alternately to the right and left sides). As a result, the side edge of the band sheet coiled by the coiler is irregular in position.

Also, referring to a slitter line, the equipment includes upper and lower four stages of frames. Special coupling devices "b" are provided between the upper and lower frames in order to select a lift mode and to select a depressing state. Use of such coupling devices leads to a complexity of device construction and increase of device cost. There is a danger that a trouble of the coupling device "b" may cause an accident by falling of the upper and lower frames (see FIG. 39).

SUMMARY OF THE INVENTION

For the above background reasons, an object of the present invention is to provide a band sheet coiling tension applying apparatus which eliminates the necessity of using the pulleys, which possibly increases the cost to manufacture, trouble, service life reduction, and positional irregularity of the side edge of the band sheet coil, while making the best use of the advantages of the belt type apparatus. Also, One of other objects of the present invention is to provide endless belts for use with the band sheet coiling tension applying apparatus in which a structure allowing the inner surfaces of the endless belts to be impregnated with a lubricant, is employed to thereby reduce friction coefficient of the inner surfaces. Also, one of objects of the present invention is to provide a band sheet coiling tension applying apparatus in which an upper sheet-pressing-surface movable type pressure applying member or a lower sheet-pressing-surface movable type pressure applying member can safely be selected by a simple operation, viz., a mere rotation.

In particular, while it is desired to omit the pulleys and their associated parts, which hinder the cost reduction of the apparatus, to suppress the zig-zag motion of the band sheet by tightening the endless belts, it is necessary to use the pulleys associated with bearings of low rotation resistance. In the case of the pulleys, a distance between the fulcrums of the adjacent guides for the endless belt is about 500 mm. This distance causes the zig-zag traveling of the endless belts. As for the measure for preventing the zig-zag motion of the endless belt, if the belt guide fulcrum distance is reduced, it is possible to prevent the endless belts from being turned sideways without strongly tightening the endless belt from its side. Provision is made of a linear belt pressing part, arcuate belt reversing parts located on both sides thereof, and belt guide protrusions for separately guiding the endless belts being arranged side by side.

Thence, a fist band sheet coiling tension applying apparatus of the invention may be described such that a band sheet coiling tension applying apparatus in which two sets of endless belts are disposed one above the other, each set of endless belts being laterally arranged side by side, pressure applying members which hold the endless belts in a state that the endless belts freely circulate in a noval shape state, press the inner surfaces of the endless belts, and are passed through the inner part of the endless belts, each pressure applying member includes at least a belt pressing part which has a linear shaped side surface directly pressing the inner surfaces of the endless belts, and belt reversing parts being arcuate in cross section, a coefficient of friction of an outer surface of each endless belt is larger than that of the inner surface thereof, the endless belts are pressed against both surfaces of the slit band sheets which are passed between the outer surfaces of the upper and lower side, oppositely arranged endless belts by the pressure applying members which passed through the inner part of the endless belts, whereby the endless belts are driven to move by a friction engagement between the endless belts and the moving slit band sheets to independently circulate the endless belts in an oval shape fashion in unison with the slit band sheets, and a tension is generated in the band sheets by a friction force between the pressure applying members.

According to another aspect of the invention, there is provided a band sheet coiling tension applying apparatus in which two sets of endless belts are disposed one above the other, each set of endless belts being laterally arranged side by side, pressure applying members which hold the endless belts in a state that the endless belts freely circulate in an oval shape state, press the inner surfaces of the endless belts, and are passed through the inner part of the endless belts, each pressure applying member includes at least a belt pressing part which has a linear shaped side surface for directly pressing the inner surfaces of the endless belts, and belt reversing parts located on both sides of the belt pressing part, each belt reversing part having a plurality of belt reversing guide members arranged thereon at given intervals, the contact surfaces of the belt reversing guide members to be in contact with the endless belts being circular as viewed from side, and a contact locus of each belt reversing part with the endless belts being arcuate, a plurality of belt guide protrusions for separately guiding the endless belts being arranged side by side on the belt reversing parts, a coefficient of friction of an outer surface of each endless belt is larger than that of the inner surface thereof, the endless belts are pressed against both surfaces of the slit band sheets which are passed between the outer surfaces of the upper and lower side, oppositely arranged endless belts by the pressure applying members which passed through the inner part of the endless belts, whereby the endless belts are driven to move by a friction engagement between the endless belts and the moving slit band sheets to independently circulate the endless belts in an oval shape fashion in unison with the slit band sheets, and a tension is generated in the band sheets by a friction force between the pressure applying members.

In each band sheet coiling tension applying apparatus mentioned above, a band sheet coiling tension applying apparatus, wherein a cooling chamber is disposed within the belt pressing part of each pressure applying member. A cooling chamber is disposed inside the belt reversing guide members. Further, a recess part is formed on the rear side of the belt pressing part, and a belt tensioning roll for pressing the inner surfaces of the endless belts to tighten the endless belts is disposed in the recess part. A recess part is formed at a location where the belt pressing part of one of the pressure applying members is disposed, and the belt pressing part not coupled to the belt reversing parts on both sides of the belt pressing part, and an expandable bag body for pressing the belt pressing part against the inner surfaces of the endless belts, are located within the recess part.

According to still another aspect, there is provided endless belts for use with each band sheet coiling tension applying apparatus, in which the inner surfaces of the endless belts formed with woven fabric made of synthetic fibers so as to allow a lubricant to penetrate into the fibers and sunken parts of the knit meshes of the woven fabric, and the outer surface of the endless belt is formed with a relatively thin, flexible material which has a low compressive elasticity and such a hardness as to generate little compression strain even under pressure.

According to yet another aspect, there is provided an endless belt Lubricant for lubricating the inner surfaces of endless belts used by the band sheet coiling tension applying device, wherein a lubricant for lubricating the inner surfaces of the endless belts, which takes the form of a bar-like non-woven fabric or porous foam impregnated with paraffin, which is solid at normal temperature and becomes liquid when it is heated to be high in excess of its melting point, is located in contact with the inner surfaces 1*a* of the endless belts, wherein the paraffin flows out of the lubricant by friction heat generated by the rotation of the endless belts, and lubricates the inner surfaces of the endless belts to reduce the friction coefficient thereof.

According to yet another aspect, there is provided a band sheet coiling tension applying apparatus wherein sheet-pressing-surface non-movable type pressure applying members are respectively provided longitudinally along and on the outer periphery surfaces of upper and lower sheet-pressing-surface movable type pressure applying members, which are disposed above and below slit band sheets and arranged in the width direction of the slit band sheets, and include pressure applying members and endless belts circulating around the pressure applying members in a parallel fashion, while extending across the plurality of endless belts, each pressure applying members forming the sheet-pressing-surface movable type pressure applying member includes at least a belt pressing part which has a linear shaped side surface for directly pressing the inner surfaces of the endless belts, and the belt reversing parts being arcuate in cross section, a plurality of belt guide protrusions for separately guiding the endless belts being arranged side by side on the belt reversing parts, a coefficient of friction of an outer surface of each endless belt is larger than that of the inner surface thereof, to compress the slit band sheets by the upper and lower sheet-pressing-surface movable type pressure applying members, the upper and lower side, endless belts are pressed against the upper and lower surfaces of the slit band sheets, the endless belts are driven to move by a friction engagement between the endless belts and the moving slit band sheets to independently circulate the endless belts in unison with the moving slit band sheets around the pressure applying members, and the upper and lower sheet-pressing-surface movable type pressure applying members provided with the sheet-pressing-surface non-movable type pressure applying members are supported such that the sheet-pressing-surface movable type pressure applying members are rotatable about the horizontal axis, and means is provided which switches the compressing operation of the slit band sheets to the sheet-pressing-surface movable type pressure applying members or the sheet-pressing-surface non-movable type pressure applying members by their rotation.

According to yet another aspect of the invention, there is provided a band sheet coiling tension applying apparatus wherein sheet-pressing-surface non-movable type pressure applying members are respectively provided longitudinally along and on the outer periphery surfaces of upper and lower sheet-pressing-surface movable type pressure applying members, which are disposed above and below slit band sheets and arranged in the width direction of the slit band sheets, and include pressure applying members and endless belts circulating around the pressure applying members in a parallel fashion, while extending across the plurality of endless belts, each pressure applying members forming the sheet-pressing-surface movable type pressure applying member includes at least a belt pressing part which has a linear shaped side surface for directly pressing the inner surfaces of the endless belts, and belt reversing parts located on both sides of said belt pressing part, each said belt reversing part having a plurality of belt reversing guide members arranged thereon at given intervals, and the contact surfaces of the belt reversing guide members to be in contact with the endless belts being circular as viewed from side, a plurality of belt guide protrusions for separately guiding the endless belts being arranged side by side on the belt reversing parts, a coefficient of friction of an outer surface of each endless belt is larger than that of the inner surface thereof, to compress the slit band sheets by the upper and lower sheet-pressing-surface movable type pressure applying members, the upper and lower side, endless belts are pressed against the upper and lower surfaces of the slit band sheets, the endless belts are driven to move by a friction engagement between the endless belts and the moving slit band sheets to independently circulate the endless belts in unison with the moving slit band sheets around the pressure applying members, and the upper and lower sheet-pressing-surface movable type pressure applying members provided with the sheet-pressing-surface non-movable type pressure applying members are supported such that the sheet-pressing-surface movable type pressure applying members are rotatable about the horizontal axis, and means is provided which switches the compressing operation of the slit band sheets to the sheet-pressing-surface movable type pressure applying members or the sheet-pressing-surface non-movable type pressure applying members by their rotation.

In the band sheet coiling tension applying apparatus as mentioned above, a cooling chamber is provided within the belt pressing part of each pressure applying members. A cooling chamber is provided within the belt reversing parts of pressure applying members. A recess part is formed on the rear side of the belt pressing part, a belt tensioning roll for pressing the inner surfaces of the endless belts to tighten the endless belts, is disposed in the recess part.

BRIEF DESCRIPTION OF THE DRAWINGS

FIGS. 20A and 2GB are explanatory diagrams comparatively explaining a conventional band sheet coiling tension applying apparatus (FIG. 20A) and a band sheet coiling tension applying apparatus constructed according to the present invention (FIG. 20B).

DESCRIPTION OF THE PREFERRED EMBODIMENTS

Embodiments of the present invention, which are believed to be preferred, will be described with reference to the accompanying drawings.

[Embodiment 1]

Figure 1:
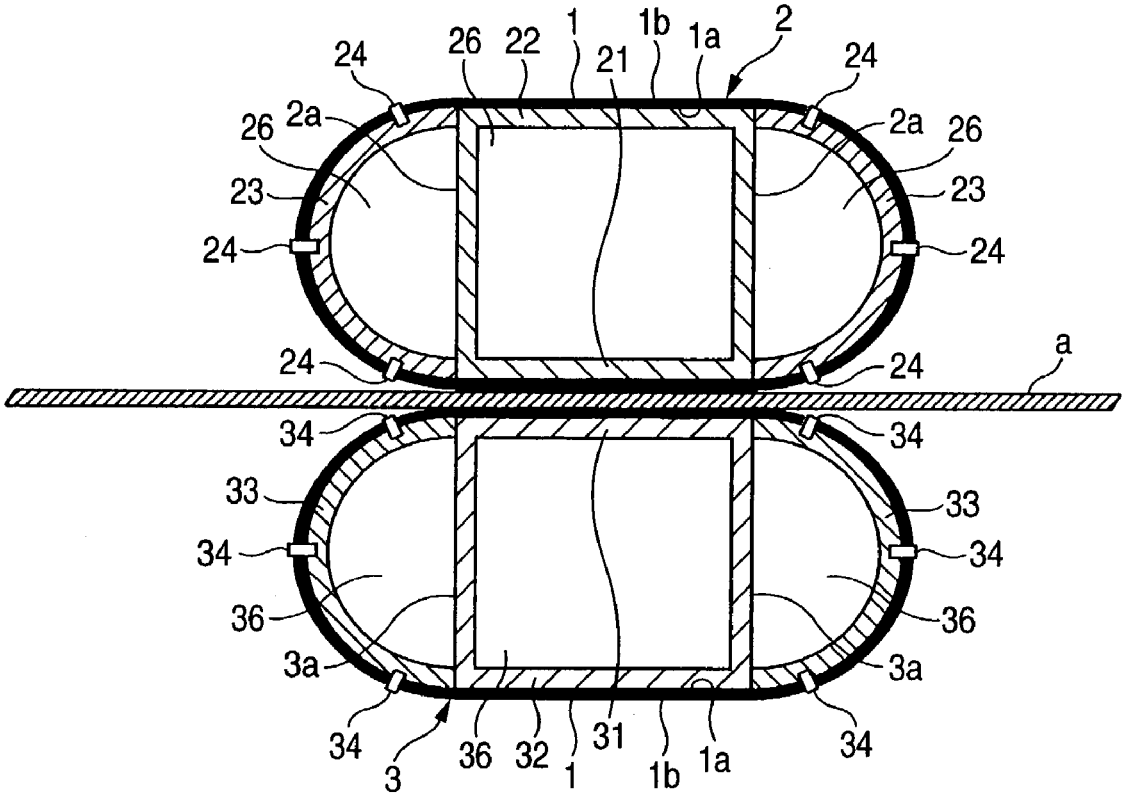
FIG. 1 is a cross sectional view showing a basic construction of an embodiment-1 of the present invention.
Figure 2:
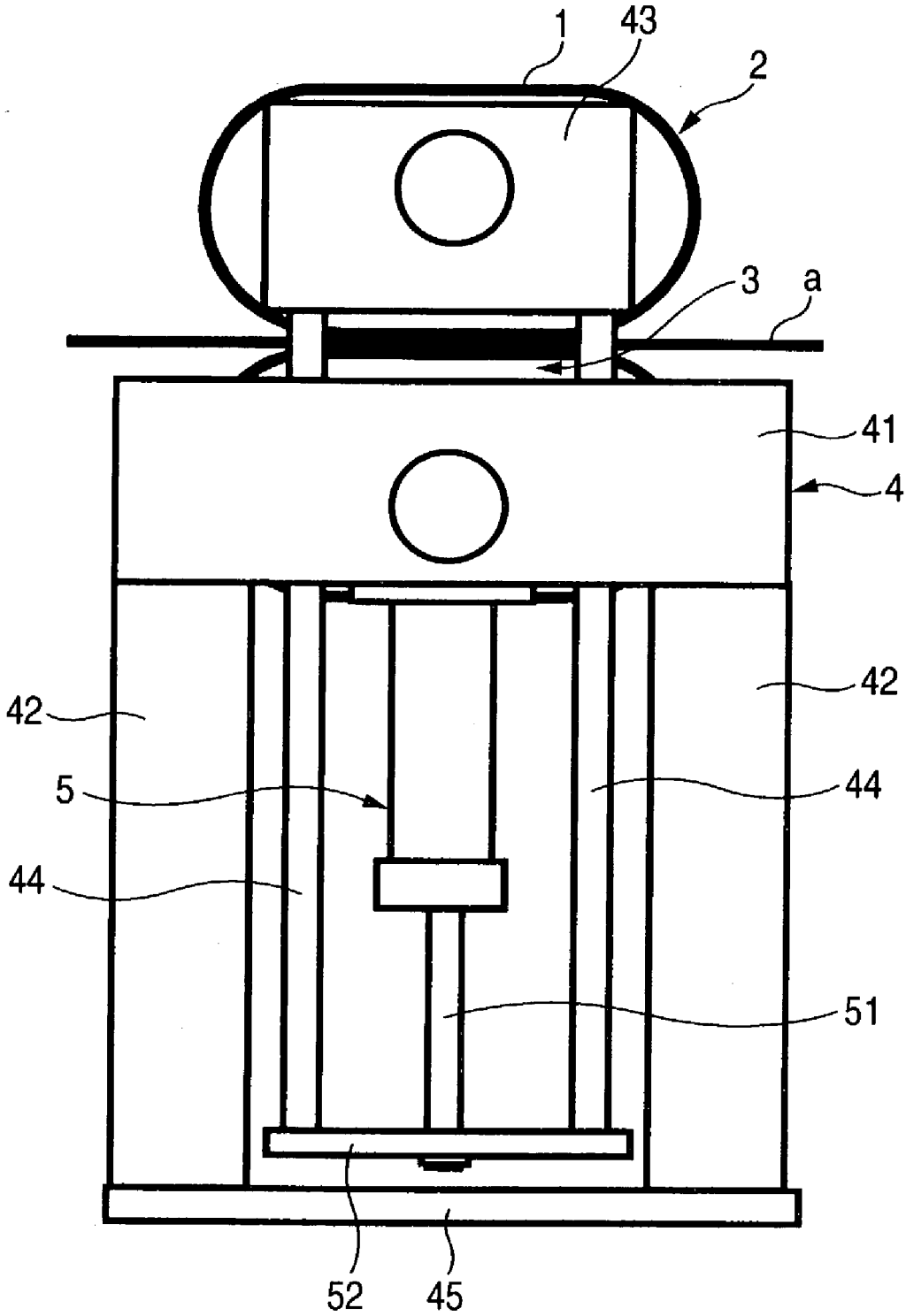
FIG. 2 is a side view showing an overall band sheet coiling tension applying apparatus of the embodiment-1 of the invention.
Figure 3:
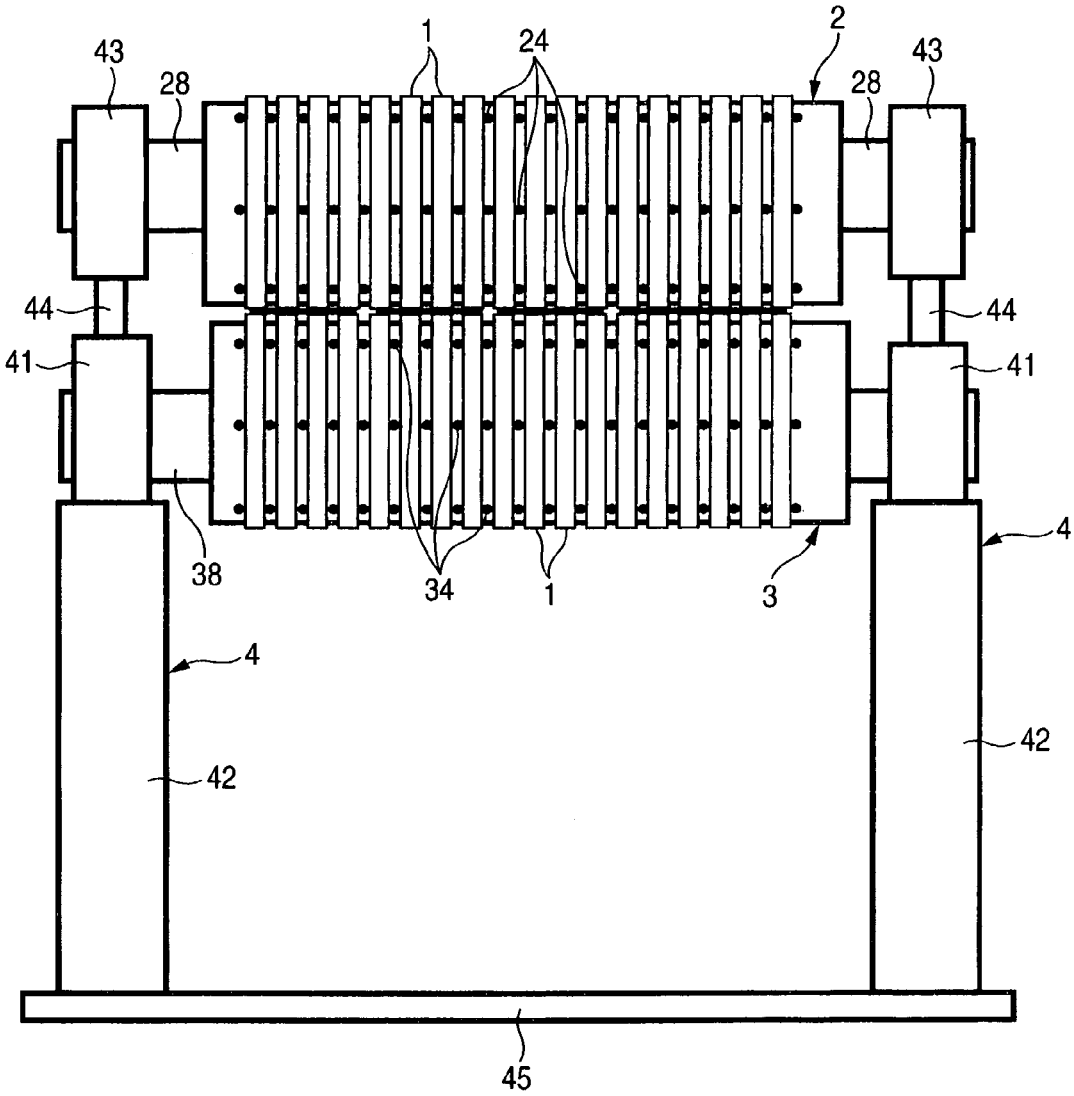
FIG. 3 is a front view showing the overall band sheet coiling tension applying apparatus of the embodiment-1.
Figure 4:
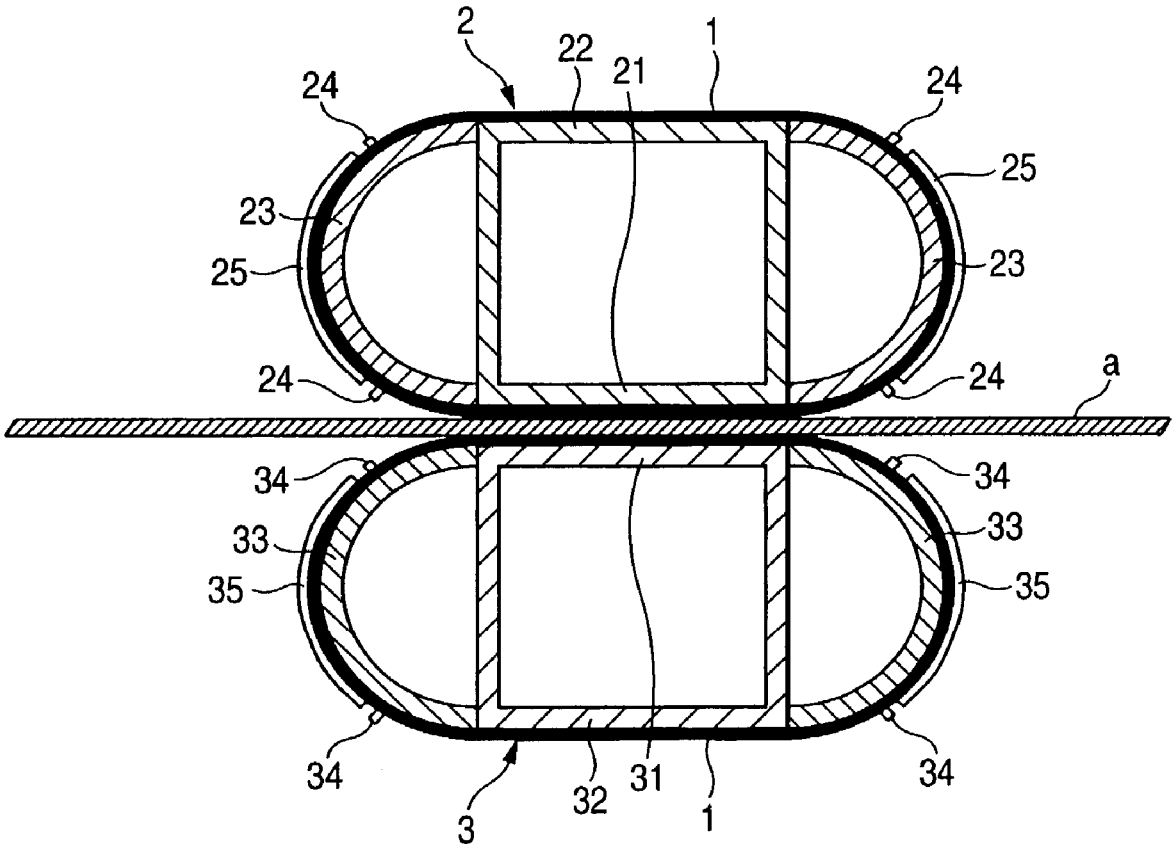
FIG. 4 is a cross sectional view showing an instance where pins and plates are combined for the belt guide protrusions in the embodiment-1.
Figure 5A:
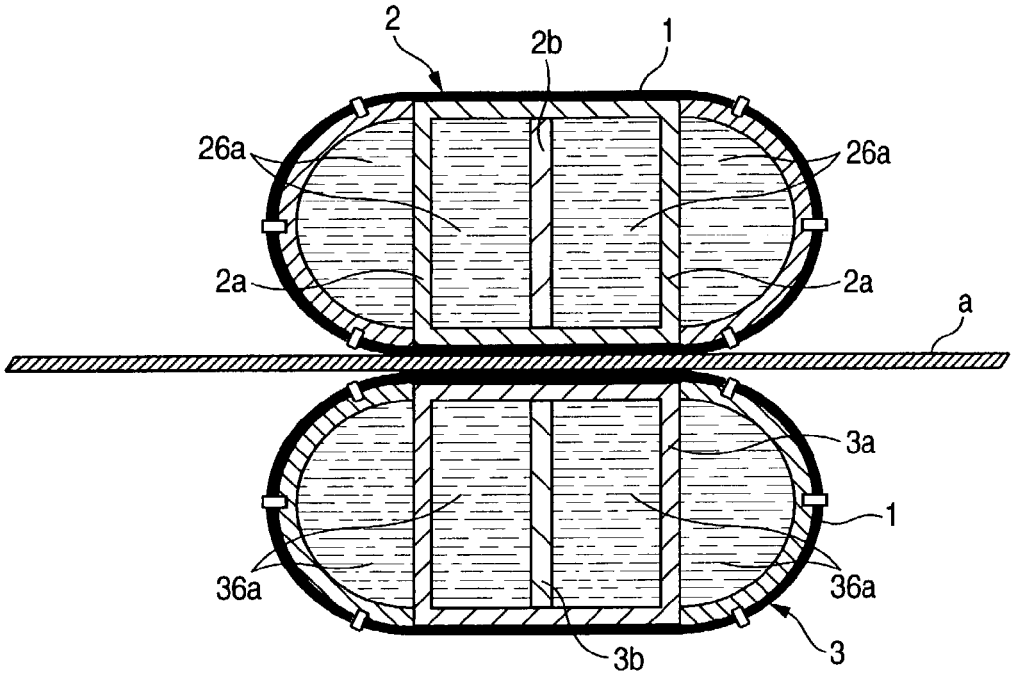
FIG. 5A is a cross sectional view showing a construction equipped with a water cooling chamber in the embodiment-1.
Figure 5B:
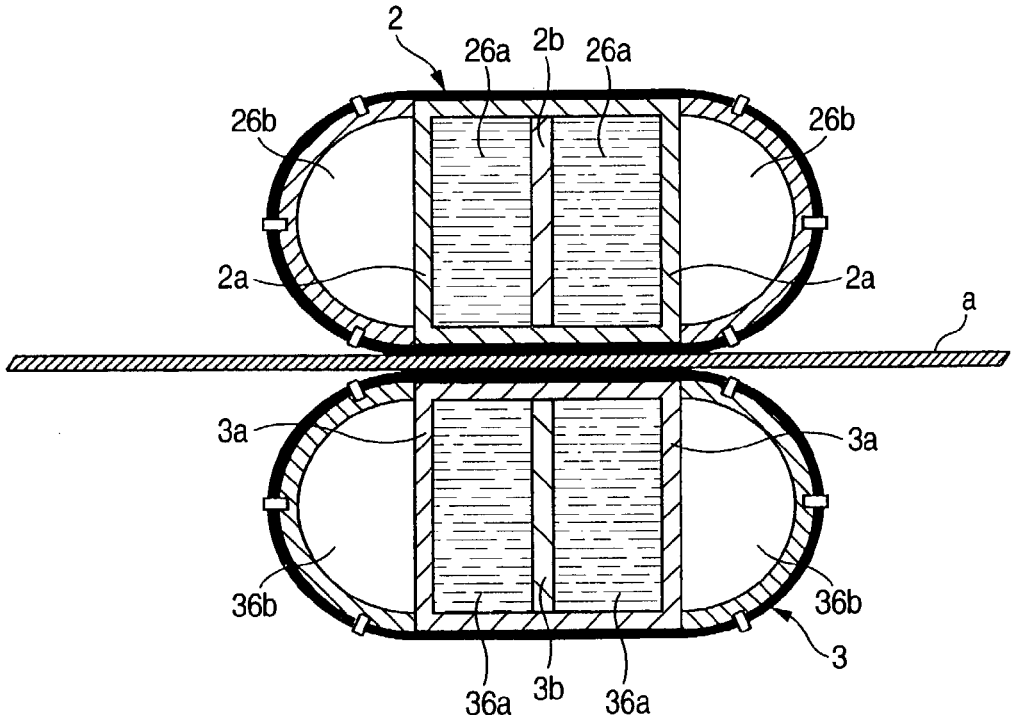
FIG. 5B is across sectional view showing a construction equipped with a water cooling chamber and an air cooling chamber in the embodiment-1.
Figure 6A:
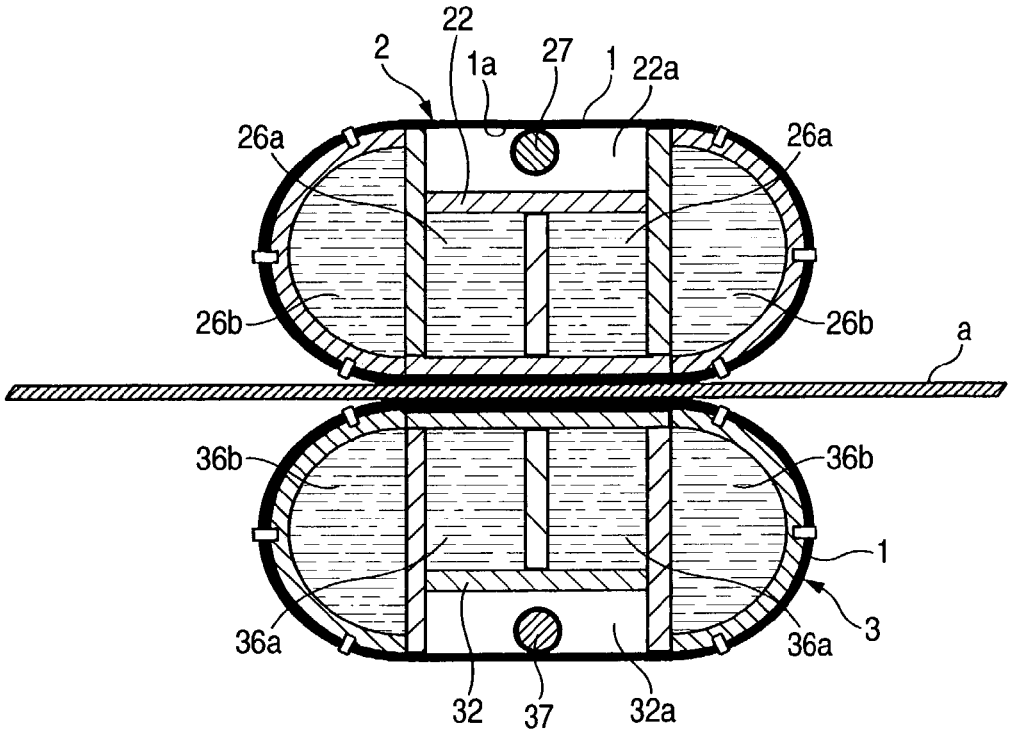
FIG. 6 is a cross sectional view showing a modification of the embodiment-1 of the invention.
Figure 6B:
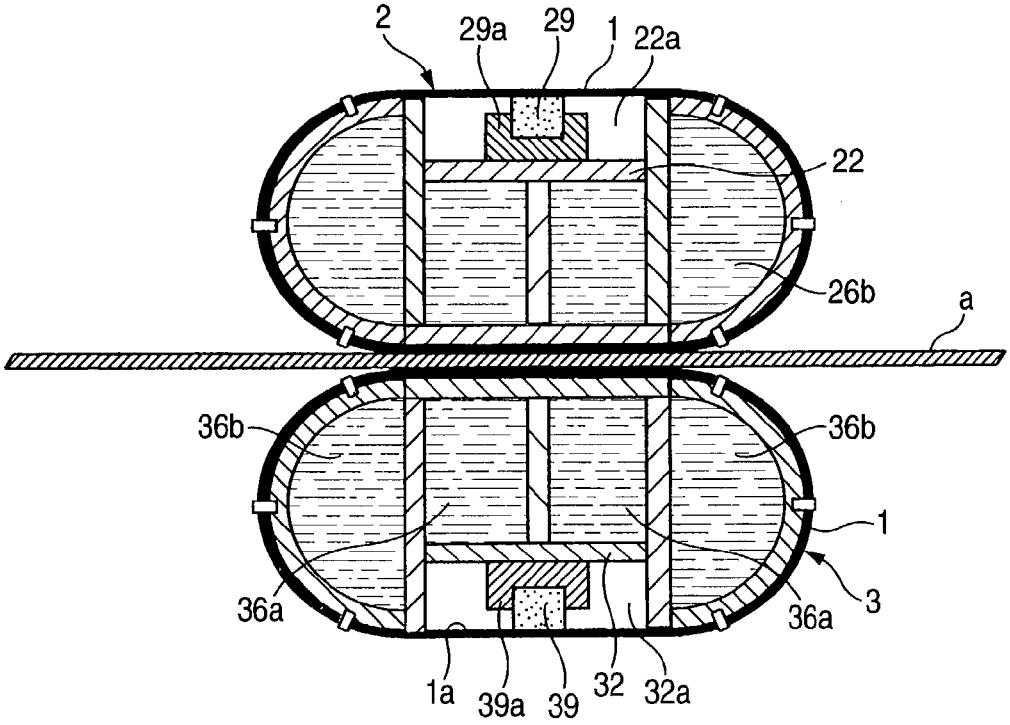

FIG. 1 is a cross sectional view showing a basic construction of an embodiment-1 of the present invention. FIG. 2 is a side view showing an overall band sheet coiling tension applying apparatus of the embodiment. FIG. 3 is a front view showing the overall band sheet coiling tension applying apparatus of the embodiment. FIG. 4 is a cross sectional view showing an instance where pins and plates are combined for the belt guide protrusions in the embodiment. FIG. 5A is a cross sectional view showing a construction equipped with a water cooling chamber in the embodiment-1, and FIG. 5B is a cross sectional view showing a construction equipped with a water cooling chamber and an air cooling chamber. FIGS. 6A and 6B are cross sectional views cooperatively showing a modification of the embodiment-1 of the invention.

Figure 20A:
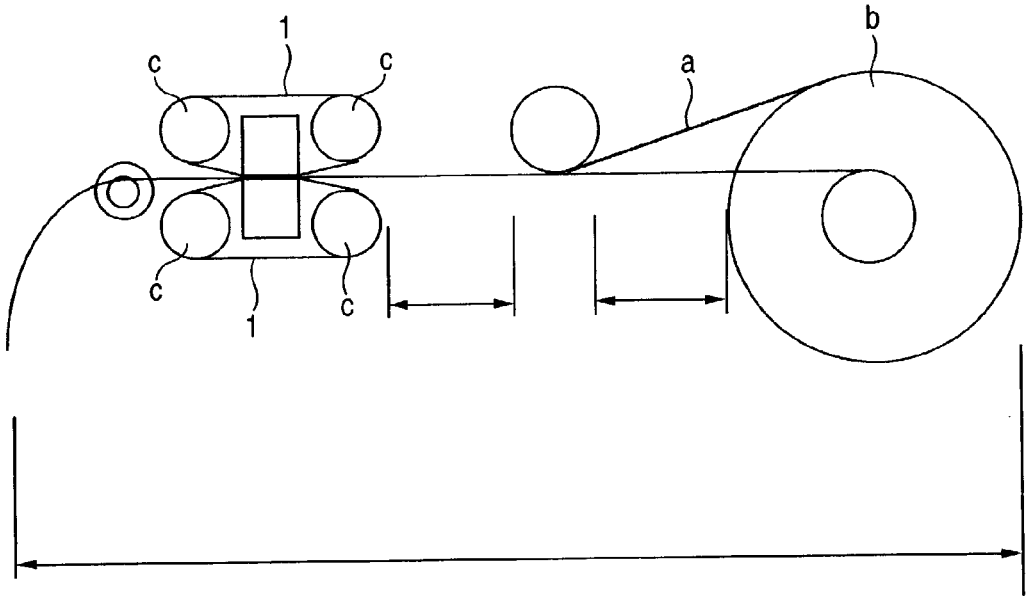
Figure 20B:
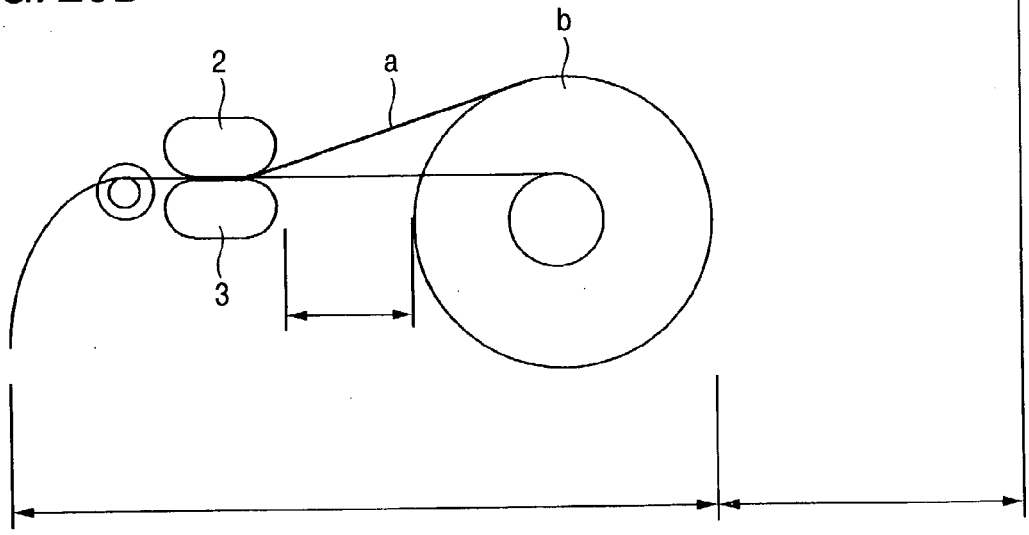

The band sheet coiling tension applying apparatus is an apparatus for applying a predetermined coiling tension to a slit band sheets "a". The band sheet coiling tension applying apparatus is disposed at the middle of a moving path of the slit band sheets "a" in front of a slit band sheet coiling apparatus "b" (see FIG. 20).

The band sheet coiling tension applying apparatus is composed mainly of two sets of upper and lower endless belts 1, a couple of upper and lower pressure applying members 2 and 3, a stand 4, and a hydraulic cylinder 5. The endless belts 1 are held to be freely circularly movable in an elliptic shape fashion, while being vertically and oppositely disposed. The upper and lower side, endless belts 1 freely circulate around the upper and lower pressure applying members 2 and 3 in an elliptical shape fashion. Those pressure applying members press the inner surfaces 1*a* of the endless belts 1. The stands 4 supports both the pressure applying members 2 and 3. The hydraulic cylinder 5 applies a depressing force to the upper pressure applying member 2.

The upper pressure applying member 2 presses downward the endless belts 1 disposed in an upper part, while the lower pressure applying member 3 presses upward the endless belts 1 disposed in a lower part. The upper and lower pressure applying members 2 and 3 cooperate to compress the slit band sheets "a", which pass through between the upper and lower endless belts 1 vertically and oppositely disposed, indirectly with aid of the endless belts 1, whereby a fixed tension is applied to the slit band sheets.

The endless belt 1 are disposed to freely circulate in the moving directions of the slit band sheets "a". Specifically, a set of the endless belts is arranged in a lateral directional, viz., direction orthogonal to the moving directions of the slit band sheets "a". Those sets of endless belts are arranged vertically or one above the other.

The endless belts 1, which are vertically disposed and arranged laterally and side by side, are each formed with an endless belt. Those endless belts 1 are installed around the outer periphery of the upper pressure applying member 2 which is disposed in an upper part and oval in cross section, and the outer periphery of the upper pressure applying member 3 which is disposed in a lower part and oval in cross section, in a state that hose belts are held to be independently and freely circularly movable in an oval shape fashion. Those endless belts 1 are able to independently circulate in the moving direction of the slit band sheet "a".

The upper and lower pressure applying members 2 and 3 on which the endless belts 1 are installed, do not include drive sources for circulating the endless belts 1. The endless belts 1 are circularly moved by a friction engagement between the belts and the moving slit band sheets "a". And those never circulate by their own power. In other words, the endless belts 1 installed respectively on the upper and lower pressure applying members 2 and 3, does not circulate until the belts contact with the slit band sheets "a".

An outer surface 1*b* of each endless belt 1 functions to move the slit band sheet "a" in unison with the slit band sheets "a". The inner surfaces 1*a* of the endless belts 1 functions to generate a tension in the slit band sheets "a" by a friction force by a slip between the upper and lower pressure applying members 2 and 3. For this reason, a coefficient of friction of the inner surface 1*a* of the endless belt 1 is smaller than that of the outer surface 1*b,* and the inner surface is easy to slip.

The inner surface 1*a* of the endless belt 1 is formed with a woven fabric made of synthetic fibers so as to allow a lubricant to penetrate into the fibers and sunken parts of the knit meshes of the woven fabric. The outer surface 1*b* of the endless belt 1 is formed with a relatively thin, flexible material which has a low compressive elasticity and such a hardness as to generate little compression strain even under pressure.

Use of the woven fabric for the inner surface 1*a* of the endless belt 1 brings about the following advantages. A friction coefficient of the belt may be set to be small by impregnating the fibers and the sunken parts of the knit meshes of the woven fabric with a lubricant in advance. A rotation resistance of the endless belt installed onto the upper pressure applying member 2 (3) is small since the woven fabric is more flexible than a plate-like member. The woven fabric may be made of synthetic fibers of polyester, vinylon, nylon or the like.

In the case of the endless belts associated with the complete round shaped pressure applying member, a material constituting the belt must have sufficiently large compressive elasticity and recovery property in the thickness direction, and the belt utilizes a compression elastic strain of the belt in its pressed state close to a linear contact of the complete round shaped tension applying member. A pressed area (of the endless belts) is considerably large in the invention of the present patent application, when comparing with the endless belts just mentioned. Therefore, a low surface pressure suffices to secure a friction resistance (tension) comparable with that in the complete round case. And in the invention, there is no need of a compression strain deformation resistance, which is essential to the case of the complete round shaped pressure applying member. Accordingly, the endless belt exhibits satisfactory functions by using the combined synthetic resin materials which are relatively thin and small in compressive elasticity. Further, the fibers and the sunken parts of the knit meshes of the woven fabric may be impregnated with a lubricant in advance. Therefore, there is no limit of the material of the endless belt to a combination of the material of the inner surface 1*a* and the material of the outer surface 1*b* of the endless belt 1 of which the friction coefficients are different from each other.

The outer surface 1*b* of the endless belt 1 may be made of a material whose friction coefficient is larger than that of the inner surface 1*a*. Specifically, the inner surface 1*a* of the endless belt 1 is made of a material having good abrasion resistance, for example, a soft synthetic resin-based material having a low friction coefficient. The outer surface of the endless belt is made of an elastic material having a high friction coefficient, for example, rubber or synthetic resin. If required, a coefficient of friction of the inner surface 1*a* of the endless belt may be smaller than that of the outer surface 1*b* by coating the inner surfaces 1*a* of the endless belts 1 and the sliding surfaces of the upper and lower pressure applying members 2 and 3, with a lubricant.

The upper pressure applying member 2 is disposed while being passed through the inner pat of a number of endless belts 1 located in the upper part. The upper pressure applying member 2 thus disposed is integrally formed with a belt pressing part 21 which has a linear shaped side surface for directly pressing the inner surfaces 1*a* of the endless belts 1, a belt guide part 22 which has a linear shaped side surface and is disposed parallel to and above the belt pressing part 21, and belt reversing parts 23 which are respectively formed on both sides of the belt guide part 22 and the belt pressing part 21, and are arcuate, e.g., semi-arcuate, in cross section.

The upper pressure applying member 2 is integrally formed with the upper and lower, belt guide part 22 and belt pressing part 21, and the belt reversing parts 23 located on both sides thereof, and is, for example, oval in cross section. The belt reversing part 23 may take a partially ellipse arc shape or a partially parabolic shape other than the semi-arc shape. In this case, the upper pressure applying member 2 is oval in cross section. The upper pressure applying member 2 is disposed with its longitudinal direction being orthogonal to the moving direction of the slit band sheets "a", and is passed through the inner part of an array of the endless belts 1.

The endless belts 1, laterally arranged side by side, independently circulate around the upper pressure applying member 2 having an oval cross sectional shape. The peripheral surface of the upper pressure applying member 2 has an oval shape so as to allow the endless belts 1 to smoothly circulate around the upper pressure applying member 2 in an oval shape fashion.

The belt pressing part 21 functions such that it presses the slit band sheet "a" by a surface pressure of a surface having a predetermined length in the moving direction of the slit band sheet "a" with the endless belts 1 being interposed therebetween, to thereby applying a coiling tension to the slit band sheet "a". To this end, the belt pressing part 21 is linear in shape while having a predetermined length in the moving direction of the slit band sheet "a", and is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 21, are circulated at a speed equal to that of the moving slit band sheet "a", in unison with the slit band sheet "a" and without their slippage, in a state that the outer surfaces 1*b* of the endless belts 1 are in close contact with the slit band sheet "a". The surface of the belt pressing part 21, which comes in contact with the endless belts 1, is flat, and is finished to have a small friction between it and the inner surfaces 1*a* of the endless belts 1.

A plurality of belt guide protrusions 24 are protruded from the outer periphery of the upper pressure applying member 2, while being circumferentially arranged at fixed intervals in the circumferential direction. Those belt guide protrusions guide those separate endless belts 1 laterally arranged side by side. The belt guide protrusions 24 prevent the endless belts 1 from taking a zig-zag motion or varying in the width direction of the endless belt 1. Specifically, the belt guide protrusions 24 are provided on both the belt reversing parts 23 at proper spatial intervals, and if necessary, may be provided on the belt guide parts 22. Usually, pins are used for the belt guide protrusions 24, and sometimes belt guide plates 25, for example, are used in addition to the pins. Where the belt guide plates 25 are used as shown in FIG. 4, the belt guide plates 25 are arcuately installed on the belt reversing parts 23 in a protruded fashion, respectively. The belt guide protrusions 24 formed with pins are protruded from the belt reversing parts 23, while being located on both sides of the belt guide plate 25.

A cooling chamber 26 is disposed within the upper pressure applying member 2 in a state that it extends across the array of the endless belts 1. The cooling chamber 26 functions to cool and to prevent the endless belts 1 circulating around the upper pressure applying member 2, from overheating by friction heat. The inner space of the cooling chamber 26 is partitioned, by an inner partitioning plate 2*a*, into three sectional spaces, inner spaces of the belt reversing parts 23 on both sides thereof, and an inner space of the belt pressing part 21 at the middle part. Sometimes, if necessary, the inner space of the belt pressing part 21 is partitioned into two or more than two sectional spaces by at least one inner partitioning plates 2*b*. In some cases, some of the inner partitioning plates 2*b* each of which partitions the inner space of the belt pressing part 21 into a plurality of sectional inner spaces, are partially bored, and the sectional inner spaces parted by one of such inner partitioning plates 2*b* communicate with each other.

Those inner partitioning plates 2*a* an 2*b*, which partition the inner space of the upper pressure applying member 2, function to retain the shape of the upper pressure applying member 2 the inside of which is hollowed because of presence of the chamber 26. A compressing force vertically acts on the upper pressure applying member 2, which presses downward the endless belts 1. The inner partitioning plates 2*a* and 2*b* resist the vertical compressing force to prevent the upper pressure applying member 2 from being flexed or bent in its longitudinal direction.

The cooling chamber 26 includes a water cooling chamber 26*a* and an air cooling chamber 26*b*. The water cooling chamber 26*a* exercises its cooling function by flowing water into the inside thereof, and the air cooling chamber 26*b* exercises its cooling function by flowing air into the inside thereof. When the passing slit band sheet "a" is thick, and its moving speed is high, friction heat generated is large and it is likely to be overheated. In such a situation, the water cooling chamber 26*a* is used. The air cooling chamber 26*b* is used in such a situation that the passing slit band sheet "a" is thin, its moving speed is low, and it is hard to be overheated.

A modification of the upper pressure applying member 2 is shown in FIG. 6. As shown, the belt guide part 22 on the rear side of the belt pressing part 21 is lower in height than the upper ends of the semi-arc, belt reversing parts 23, for example, on both sides thereof. And a recess part 22*a* is formed on the rear side of the belt pressing part 21. The upper pressure applying member of the modification has such a cross section shape that the upper part contains the groove and the remaining part is substantially oval. In this case, a gap is present between the upper side endless belts 1 and the inside of the recess part 22*a*. As shown in FIG. 6A, a belt tensioning roll 27 is disposed in the recess part 22*a*. The roll presses the inner surfaces 1*a* of the endless belts 1 to tighten the endless belts 1.

As shown in FIG. 6B, a lubricant 29 is disposed within the recess part 22*a*, in place of the belt tensioning roll 27 or together with the same. The lubricant is for lubricating the inner surfaces 1*a* of the endless belts 1. The lubricant 29 is contained in a recessed, lubricant holder 29*a* located on the bottom of the recess part 22*a*. The lubricant 29 may take the form of a bar-like non-woven fabric or porous foam impregnated with paraffin, which is solid at normal temperature and becomes liquid when it is heated to be high in excess of its melting point. The bar-like lubricant is located in contact with the inner surfaces 1*a* of the endless belts 1. The paraffin flows out of the lubricant by friction heat generated by the rotation of the endless belts 1, and lubricates the inner surfaces 1*a* of the endless belts 1 to reduce the friction coefficient thereof. Since the inner surfaces 1*a* of the endless belts 1 are lubricated by the lubricant 29 during their rotation, there is no necessity of frequently stopping the production line and lubricating the inner surfaces 1*a*. In this respect, the lubricant 29 provided within the recess part 22*a* contributes to improvement of the productivity.

The lower pressure applying member 3 is disposed while being passed through the inner part of a number of endless belts 1 located in the lower part. The lower pressure applying member 3 thus disposed is integrally formed with a belt pressing part 31 which has a linear shaped side surface for directly pressing the inner surfaces 1*a* of the endless belts 1, a belt guide part 32 which has a linear shaped side surface and is disposed parallel to and under the belt pressing part 31, and belt reversing parts 33 which are respectively provided on both sides of the belt pressing part 31 and the belt guide part 32, and are arcuate, e.g., semi-arcuate, in cross section.

The lower pressure applying member 3, which is integrally formed with upper and lower, belt guide part 32 and belt pressing part 31, and the semi-arc belt reversing parts 33 being located on both sides thereof, is oval in cross section, for example. Each belt reversing part 33 may take a partially elliptical shape or a partially ellipse-arcuately shape other than the arc shape. In this case, the lower pressure applying member 3 is oval in cross section. The lower pressure applying member 3 is disposed such that its longitudinal direction is orthogonal to the moving direction of the slit band sheets "a", and is passed through the inner part of an array of the endless belts The endless belts 1, laterally arranged side by side, independently circulate around the lower pressure applying member 3 having an oval cross sectional shape. The peripheral surface of the lower pressure applying member 3 is finished to have an oval shape so as to allow the endless belts 1 to smoothly circulate around the lower pressure applying member 3 in an oval shape fashion.

The belt pressing part 31 functions such that it presses the slit band sheets "a" by a surface pressure of a surface having a predetermined length in the moving direction of the slit band sheet "a" in a state that the endless belts 1 are interposed between them, whereby it applies a coiling tension to the slit band sheet "a". To this end, the belt pressing part 31 is linearly shaped to have a predetermined length in the moving direction of the slit band sheet "a" so that it is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 31, are circulated at a speed equal to that of the moving slit band sheets "a", in unison with the slit band sheet "a" and without their slippage, in a state that the outer surfaces 1*b* of the endless belts 1 are in close contact with the slit band sheet "a". The surface of the belt pressing part 31, which comes in contact with the endless belts 1, is flat, and is finished to have a small friction between it and the inner surfaces 1*a* of the endless belts 1.

A plurality of belt guide protrusions 34 are protruded from the outer periphery of the lower pressure applying member 3, while being arranged at fixed intervals in the circumferential direction. Those belt guide protrusions guide those separate endless belts 1 laterally arranged side by side. The belt guide protrusions 34 prevent the endless belts 1 from taking a zig-zag motion and varying in the width direction of the endless belt 1. Specifically, the belt guide protrusions 34 are provided on both the belt reversing parts 33 at proper spatial intervals, and if necessary, may be provided on the belt guide parts 32. Usually, pins are used for the belt guide protrusions 34, and sometimes belt guide plates 35, for example, are used in addition to the pins. When the belt guide plates 35 are used as shown in FIG. 4, the belt guide plates 35 are arcuately installed on the belt reversing parts 33 in a protruded fashion, respectively. The belt guide protrusions 34 formed with pins are protruded from the belt reversing parts 33, while being located on both sides of the belt guide plate 35.

A cooling chamber 36 is disposed within the lower pressure applying member 3 in a state that it extends across the array of the endless belts 1. The cooling chamber 36 functions to cool and to prevent the endless belts 1 circulating around the lower pressure applying member 3, from overheating by friction heat. The inner space of the cooling chamber 36 is partitioned, by an inner partitioning plate 3*a*, into three sectional spaces, inner spaces of the belt reversing parts 33 on both sides thereof, and an inner space of the belt pressing part 31 at the middle part. Sometimes, the inner space of the belt pressing part 31 is partitioned into more than three sectional spaces by the inner partitioning plates 3*b* or by two or more number of inner partitioning plates 3*b*. In some cases, some of the inner partitioning plates 3*b* each of which partitions the inner space of the belt pressing part 31 into a plurality of sectional inner spaces, are partially bored, and the sectional inner spaces parted by one of such inner-partitioning plates 3*b* communicate with each other.

Those inner partitioning plates 3*a* and 3*b*, which partition the inner space of the lower pressure applying member 3, function to retain the shape of the lower pressure applying member 3 the inside of which is hollowed because of presence of the chamber 36. A compressing force vertically acts on the lower pressure applying member 3, which presses downward the endless belts 1. The inner partitioning plates 3*a* and 3*b* resist the vertical compressing force to prevent the lower pressure applying member 3 from being flexed or bent in its longitudinal direction.

The cooling chamber 36 includes a water cooling chamber 36*a* and an air cooling chamber 36*b*. The water cooling chamber 36*a* exercises its cooling function by flowing water into the inside thereof, and the air cooling chamber 36*b* exercises its cooling function by flowing air into the inside thereof. When the passing slit band sheet "a" is thick, and its moving speed is high, friction heat generated is large and it is likely to be overheated. In such a situation, the water cooling chamber 36*a* is used. The air cooling chamber 36*b* is used in such a situation that the passing slit band sheet "a" is thin, its moving speed is low, and it is hard to be overheated.

A modification of the lower pressure applying member 3 is shown in FIG. 6. As shown, the belt guide part 32 on the rear side of the belt pressing part 31 is lower in height than the upper ends of the semi-arc, belt reversing parts 33, for example, on both sides thereof. And a recess part 32*a* is formed on the rear side of the belt pressing part 31. The lower pressure applying member of the modification has such a cross section shape that the lower part contains the groove and the remaining part is substantially oval. In this case, a gap is present between the lower side endless belts 1 and the inside of the recess part 32*a*. As shown in FIG. 6A, a belt tensioning roll 37 is disposed in the recess part 32*a*. The roll presses the inner surfaces 1*a* of the endless belts 1 to tighten the endless belts 1.

As shown in FIG. 6B, a lubricant 39 for lubricating the inner surfaces 1*a* of the endless belts 1 is disposed within the recess part 32*a*, in place of the belt tensioning roll 37 or together with the same. The lubricant 39 is contained in a recessed, lubricant holder 39*a* located on the bottom of the recess part 32*a*. The lubricant 39 may take the form of a bar-like non-woven fabric or porous foam impregnated with paraffin, which is solid at normal temperature and becomes liquid when it is heated to be high in excess of its melting point. It is located in contact with the inner surfaces 1*a* of the endless belts 1. The paraffin flows out of the lubricant by friction heat generated by the rotation of the endless belts 1, and lubricates the inner surfaces 1*a* of the endless belts 1 to reduce the friction coefficient thereof. Since the inner surfaces 1*a* of the endless belts 1 are lubricated by the lubricant 39 during their rotation, there is no necessity of frequently stopping the production line and lubricating the inner surfaces 1*a*. In this respect, the lubricant 39 provided within the recess part 32*a* contributes to improvement of the productivity.

Both ends of the lower pressure applying member 3 are rotatably supported by gate-like stands 4 disposed on both sides thereof, with the aid of a shaft 38. As shown, the end parts of the shaft 38 are respectively extended out of both ends of the lower pressure applying member 3. The end parts of the shaft 38 are shaft-supported at the center positions of upper lateral beams 41 of the gate-like stands 4.

Each of the gate-like stands 4, which are disposed on both sides of the lower pressure applying member 3, is formed with the upper lateral beam 41 and right and left vertical beams 42, which support the lower sides of both ends of the upper lateral beam 41. The stands 4 support the upper pressure applying member 2 and the lower pressure applying member 3. Upper bearings 43 for supporting both sides of the upper pressure applying member 2 are respectively provided above the upper lateral beams 41 of the gate-like stands in a liftable manner. The lower ends of the stands 4, located on both sides thereof, are secured to a plate-like base 45.

Both end sides of the upper pressure applying member 2 are supported at the shaft 28 by the gate-like stands 4. The end parts of the shaft 28 are protruded out of both ends of the upper pressure applying member 2, respectively. The end parts of the shaft 28 are supported at the center positions of the upper bearings 43, which are provided above the upper lateral beam 41 of the gate-like stands 4 in a liftable manner.

A hydraulic cylinder 5 is provided in the inner space of the gate-like stands 4, viz., a space defined by the upper lateral beam 41 and the right and left vertical beams 42. The hydraulic cylinder 5 vertically moves or lifts the upper bearings 43, and further applies a depressing force to the upper pressure applying member 2 through the lifting upper bearings 43. A hydraulic cylinder 5, for example, is used of the oil pressure cylinder.

The hydraulic cylinder 5 is suspended at the upper end from the center position of the lower end of the upper lateral beam 41, whereby the hydraulic cylinder is expandable downward. The lower end of the piston rod 51, which is extended downward from the lower end of the hydraulic cylinder 5, is coupled to a center position of a lateral coupling plate 52. The lower ends of lift shafts 44 are coupled to both ends of the lateral coupling plate 52, respectively. The lift shafts support the upper bearings 43 in a liftable manner.

The lift shafts 44, which vertically extend, are movably passed through the upper lateral beam 41, and the upper ends of the lift shafts, located above the upper lateral beam, are coupled to the lower ends of the upper bearings 43. When the lift shafts 44 are vertically moved by the hydraulic cylinder 5, the upper bearings 43, which support the upper pressure applying member 2, also vertically moves together with the lift shafts.

Specifically, when the piston rod 51 of the hydraulic cylinder 5 extends downward, the lift shafts 44 move downward. With the downward movement, the upper bearings 43 and the upper pressure applying member 2 also descend. A depressing force exerts on the endless belts 1. The upper pressure applying member 2 and the lower pressure applying member 3 cooperate to compress the slit band sheet "a" and applies a coiling tension to the slit band sheet "a".

When the piston rod 51 of the hydraulic cylinder 5 retracts, the lift shafts 44 ascend. With the ascending motion, the upper bearings 43 and the upper pressure applying member 2 also ascend. The depressing force acting on the endless belts 1 disappears, and the coiling tension of the slit band sheet "a" caused by the endless belts 1 also disappears.

In the illustration, the hydraulic cylinder 5 is installed downward, viz., it is suspended from the upper lateral beam 41, so that the piston rod 51 directed downward is extendible and retractable. In an alternative, the hydraulic cylinder 5 is installed upward, viz., the lower end of the hydraulic cylinder 5 is placed on the base 45 and the piston rod 51 is directed upward, and the piston rod 51 is extendible and retractable in a state that it is directed upward. A pressure adjusting device (not shown) is associated with the hydraulic cylinder 5, and adjusts a hydraulic pressure to the hydraulic cylinder 5 so as to provide a tension as determined in accordance with a thickness and width of the slit band sheet "a".

Operation of the band sheet coiling tension applying apparatus thus constructed will be described.

The piston rod 51 of the hydraulic cylinder 5, which is suspended within the gate-like stands 4 disposed on both sides of the upper and lower pressure applying members 2 and 3, is retracted, and the upper bearings 43 located above the gate-like stands 4 are lifted. With the lifting of the upper bearings 43, the upper pressure applying member 2 which is supported at both the ends by the upper bearings 43, ascends, and the upper and lower pressure applying members 2 and 3 are vertically moved apart from each other.

Slit band sheets "a" are passed through between the outer surfaces 1*b* of the endless belts i as moved apart from each other. The piston rod 51 of the hydraulic cylinder 5 is extended downward to lower the upper pressure applying member 2. The upper and lower pressure applying members 2 and 3 are made to approach to each other to be in contact with each other and the setting work of the slit band sheets "a" is completed. The slit band sheets "a" are compressed, by a predetermined pressing force, between the endless belts 1 mounted on the upper and lower pressure applying members 2 and 3.

The belt pressing part 21 of the upper pressure applying member 2 presses downward the inner surfaces 1*a* of the endless belts 1 to be brought into completely close contact with the inner surfaces 1*a*. The outer surfaces 1*b* of the endless belts 1, which is pressed downward by the belt pressing part 21, is brought into close contact with the surfaces of the slit band sheets "a". After the outer surfaces 1*b* of the endless belts 1 are in close contact with the surface of the slit band sheet "a", it presses the slit band sheets "a" downward.

The lower side, endless belts 1, which are in contact with the back surface of the slit band sheet "a", presses upward the inner surfaces 1*a* of the lower side, endless belts 1 by a counterforce, or the belt pressing part 31 of the lower pressure applying member 3, whereby the outer surfaces 1*b* of the endless belts 1 are brought into close contact with the back surfaces of the slit band sheets "a". The front and back sides of the slit band sheets "a" are pressed by equal forces by the outer surfaces 1*b* of the endless belts 1 which are vertically and oppositely arranged. At this time, a pressure is applied uniformly to the entire front and back sides of the slit band sheets "a" being in close contact with the outer surfaces 1*b* of the endless belts 1 vertically and oppositely arranged.

When the operation of coiling the slit band sheets "a" starts, the upper and lower side, endless belts 1 circulate around the oval, upper and lower pressure applying members 2 and 3 in an oval shape fashion, by a friction caused by the close contact between the obverse and reverse sides of the moving slit band sheets "a" and the outer surfaces 1*b* of the upper and lower side, endless belts 1. At this time, the upper and lower side, endless belts 1 independently circulate at equal speeds without their slippage on the moving slit band sheets "a".

By a friction force caused by a slip between the surfaces of the belt pressing part 21 of the upper pressure applying member 2 and the belt pressing part 31' of the lower pressure applying member 3, viz., their friction engagement with the moving slit band sheet "a", the belt pressing part 21 and the belt pressing part 31, which press the inner surfaces 1*a* of the endless belts 1 circulating in an oval shape fashion, function like a brake to thereby a necessary coiling tension in the slit band sheet "a" between the slit band sheet coiling apparatus "b" (see FIG. 20) and the band sheet coiling tension applying apparatus.

[Embodiment-2]

Figure 7:
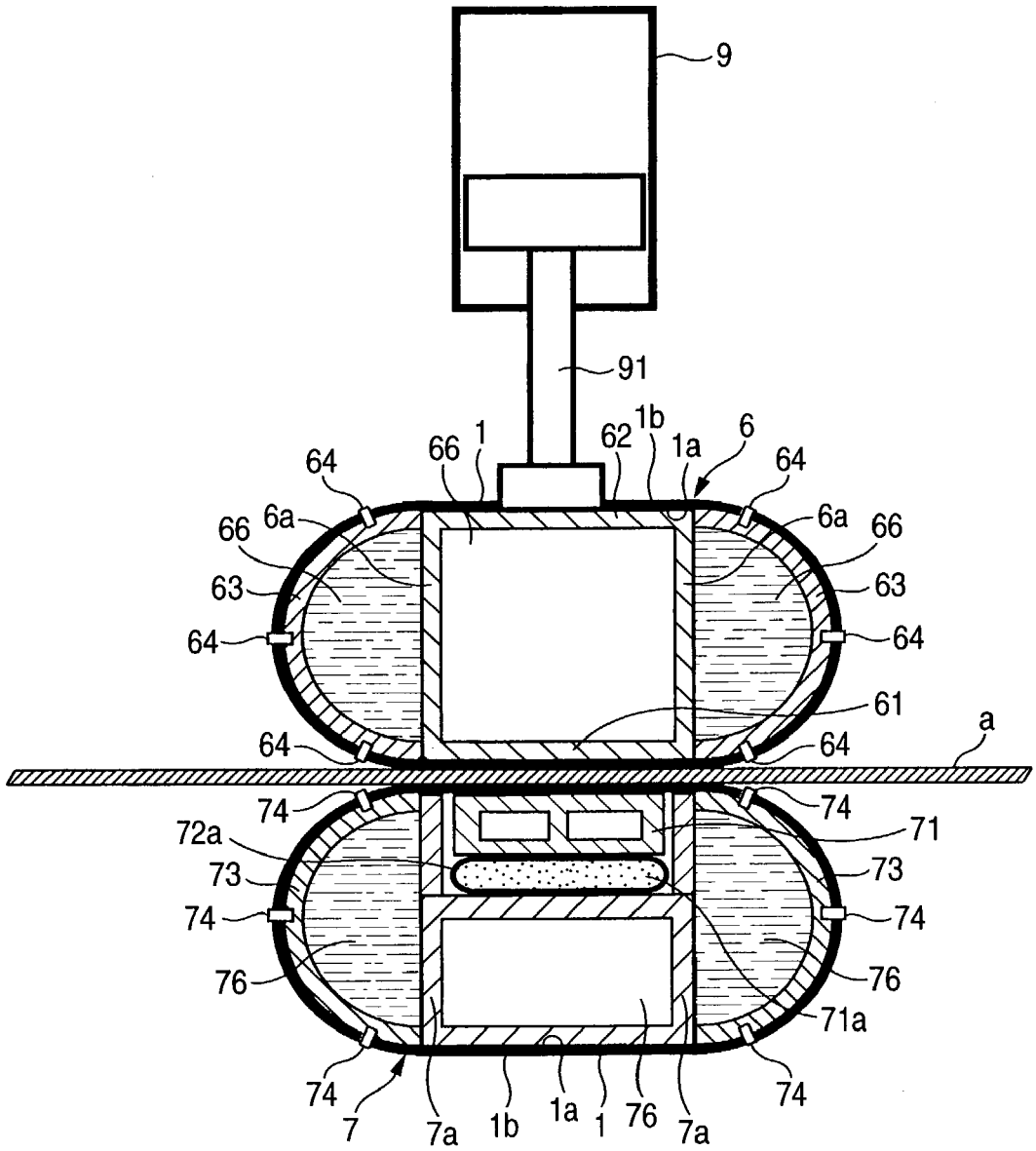
FIG. 7 is a cross sectional view showing a basic construction of an embodiment-2 of the present invention.
Figure 8:
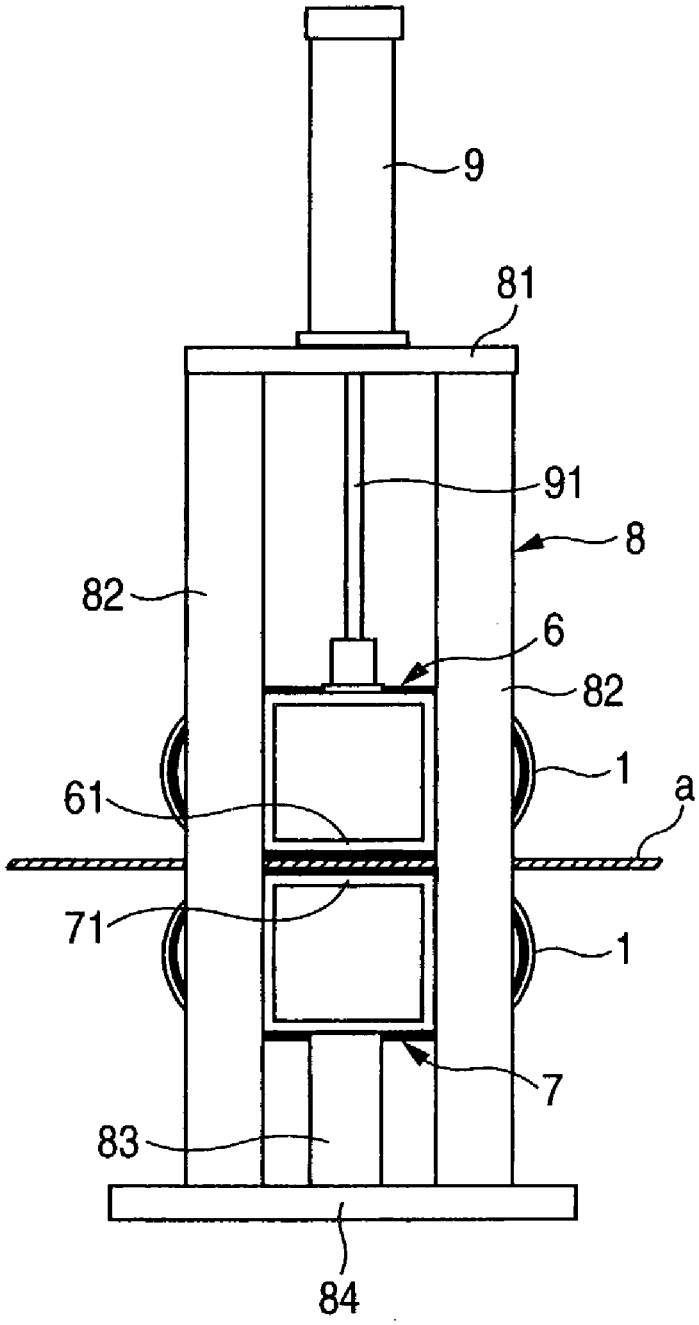
FIG. 8 is a side view showing an overall band sheet coiling tension applying apparatus of the embodiment-2 of the invention.
Figure 9:
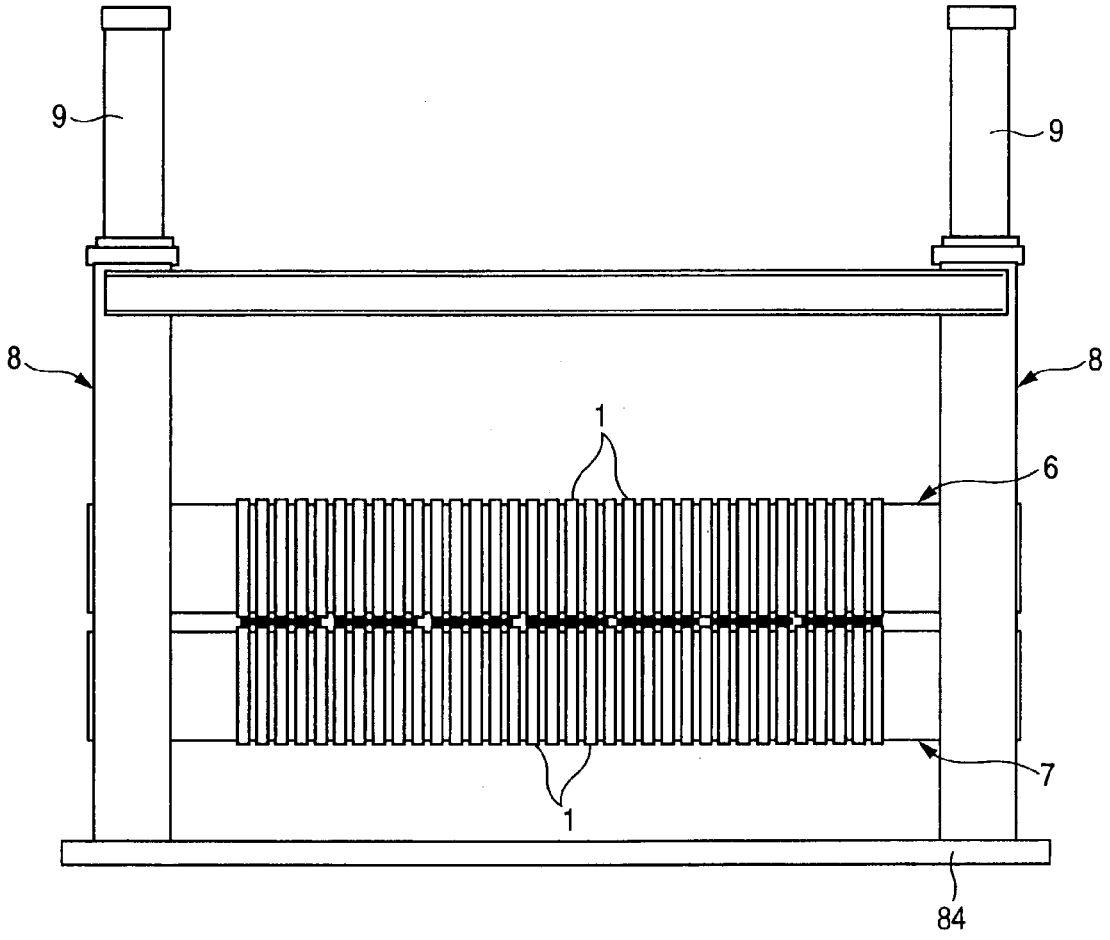
FIG. 9 is a front view showing an overall band sheet coiling tension applying apparatus of the embodiment-3 of the invention.

FIG. 7 is a cross sectional view showing a basic construction of an embodiment-2 of the present invention. FIG. 8 is a side view showing an overall band sheet coiling tension applying apparatus of the embodiment. FIG. 9 is a front view showing the overall band sheet coiling tension applying apparatus of the embodiment.

The band sheet coiling tension applying apparatus is an apparatus for applying a predetermined coiling tension to a slit band sheets "a". The band sheet coiling tension applying apparatus is disposed at the middle of a moving path of the slit band sheets "a" in front of a slit band sheet coiling apparatus "b" (see FIG. 20).

The band sheet coiling tension applying apparatus is composed mainly of a couple of upper and lower endless belts 1, a couple of upper and lower pressure applying members 6 and 7, a stand 8, and a hydraulic cylinder 9. The endless belts 1 are held to be freely circularly movable in an elliptic shape fashion, while being vertically and oppositely disposed. The upper and lower side, endless belts 1 freely circulate around the upper and lower pressure applying members 6 and 7 in an elliptical shape fashion. Those pressure applying members press the inner surfaces 1*a* of the endless belts 1. The stands 8 supports both the pressure applying members 6 and 7. The hydraulic cylinder 9 applies a depressing force to the upper pressure applying member 6.

The upper pressure applying member 6 presses downward the endless belts 1 disposed in an upper part, while the lower pressure applying member 7 presses upward the endless belts 1 disposed in a lower part. The upper and lower pressure applying members 6 and 7 cooperate to compress the slit band sheets "a", which pass through between the upper and lower endless belts 1 vertically and oppositely disposed, indirectly with aid of the endless belts 1, whereby a fixed tension is applied to the slit band sheets.

The endless belt 1 are disposed to freely circulate in the moving directions of the slit band sheets "a". Specifically, a set of the endless belts is arranged in a lateral directional, viz., direction orthogonal to the moving directions of the slit band sheets "a". Those sets of endless belts are arranged vertically or one above the other.

The endless belts 1, which are vertically disposed and arranged laterally and side by side, are each formed with an endless belt. Those endless belts 1 are installed around the outer periphery of the upper pressure applying member 6 which is disposed in an upper part and oval in cross section, and the lower periphery of the upper pressure applying member 7 which is disposed in a lower part and oval in cross section, in a state that those belts are held to be independently and freely circularly movable in an oval shape fashion. Those endless belts 1 are able to independently circulate in the moving direction of the slit band sheet "a".

The upper and lower pressure applying members 6 and 7 on which the endless belts 1 are installed, do not include drive sources for circulating the endless belts 1. The endless belts 1 are circularly moved by a friction engagement between the belts and the moving slit band sheets "a". And those never circulate by their own power. In other words, the endless belts 1 installed respectively on the upper and lower pressure applying members 6 and 7, will circulate until the belts contact with the slit band sheets "a".

An outer surface 1*b* of each endless belt 1 functions to move the slit band sheet "a" in unison with the slit band sheets "a". The inner surfaces 1*a* of the endless belts 1 functions to generate a tension in the slit band sheets "a" by a friction force by a slip between the upper and lower pressure applying members 6 and 7. For this reason, a coefficient of friction of the inner surface 1*a* of the endless belt 1 is smaller than that of the outer surface 1*b*, and the inner surface is easy to slip.

The inner surface 1*a* of the endless belt 1 is formed with a woven fabric made of synthetic fibers so as to allow a lubricant to penetrate into the fibers and sunken parts of the knit meshes of the woven fabric. The outer surface 1*b* of the endless belt 1 is formed with a relatively thin, flexible material which has a low compressive elasticity and such a hardness as to generate little compression strain even under pressure.

Use of the woven fabric for the inner surface 1*a* of the endless belt 1 brings about the following advantages. A friction coefficient of the belt may be set to be small by impregnating the fibers and the sunken parts of the knit meshes of the woven fabric with a lubricant in advance. A rotation resistance of the endless belt installed onto the upper pressure applying member 6 (7) is small since the woven fabric is more flexible than a plate-like member. The woven fabric may be made of synthetic fibers of polyester, vinylon, nylon or the like.

In the case of the endless belts associated with the complete round shaped pressure applying member, a material constituting the belt must have sufficiently large compressive elasticity and recovery property in the thickness direction, and the belt utilizes a compression elastic strain of the belt in its pressed state close to a linear contact of the complete round shaped tension applying member. A pressed area (of the endless belts) is considerably large in the invention of the present patent application, when comparing with the endless belts just mentioned. Therefore, a low surface pressure suffices to secure a friction resistance (tension) comparable with that in the complete round case. And in the invention, there is no need of a compression strain deformation resistance, which is essential to the case of the complete round shaped pressure applying member. Accordingly, the endless belt exhibits satisfactory functions by using the combined synthetic resin materials which are relatively thin and small in compressive elasticity. Further, the fibers and the sunken parts of the knit meshes of the woven fabric may be impregnated with a lubricant in advance. Therefore, there is no limit of the material of the endless belt to a combination of the material of the inner surface 1*a* and the material of the outer surface 1*b* of the endless belt 1 of which the friction coefficients are different from each other.

The outer surface 1*b* of the endless belt 1 may be made of a material whose friction coefficient is larger than that of the inner surface 1*a*. Specifically, the inner surface 1*a* of the endless belt 1 is made of a material having good abrasion resistance, for example, a soft synthetic resin-based material having a low friction coefficient. The outer surface of the endless belt is made of an elastic material having a high friction coefficient, for example, rubber or synthetic resin. If required, a coefficient of friction of the inner surface 1*a* of the endless belt maybe smaller than that of the outer surface 1*b* by coating the inner surfaces 1*a* of the endless belts 1 and the sliding surfaces of the upper and lower pressure applying members 2 and 3, with a lubricant.

The upper pressure applying member 6 is disposed while being passed through the inner pat of a number of endless belts 1 located in the upper part. The upper pressure applying member 6 thus disposed is integrally formed with a belt pressing part 61 which has a linear shaped side surface for directly pressing the inner surfaces 1*a* of the endless belts 1, a belt guide part 62 which has a linear shaped side surface and is disposed parallel to and above the belt pressing part 61, and belt reversing parts 63 which are respectively formed on both sides of the belt guide part 62 and the belt pressing part 61, and are arcuate, e.g., semi-arcuate, in cross section.

The upper pressure applying member 6 is integrally formed with the upper and lower, belt guide part 62 and belt pressing part 61, and the belt reversing parts 63 located on both sides thereof, and is, for example, oval in cross section. The belt reversing part 63 may take a partially ellipse arc shape or a partially parabolic shape other than the semi-arc shape. In this case, the upper pressure applying member 6 is oval in cross section. The upper pressure applying member 6 is disposed with its longitudinal direction being orthogonal to the moving direction of the slit band sheets "a", and is passed through the inner part of an array of the endless belts 1.

The endless belts 1, laterally arranged side by side, independently circulate around the upper pressure applying member 6 having an oval cross sectional shape. The peripheral surface of the upper pressure applying member 6 has an oval shape so as to allow the endless belts 1 to smoothly circulate around the upper pressure applying member 6 in an oval shape fashion.

The belt pressing part 61 functions such that it presses the slit band sheet "a" by a surface pressure of a surface having a predetermined length in the moving direction of the slit band sheet "a" with the endless belts 1 being interposed therebetween, to thereby applying a coiling tension to the slit band sheet "a" To this end, the belt pressing part 61 is linear in shape while having a predetermined length in the moving direction of the slit band sheet "a", and is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 61, are circulated at a speed equal to that of the moving slit band sheet "a", in unison with the slit band sheet "a" and without their slippage, in a state that the outer surfaces 1*b* of the endless belts 1 are in close contact with the slit band sheet "a". The surface of the belt pressing part 61, which comes in contact with the endless belts 1, is flat, and is finished to have a small friction between it and the inner surfaces 1*a* of the endless belts 1.

A plurality of belt guide protrusions 64 are protruded from the outer periphery of the upper pressure applying member 6, while being circumferentially arranged at fixed intervals in the circumferential direction. Those belt guide protrusions guide those separate endless belts 1 laterally arranged side by side. The belt guide protrusions 64 prevent the endless belts 1 from taking a zig-zag motion or varying in the width direction of the endless belt 1. Specifically, the belt guide protrusions 64 are provided on both the belt reversing parts 63 at proper spatial intervals, and if necessary, may be provided on the belt guide parts 62. Usually, pins are used for the belt guide protrusions 64, and sometimes belt guide plates, for example, are used in addition to the pins. Where the belt guide plates are used as shown in FIG. 4, the belt guide plates are arcuately installed on the belt reversing parts 63 in a protruded fashion, respectively. The belt guide protrusions 64 formed with pins are protruded from the belt reversing parts 63, while being located on both sides of the belt guide plate A cooling chamber 66 is disposed within the upper pressure applying member 6 in a state that it extends across the array of the endless belts 1. The cooling chamber 66 functions to cool and to prevent the endless belts 1 circulating around the upper pressure applying member 6, from overheating by friction heat. The cooling chamber 66 includes a water cooling chamber and an air cooling chamber. This is just the same as of the embodiment-1. When the passing slit band sheet "a" is thick, and its moving speed is high, friction heat generated is large and it is likely to be overheated. In such a situation, the water cooling chamber is used. The air cooling chamber is used in such a situation that the passing slit band sheet "a" is thin, its moving speed is low, and it is hard to be overheated.

The inner space of the cooling chamber 66 is partitioned, by an inner partitioning plate 6*a,* into three sectional spaces, inner spaces of the belt reversing parts 63 on both sides thereof, and an inner space of the belt pressing part 61 at the middle part. Sometimes, the inner space of the belt pressing part 61 is partitioned into more than three sectional spaces by inner partitioning plates (not shown) or by two or more number of inner partitioning plates. In some cases, some of the inner partitioning plates each of which partitions the inner space of the belt pressing part 61 into a plurality of sectional inner spaces, are partially bored, and the sectional inner spaces parted by one of such inner partitioning plates communicate with each other. The technical feature that the inner space is further partitioned by the inner partitioning plates (not shown) is just the same as of the embodiment-1.

Those inner partitioning plates 6*a,* which partition the inner space of the upper pressure applying member 6, function to retain the shape of the upper pressure applying member 6 the inside of which is hollowed because of presence of the chamber 66. A compressing force vertically acts on the upper pressure applying member 6, which presses downward the endless belts 1. The inner partitioning plate 6*a* resists the vertical compressing force to prevent the upper pressure applying member 6 from being flexed or bent in its longitudinal direction. This technical feature is just the same as of the embodiment-1.

The lower pressure applying member 7 is disposed while being passed through the inner part of a number of endless belts 1 located in the lower part. The lower pressure applying member 7 thus disposed is integrally formed with a belt pressing part 71 which has a linear shaped side surface for directly pressing the inner surfaces 1*a* of the endless belts 1, an expandable bag body 71*a* disposed under the belt pressing part 71, a recess part 72*a* for accommodating the belt pressing part 71 and the expandable bag body 71*a,* a belt guide part 72 which has a linear shaped side surface and is disposed parallel to and under the recess part 72*a,* and belt reversing parts 73 which are respectively formed on both sides of the belt pressing part 71 and the belt guide part 72 and have each an arc or semi-arc shaped side surface.

The belt pressing part 71 is unconnected to the belt guide part 72 and the belt reversing parts 73 on both sides. The belt guide part 72 and the belt reversing parts 73 on both sides are integrally provided. The recess part 72*a* in which the belt pressing part 71 and the expandable bag body 71*a* are housed, is formed in upper and center part of the lower pressure applying member 7 where the belt pressing part 71 is disposed.

The lower pressure applying member 7, which is integrally formed with upper and lower belt guide parts 71, belt guide part 72, and the belt reversing parts 73 located on both sides thereof, is, for example, oval in cross section. Each belt reversing part 73 may take a partially elliptical shape or a partially ellipse-arcuately shape other than the arc shape. In this case, the lower pressure applying member 7 is oval in cross section. The lower pressure applying member 7 is disposed such that its longitudinal direction is orthogonal to the moving direction of the slit band sheets "a", and is passed through the inner part of an array of the endless belts 1.

The endless belts 1, laterally arranged side by side, independently circulate around the lower pressure applying member 7 having an oval cross sectional shape. The peripheral surface of the lower pressure applying member 7 is finished to have an oval shape so as to allow the endless belts 1 to smoothly circulate around the lower pressure applying member 7 in an oval shape fashion.

The belt pressing part 71 functions such that it is pressed by the expandable bag body 71*a,* and presses the slit band sheet "a" by a pressure by a surface having a predetermined length in the moving direction of the slit band sheet "a" in a state that the endless belts 1 are interposed between the belt pressing part and the slit band sheet, whereby it applies a coiling tension to the slit band sheet "a". To this end, the belt pressing part 71 is linearly shaped to have a predetermined length in the moving direction of the slit band sheet "a" so that it is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 71, are circulated at a speed equal to that of the moving slit band sheets "a", in unison with the slit band sheet "a" and without their slippage, in a state that the outer surfaces 1*b* of the endless belts 1 are in close contact with the slit band sheet "a". The surface of the belt pressing part 71, which comes in contact with the endless belts 1, is flat, and is finished to have a small friction between it and the inner surfaces 1*a* of the endless belts 1.

The expandable bag body 71*a* is held in a state that it is put between the belt pressing part 71 and the bottom surface of the recess part 72*a*. The expandable bag body 71*a* is formed with a hollowed bag having a predetermined width and a predetermined length. The longitudinal direction of the expandable bag body is orthogonal to the moving direction of the slit band sheet "a", and the bag body is passed through the inner part of the endless belts 1 laterally arranged side by side. The expandable bag body 71*a* is filled with a fluid of gas or liquid, and sealed up. The expandable bag body is made of a material having a good sealing property of preventing the fluid from leaking out of the bag body, and a good expandability. A synthetic resin may typically be enumerated for such a material.

The expandable bag body 71*a* is expanded and contracted by a pressure of the fluid contained in the expandable bag body 71*a.* A flat surface of the lower part of the belt pressing part 71, located above the expandable bag body, is uniformly pressed by utilizing a nature of the fluid pressure. And, the expandable bag body 71*a* is capable of uniformly pressing the slit band sheet "a" with the aid of the belt pressing part 71. A pressing force for pressing the belt pressing part 71 is varied by varying a pressure of the fluid contained in the expandable bag body 71*a,* and a pressing force for pressing the slit band sheet "a" may be varied by the belt pressing part 71. Gas, e.g., air, or liquid, e.g., oil, is used for the fluid.

A plurality of belt guide protrusions 74 are protruded from the outer periphery of the lower pressure applying member 7, while being arranged at fixed intervals in the circumferential direction. Those belt guide protrusions guide those separate endless belts 1 laterally arranged side by side. The belt guide protrusions 74 prevent the endless belts 1 from taking a zig-zag motion and varying in the width direction of the endless belt 1. Specifically, the belt guide protrusions 74 are provided on both the belt reversing parts 73 at proper spatial intervals, and if necessary, may be provided on the belt guide parts 72. Usually, pins are used for the belt guide protrusions 74, and sometimes belt guide plates, for example, are used in addition to the pins. When the belt guide plates are used as shown in FIG. 4, the belt guide plates are arcuately installed on the belt reversing parts 73 in a protruded fashion, respectively. The belt guide protrusions 74 formed with pins are protruded from the belt reversing parts 73, while being located on both sides of the belt guide plate.

A cooling chamber 76 is disposed within the lower pressure applying member 7 in a state that it extends across the array of the endless belts 1. The cooling chamber 76 functions to cool and to prevent the endless belts 1 circulating around the lower pressure applying member 7, from overheating by friction heat. The cooling chamber 76 includes a water cooling chamber and an air cooling chamber. This is just the same as of the embodiment-1. When the passing slit band sheet "a" is thick, and its moving speed is high, friction heat generated is large and it is likely to be overheated. In such a situation, the water cooling chamber is used. The air cooling chamber is used in such a situation that the passing slit band sheet "a" is thin, its moving speed is low, and it is hard to be overheated.

The inner space of the cooling chamber 76 is partitioned, by an inner partitioning plate 7*a,* into three sectional spaces, inner spaces of the belt reversing parts 73 on both sides thereof, and a lower inner part of the recess part 72*a* at the middle part.

Sometimes, the lower inner part of the recess part 72*a* is partitioned into more than three sectional spaces by inner partitioning plates (not shown) or by two or more number of inner partitioning plates. In some cases, some of the inner partitioning plates each of which partitions the lower inner part of the recess part 72*a* into a plurality of sectional inner spaces, are partially bored, and the sectional inner spaces parted by one of such inner partitioning plates communicate with each other. The technical feature that the inner space is further partitioned by the inner partitioning plates (not shown) is just the same as of the embodiment-1.

Those inner partitioning plates 7*a,* which partition the inner space of the lower pressure applying member 7, function to retain the shape of the lower pressure applying member 7 the inside of which is hollowed because of presence of the chamber 76. A compressing force vertically acts on the upper pressure applying member 7, which presses downward the endless belts 1. The inner partitioning plate 7*a* resists the vertical compressing force to prevent the upper pressure applying member 7 from being flexed or bent in its longitudinal direction. The technical feature is just the same as of the embodiment-1.

The center parts of both ends of the upper pressure applying member 6 and the upper pressure applying member 6 are fit to a gate-like stand 8 installed on both sides of them. The upper pressure applying member 6 is coupled with the stand 8 while being freely movable up and down. The center parts of both ends of the lower pressure applying member 7 are supported by a support beam 83.

The stand 8, which is installed on both sides of the upper pressure applying member 6 and the lower pressure applying member 7, is shaped like a gate, and is formed with an upper lateral beam 81 and right and left vertically extending beams 82 for supporting the lower parts of both ends of the upper lateral beam 81. The stand 8 supports the upper pressure applying member 6 and the lower pressure applying member 7. The upper pressure applying member 6 is moved up and down inside the stand 8, viz., a space enclosed by the upper lateral beam 81 and the right and left vertical beams 82. The vertical beams 82 are longer in height than the ascending/descending length of the upper pressure applying member 6. The stand 8, which is installed on both sides o the upper pressure applying member 6 and the lower pressure applying member 7, are secured at the lower end to a plate-like base 84.

A hydraulic cylinder 9 is provided on the upper end of the mid-part of the upper lateral beam 81 of the gate-like stand 8. The hydraulic cylinder 9 has at least two functions: to move up and down the upper pressure applying member 6 and to apply to the moving-up/down upper pressure applying member 6 a depressing force to be applied to the endless belt 1. The hydraulic cylinder 9 may be an oil cylinder.

The hydraulic cylinder 9 is suspended at the upper end from the center position of the lower end of the upper lateral beam 81, whereby the hydraulic cylinder is expandable downward. A piston rod 91, which extends downward from the upper end, extends downward through the upper lateral beam 81. The lower end of the piston rod 91 is coupled to the upper end of the mid-position between both the side ends of the upper pressure applying member 6. The hydraulic cylinder 9 presses down both the side ends of the upper pressure applying member 6.

When the piston rod 91 of the hydraulic cylinder 9 extends downward, the upper pressure applying member 6 both sides ends of which are coupled thereto also descends.

A depressing force exerts on the endless belts 1, The upper pressure applying member 6 and the lower pressure applying member 7 cooperate to compress the slit band sheet "a" and applies a coiling tension to the slit band sheet a When the piston rod 91 of the hydraulic cylinder 9 retracts, the upper pressure applying member 6 also ascends, the depressing force acting on the endless belts 1 disappears, and the coiling tension of the slit band sheet "a" caused by the endless belts 1 also disappears.

A pressure adjusting device (not shown) is associated with the hydraulic cylinder 9, and adjusts a hydraulic pressure to the hydraulic cylinder 9 so as to provide a tension as determined in accordance with a thickness and width of the slit band sheet "a".

Operation of the band sheet coiling tension applying apparatus thus constructed will be described. When the piston rod 91 of the hydraulic cylinder 9, which is suspended from the center of the upper end of the upper lateral beams 81 of the stands 8 disposed on both sides of the upper and lower pressure applying members 6 and 7, is retracted, then the upper pressure applying member 6 both side ends of which are coupled to the lower end of the piston rod 91, ascends, and the upper and lower pressure applying members 6 and 7 are vertically moved apart from each other.

Each slit band sheet "a" is passed through between the outer surfaces 1*b* of the endless belts 1 as moved apart from each other. The piston rod 91 of the hydraulic cylinder 9 is extended downward to lower the upper pressure applying member 6. The upper and lower pressure applying members 6 and 7 are made to approach to each other to be in contact with each other and the setting work of the slit band sheet "a" is completed. A fluid is fed into the expandable bag body 71*a* under the belt pressing part 71 of the lower pressure applying member 7 to expand the expandable bag body 71*a*. The fluid is forcibly fed into the expandable bag body 71*a* by means of a pump, not shown.

The expanded expandable bag body 71*a* presses the belt pressing part 71 above the expandable bag body 71*a*. The expandable bag body 71*a* presses, by an equal force, the entire a real range of the belt pressing part 71, which is in contact with the expandable bag body 71*a*, by the utilization of the nature of the fluid that ever point in the fluid is at an equal pressure. Then, the belt pressing part 71 is pressed upward by the upward expansion of the expandable bag body 71*a* as expanded, so that the upper surface thereof is brought into completely close contact with the inner surfaces 1*a* of the under side, endless belts 1. The belt pressing part 71 as pressed upward by the fluid of the expandable bag body 71*a* presses the endless belts 1 upward, and the outer surfaces 1*b* of the endless belts 1 are brought into completely close contact with the reverse side of the slit band sheet "a".

The upper side, endless belts 1, which are in contact with the front surface of the slit band sheet "a", presses upward the inner surfaces 1*a* of the upper side, endless belts 1 by a counterforce, or the belt pressing part 61 of the upper pressure applying member 6, whereby the outer surfaces 1*b* of the endless belts 1 are brought into close contact with the front surfaces of the slit band sheets "a". The front and back sides of the slit band sheets "a" are pressed by equal forces by the outer surfaces 1*b* of the endless belts 1 which are vertically and oppositely arranged. At this time, a pressure is uniformly applied to the entire front and back sides of the slit band sheet "a" being in close contact with the outer surfaces 1*b* of the endless belts 1, which are vertically and oppositely arranged, because of the nature of the fluid that ever point in the fluid is at an equal pressure.

When the operation of coiling the slit band sheets "a" starts, the upper and lower side, endless belts 1 circulate around the oval, upper and lower pressure applying members 6 and 7 in an oval shape fashion, by a friction caused by the close contact between the obverse and reverse sides of the moving slit band sheets "a" and the outer surfaces 1*b* of the upper and lower side, endless belts 1. At this time, the upper and lower side, endless belts 1 independently circulate at equal speeds without their slippage on the moving slit band sheets "a".

By a friction force caused by a slip between the surfaces of the belt pressing part 61 of the upper pressure applying member 6 and the belt pressing part 71 of the lower pressure applying member 7, viz., their friction engagement with the moving slit band sheet "a", the belt pressing part 61 and the belt pressing part 71, which press the inner surfaces 1*a* of the endless belts 1 circulating in an oval shape fashion, function like a brake to thereby a necessary coiling tension in the slit band sheet "a" between the slit band sheet coiling apparatus "b" (see FIG. 20) and the band sheet coiling tension applying apparatus. Also, the generated tension may be adjusted as desired by controlling the fluid pressure in the upper pressure applying member 6.

[Embodiment 3]

Figure 10:
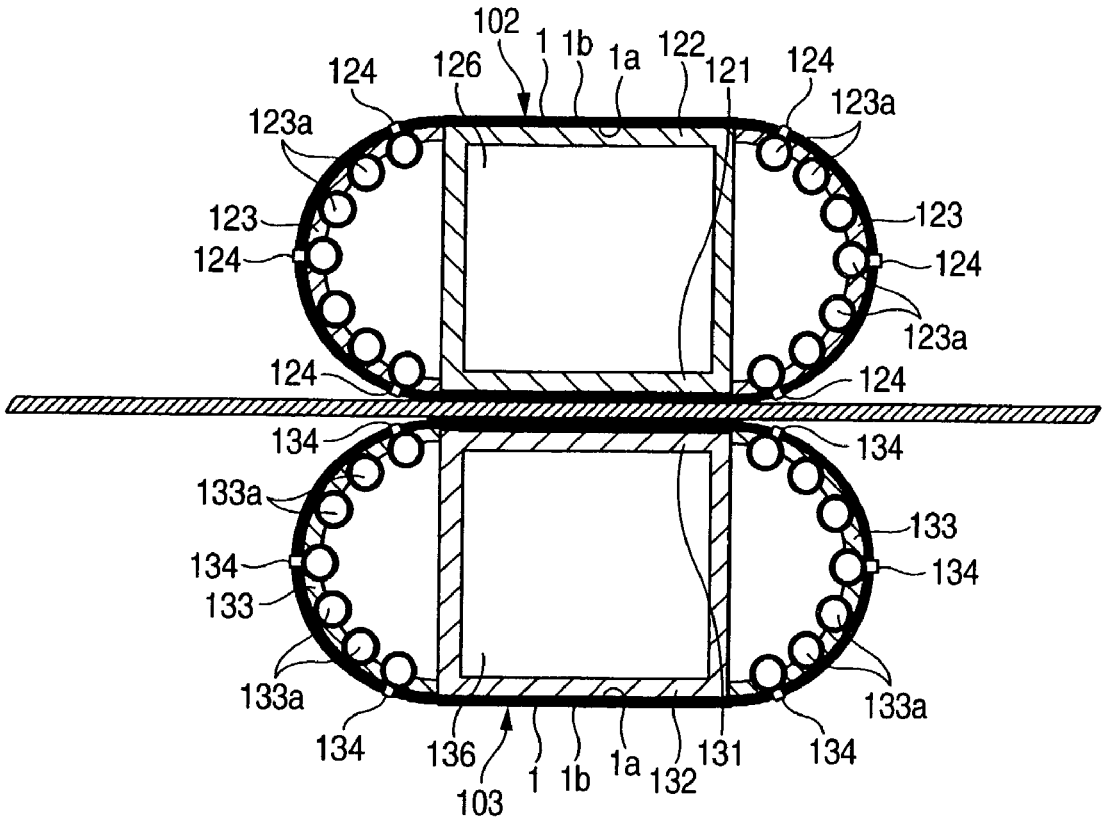
FIG. 10 is a cross sectional view showing a basic construction of an embodiment-3 of the present invention.
Figure 11:
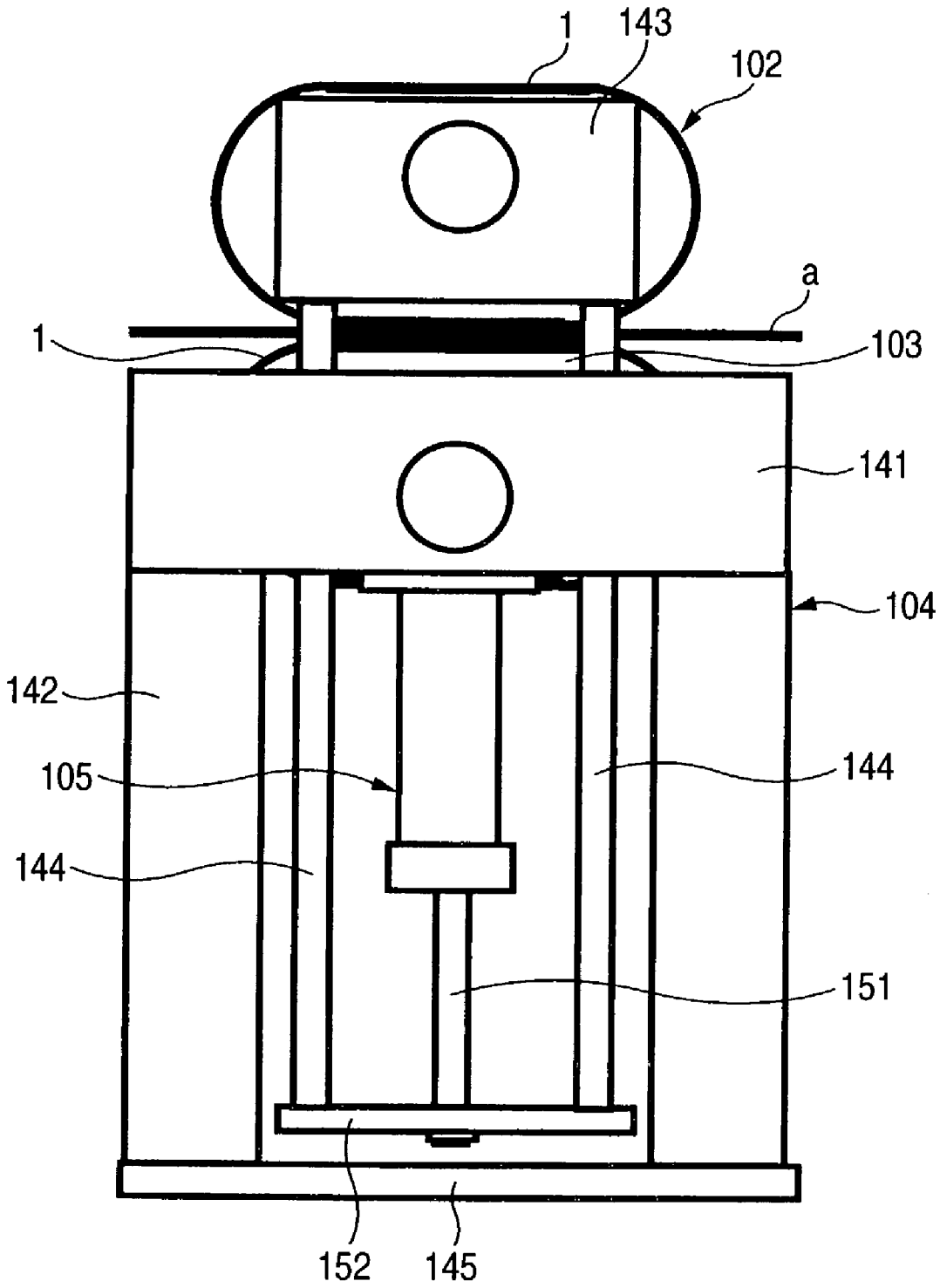
FIG. 11 is a side view showing an overall band sheet coiling tension applying apparatus of the embodiment-3 of the invention.
Figure 12:
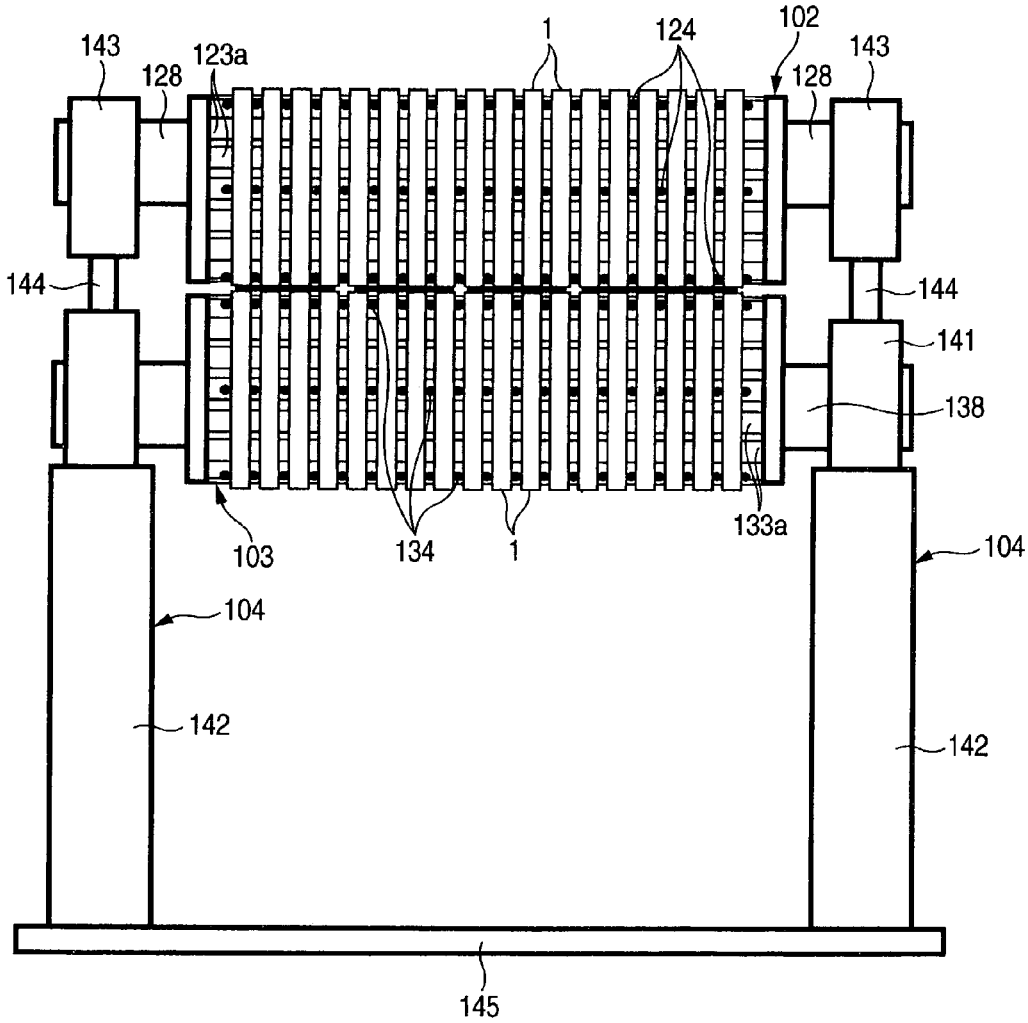
FIG. 12 is a front view showing an overall band sheet coiling tension applying apparatus of the embodiment-3 of the invention.
Figure 13:
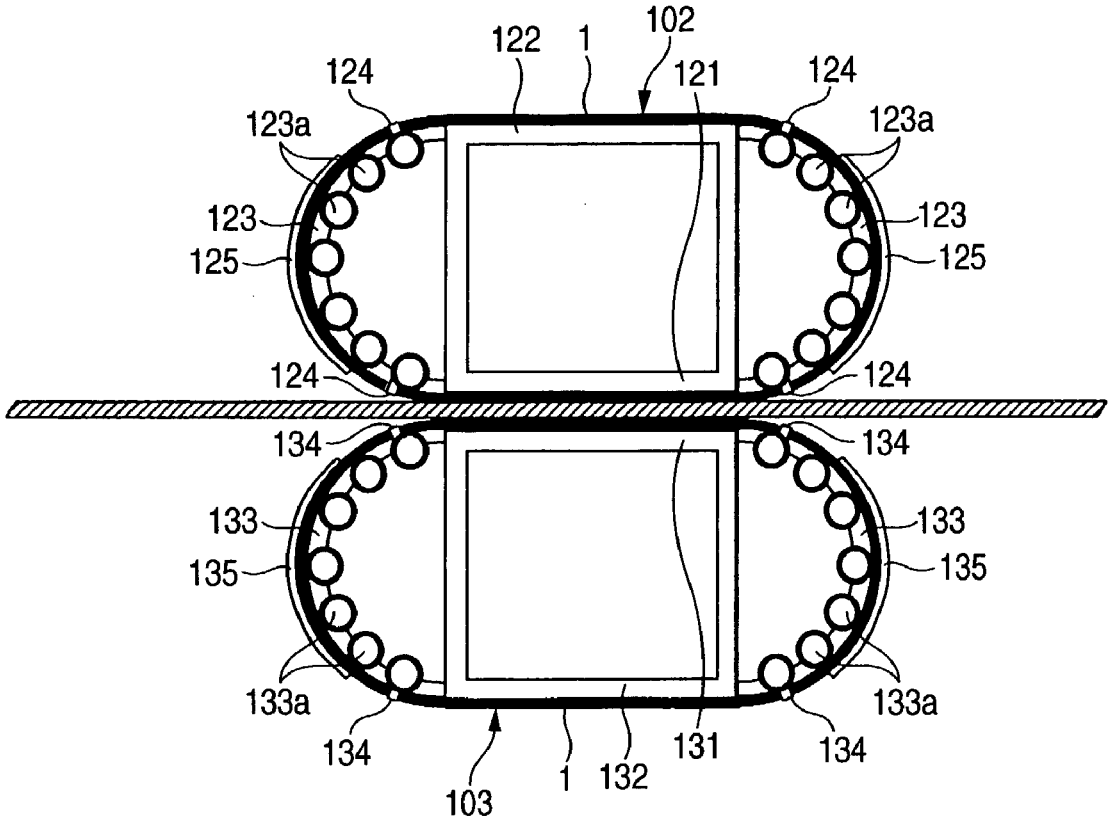
FIG. 13 is a cross sectional view showing an instance where belt guide protrusions are formed with pins and plates in the embodiment-3.
Figure 14:
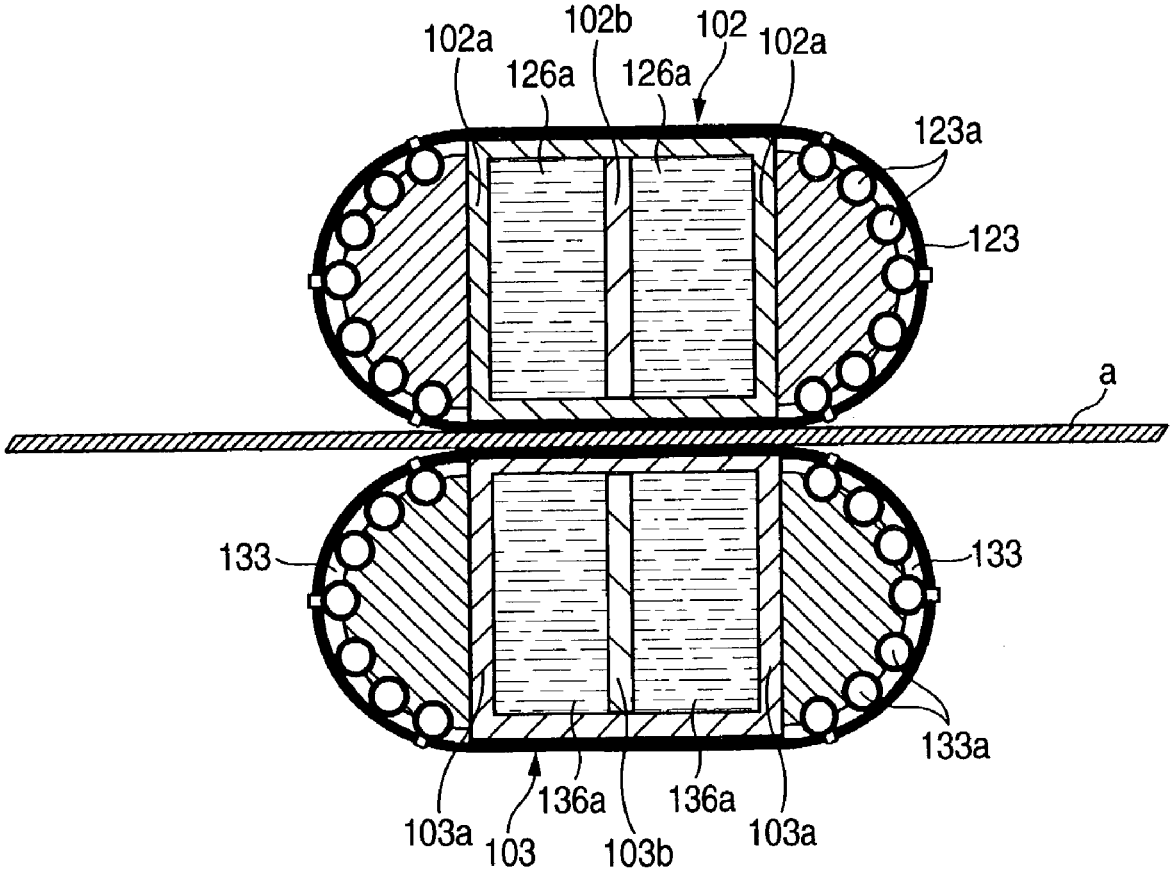
FIG. 14 is a cross sectional view showing a construction equipped with a water cooling chamber in the embodiment-3.
Figure 15A:
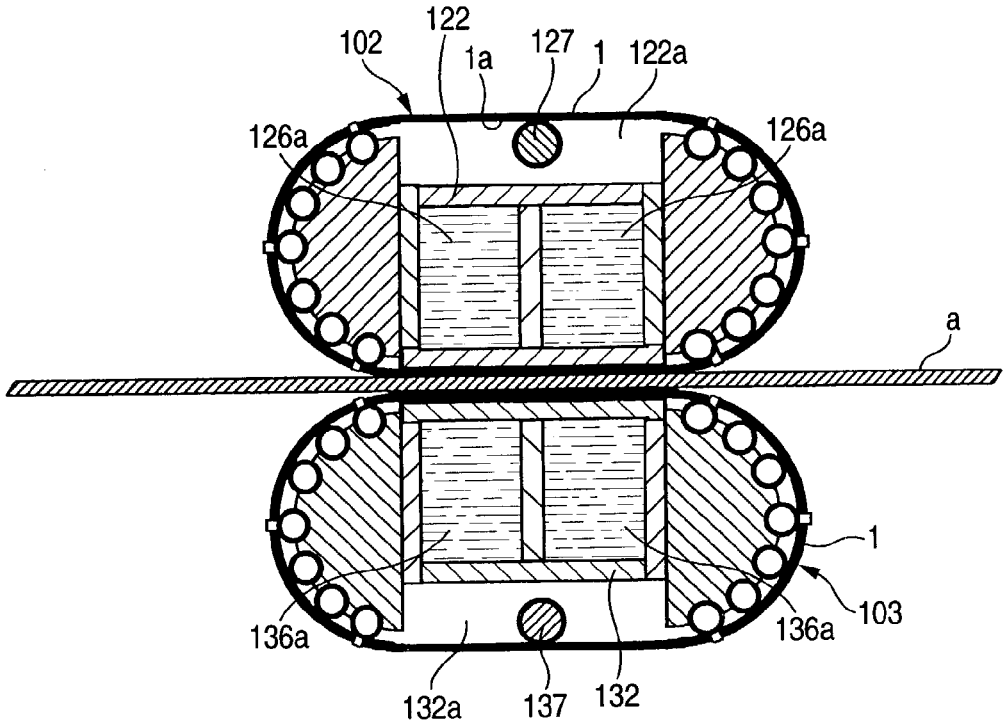
FIG. 15 is a cross sectional view showing a modification of the embodiment-3 of the invention.
Figure 15B:
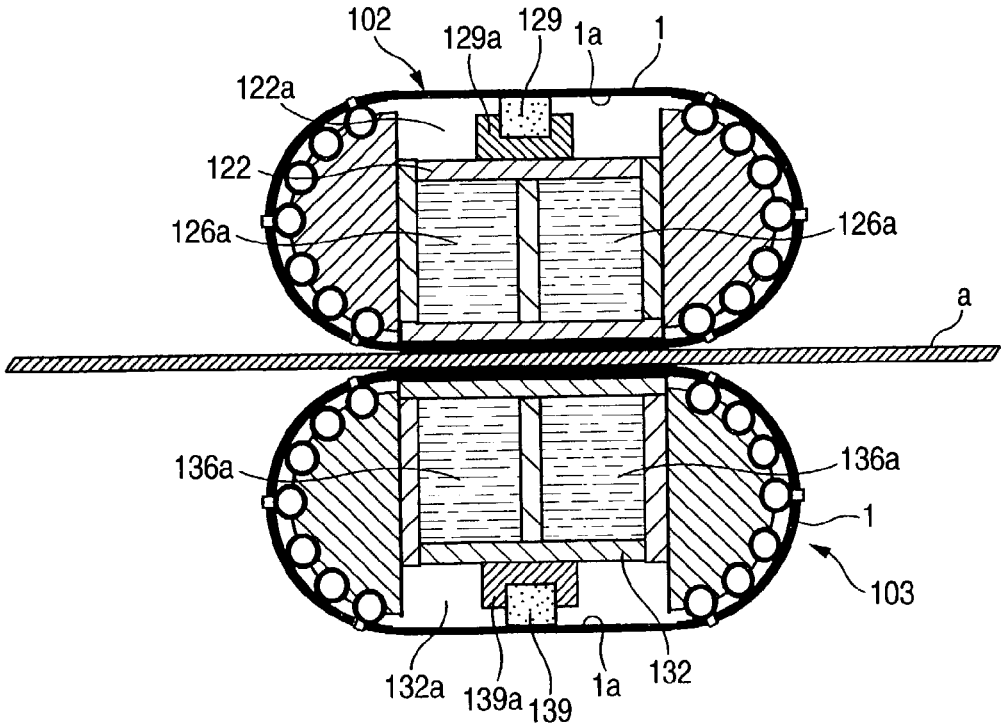

FIG. 10 is a cross sectional view showing a basic construction of an embodiment-3 of the present invention. FIG. 11 is a side view showing an overall band sheet coiling tension applying apparatus of the embodiment. FIG. 12 is a front view showing the overall band sheet coiling tension applying apparatus of the embodiment. FIG. 13 is a cross sectional view showing an instance where pins and plates are combined for the belt guide protrusions in the embodiment. FIG. 14 is a cross sectional view showing a construction equipped with a water cooling chamber in the embodiment-3. FIGS. 15A and 15B are cross sectional views cooperatively showing a modification of the embodiment-3 of the invention.

The band sheet coiling tension applying apparatus is an apparatus for applying a predetermined coiling tension to a slit band sheets "a". The band sheet coiling tension applying apparatus is disposed at the middle of a moving path of the slit band sheets "a" in front of a slit band sheet coiling apparatus "b" (see FIG. 20).

The band sheet coiling tension applying apparatus is composed mainly of a couple of upper and lower endless belts 1, a couple of upper and lower pressure applying members 102 and 103, a stand 104, and a hydraulic cylinder 105. The endless belts 1 are held to be freely circularly movable in an elliptic shape fashion, while being vertically and oppositely disposed. The upper and lower side, endless belts 1 freely circulate around the upper and lower pressure applying members 102 and 103 in an elliptical shape fashion. Those pressure applying members press the inner surfaces 1*a* of the endless belts 1. The stands 104 supports both the pressure applying members 102 and 103. The hydraulic cylinder 105 applies a depressing force to the upper pressure applying member 102.

The upper pressure applying member 102 presses downward the endless belts 1 disposed in an upper part, while the lower pressure applying member 103 presses upward the endless belts 1 disposed in a lower part. The upper and lower pressure applying members 102 and 103 cooperate to compress the slit band sheets "a", which pass through between the upper and lower endless belts 1 vertically and oppositely disposed, indirectly with aid of the endless belts 1, whereby a fixed tension is applied to the slit band sheets.

The endless belt 1 are disposed to freely circulate in the moving directions of the slit band sheets "a". Specifically, a set of the endless belts is arranged in a lateral directional, viz., direction orthogonal to the moving directions of the slit band sheets "a". Those sets of endless belts are arranged vertically or one above the other.

The endless belts 1, which are vertically disposed and arranged laterally and side by side, are each formed with an endless belt. Those endless belts 1 are installed around the outer periphery of the upper pressure applying member 102 which is disposed in an upper part and oval in cross section, and the lower periphery of the upper pressure applying member 103 which is disposed in a lower part and oval in cross section, in a state that hose belts are held to be independently and freely circularly movable in an oval shape fashion. Those endless belts 1 are able to independently circulate in the moving direction of the slit band sheet "a".

The upper and lower pressure applying members 102 and 103 on which the endless belts 1 are installed, do not include drive sources for circulating the endless belts 1. The endless belts 1 are circularly moved by a friction engagement between the belts and the moving slit band sheets "a". And those never circulate by their own power. In other words, the endless belts 1 installed respectively on the upper and lower pressure applying members 102 and 103, will circulate until the belts contact with the slit band sheets "a".

An outer surface 1*b* of each endless belt 1 functions to move the slit band sheet "a" in unison with the slit band sheets "a". The inner surfaces 1*a* of the endless belts 1 functions to generate a tension in the slit band sheets "a" by a friction force by a slip between the upper and lower pressure applying members 102 and 103. For this reason, a coefficient of friction of the inner surface 1*a* of the endless belt 1 is smaller than that of the outer surface 1*b,* and the inner surface is easy to slip.

The inner surface 1*a* of the endless belt 1 is formed with a woven fabric made of synthetic fibers so as to allow a lubricant to penetrate into the fibers and sunken parts of the knit meshes of the woven fabric. The outer surface 1*b* of the endless belt 1 is formed with a relatively thin, flexible material which has a low compressive elasticity and such a hardness as to generate little compression strain even under pressure.

Use of the woven fabric for the inner surface 1*a* of the endless belt 1 brings about the following advantages. A friction coefficient of the belt may be set to be small by impregnating the fibers and the sunken parts of the knit meshes of the woven fabric with a lubricant in advance. A rotation resistance of the endless belt installed onto the upper pressure applying member 102 (103) is small since the woven fabric is more flexible than a plate-like member. The woven fabric may be made of synthetic fibers of polyester, vinylon, nylon or the like.

In the case of the endless belts associated with the complete round shaped pressure applying member, a material constituting the belt must have sufficiently large compressive elasticity and recovery property in the thickness direction, and the belt utilizes a compression elastic strain of the belt in its pressed state close to a linear contact of the complete round shaped tension applying member. A pressed area (of the endless belts) is considerably large in the invention of the present patent application, when comparing with the endless belts just mentioned. Therefore, a low surface pressure suffices to secure a friction resistance (tension) comparable with that in the complete round case. And in the invention, there is no need of a compression strain deformation resistance, which is essential to the case of the complete round shaped pressure applying member. Accordingly, the endless belt exhibits satisfactory functions by using the combined synthetic resin materials which are relatively thin and small in compressive elasticity. Further, the fibers and the sunken parts of the knit meshes of the woven fabric may be impregnated with a lubricant in advance. Therefore, there is no limit of the material of the endless belt to a combination of the material of the inner surface 1*a* and the material of the outer surface 1*b* of the endless belt 1 of which the friction coefficients are different from each other.

The outer surface 1*b* of the endless belt 1 may be made of a material whose friction coefficient is larger than that of the inner surface 1*a*. Specifically, the inner surface 1*a* of the endless belt 1 is made of a material having good abrasion resistance, for example, a soft synthetic resin-based material having a low friction coefficient. The outer surface of the endless belt is made of an elastic material having a high friction coefficient, for example, rubber or synthetic resin. If required, a coefficient of friction of the inner surface 1*a* of the endless belt may be smaller than that of the outer surface 1*b.* by coating the inner surfaces 1*a* of the endless belts 1 and the sliding surfaces of the upper and lower pressure applying members 102 and 103, with a lubricant.

The upper pressure applying member 102 is disposed while being passed through the inner pat of a number of endless belts 1 located in the upper part. The upper pressure applying member 102 thus disposed is integrally formed with a belt pressing part 121 which has a linear shaped side surface for directly pressing the inner surfaces 1*a* of the endless belts 1, a belt guide part 122 which has a linear shaped side surface and is disposed parallel to and above the belt pressing part 121, and belt reversing parts 123 which are respectively formed on both sides of the belt guide part 122 and the belt pressing part 121, and belt reversing parts 123 each having a plurality of belt reversing guide members 123*a* arranged thereon at given intervals. The contact surfaces of the belt reversing guide members 123*a* to be in contact with the endless belts 1 are circular as viewed from side. The belt reversing parts 123 are each disposed such that a contact locus of each belt reversing part with the endless belts 1 is arcuate, e.g., semi-arcuate.

The upper pressure applying member 102, which is integrally formed with the upper and lower, belt guide part 122 and belt pressing part 121, and the belt reversing parts 123 located on both sides there of each including belt reversing guide members 123*a* semi-arcuately arranged, is, for example, oval in cross section. The plurality of belt reversing guide members 123*a* forming each belt reversing part 123 may be arranged semi-arcuately, partially ellipse-arcuately or partially parabolically. In this case, the upper pressure applying member 102 is oval in cross section. The upper pressure applying member 102 is integrally formed with the upper and lower, belt guide part 122 and belt pressing part 121, and the belt reversing parts 123 located on both sides thereof, and is, for example, oval in cross section. The belt reversing part 123 may take a partially ellipse arc shape or a partially parabolic shape other than the semi-arc shape. In this case, the upper pressure applying member 102 is oval in cross section. The upper pressure applying member 102 is disposed with its longitudinal direction being orthogonal to the moving direction of the slit band sheets "a", and is passed through the inner part of an array of the endless belts 1.

In the instant embodiment, the belt reversing guide members 123*a* forming each belt reversing part 123 are each a cylindrical member or a bar member circular in cross section of which the contact surface with the inner surfaces 1*a* of the endless belts 1 is circular. Also, in the embodiment, the belt reversing guide members 123*a* are fixedly mounted; however, those may rotatably be mounted sometimes. In the case where the belt reversing guide members 123*a* are used for the belt reversing part 123, air flows into the belt reversing part 123 through gaps between the belt reversing guide members 123*a,* whereby the air permeability is secured. Therefore, the air cooling effect is produced. In the case where the hollowed cylindrical members are used for the belt reversing guide members 123*a,* the cylindrical members are cooled by air passing therethrough, and more effective cooling effect is produced. In a case where cylindrical members, arcuate in cross section, which have grooves partially opened to the inside thereof are used for the belt reversing guide members 123*a,* the cooling effect is enhanced likewise.

The endless belts 1, laterally arranged side by side, independently circulate around the upper pressure applying member 102 having an oval cross sectional shape. The peripheral surface of the upper pressure applying member 102 has an oval shape so as to allow the endless belts 1 to smoothly circulate around the upper pressure applying member 102 in an oval shape fashion.

The belt pressing part 121 functions such that it presses the slit band sheet "a" by a surface pressure of a surface having a predetermined length in the moving direction of the slit band sheet "a" with the endless belts 1 being interposed therebetween, to thereby applying a coiling tension to the slit band sheet "a". To this end, the belt pressing part 121 is linear in shape while having a predetermined length in the moving direction of the slit band sheet "a", and is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 121, are circulated at a speed equal to that of the moving slit band sheet "a", in unison with the slit band sheet "a" and without their slippage, in a state that the outer surfaces 1*b* of the endless belts 1 are in close contact with the slit band sheet "a". The surface of the belt pressing part 121, which comes in contact with the endless belts 1, is flat, and is finished to have a small friction between it and the inner surfaces 1*a* of the endless belts 1.

A plurality of belt guide protrusions 124 are protruded from the outer periphery of the upper pressure applying member 102, while being circumferentially arranged at fixed intervals in the circumferential direction. Those belt guide protrusions guide those separate endless belts 1 laterally arranged side by side. The belt guide protrusions 124 prevent the endless belts 1 from taking a zig-zag motion or varying in the width direction of the endless belt 1. Specifically, the belt guide protrusions 124 are provided on both the belt reversing parts 123 at proper spatial intervals, and if necessary, may be provided on the belt guide parts 122. Usually, pins are used for the belt guide protrusions 124, and sometimes belt guide plates 125, for example, are used in addition to the pins. Where the belt guide plates 125 are used as shown in FIG. 13, the belt guide plates 125 are arcuately installed on the belt reversing parts 123 in a protruded fashion, respectively. The belt guide protrusions 124 formed with pins are protruded from the belt reversing parts 123, while being located on both sides of the belt guide plate 125.

A cooling chamber 126 is disposed within the upper pressure applying member 102 in a state that it extends across the array of the endless belts 1. The cooling chamber 126 functions to cool and to prevent the endless belts 1 circulating around the upper pressure applying member 102, from overheating by friction heat. The inner space of the cooling chamber 126 is partitioned, by an inner partitioning plate 102*a,* into three sectional spaces, inner spaces of the belt reversing parts 123 on both sides thereof, and an inner space of the belt pressing part 121 at the middle part. Sometimes, if necessary, the inner space of the belt pressing part 121 is partitioned into more than three sectional spaces by the inner partitioning plates 102*b* or by two or more number of inner partitioning plates 102*b.* In some cases, some of the inner partitioning plates 102*b* each of which partitions the inner space of the belt pressing part 121 into a plurality of sectional inner spaces, are partially bored, and the sectional inner spaces parted by one of such inner partitioning plates 102*b* communicate with each other.

Those inner partitioning plates 102*a* an 102*b,* which partition the inner space of the upper pressure applying member 102, function to retain the shape of the upper pressure applying member 102 the inside of which is hollowed because of presence of the chamber 126. A compressing force vertically acts on the upper pressure applying member 102, which presses downward the endless belts 1. The inner partitioning plates 102*a* and 102*b* resist the vertical compressing force to prevent the upper pressure applying member 102 from being flexed or bent in its longitudinal direction.

The cooling chamber 126 includes a water cooling chamber 126*a* and an air cooling chamber 126*b.* The water cooling chamber 126*a* exercises its cooling function by flowing water into the inside thereof, and the air cooling chamber 126*b* exercises its cooling function by flowing air into the inside thereof. When the passing slit band sheet "a" is thick, and its moving speed is high, friction heat generated is large and it is likely to be overheated. In such a situation, the water cooling chamber 126*a* is used. The air cooling chamber 126*b* is used in such a situation that the passing slit band sheet "a" is thin, its moving speed is low, and it is hard to be overheated.

A modification of the upper pressure applying member 102 is shown in FIG. 15. As shown, the belt guide part 122 on the rear side of the belt pressing part 121 is lower in height than the upper ends of the semi-arc, belt reversing parts 123, for example, on both sides thereof. And a recess part 122*a* is formed on the rear side of the belt pressing part 121. The upper pressure applying member of the modification has such a cross section shape that the upper part contains the groove and the remaining part is substantially oval. In this case, a gap is present between the upper side endless belts 1 and the inside of the recess part 122*a*. As shown in FIG. 15A, a belt tensioning roll 127 is disposed in the recess part 122*a*. The roll presses the inner surfaces 1*a* of the endless belts 1 to tighten the endless belts 1.

As shown in FIG. 15B, a lubricant 129 is disposed within the recess part 122*a,* in place of the belt tensioning roll 127 or together with the same. The lubricant is for lubricating the inner surfaces 1*a* of the endless belts 1. The lubricant 129 is contained in a recessed, lubricant holder 129*a* located on the bottom of the recess part 122*a*. The lubricant 129 may take the form of a bar-like non-woven fabric or porous foam impregnated with paraffin, which is solid at normal temperature and becomes liquid when it is heated to be high in excess of its melting point. The bar-like lubricant is located in contact with the inner surfaces 1*a* of the endless belts 1. The paraffin flows out of the lubricant by friction heat generated by the rotation of the endless belts 1, and lubricates the inner surfaces 1*a* of the endless belts 1 to reduce the friction coefficient thereof. Since the inner surfaces 1*a* of the endless belts 1 are lubricated by the lubricant 129 during their rotation, there is no necessity of frequently stopping the production line and lubricating the inner surfaces 1*a*. In this respect, the lubricant 129 provided within the recess part 122*a* contributes to improvement of the productivity.

The lower pressure applying member 103 is disposed while being passed through the inner part of a number of endless belts 1 located in the lower part. The lower pressure applying member 103 thus disposed is integrally formed with a belt pressing part 131 which has a linear shaped side surface for directly pressing the inner surfaces 1*a* of the endless belts 1, a belt guide part 132 which has a linear shaped side surface and is disposed parallel to and under the belt pressing part 131, and belt reversing parts 133 which are respectively provided on both sides of the belt pressing part 131 and the belt guide part 132, and belt reversing parts 133 each having a plurality of belt reversing guide members 133*a* arranged thereon at given intervals. The contact surfaces of the belt reversing guide members 133*a* to be in contact with the endless belts are circular as viewed from side. The belt reversing parts 133 are each disposed such that a contact locus of each belt reversing part with the endless belts 1 is arcuate, e.g., semi-arcuate.

The lower pressure applying member 103, which is integrally formed with the upper and lower, belt guide part 132*ad* belt pressing part 131, and the belt reversing parts 133 located on both sides thereof each including belt reversing guide members 133*a* semi-arcuately arranged, is, for example, oval in cross section. The plurality of belt reversing guide members 133*a* forming each belt reversing part 133 may be arranged semi-arcuately, partially ellipse-arcuately or partially parabolically. In this case, the upper pressure applying member 103 is oval in cross section. The lower pressure applying member 103 is disposed such that its longitudinal direction is orthogonal to the moving direction of the slit band sheets "a", and is passed through the inner part of an array of the endless belts 1.

In the instant embodiment, the belt reversing guide members 133*a* forming each belt reversing part 133 are each a cylindrical member or a bar member circular in cross section of which the contact surface with the inner surfaces 1*a* of the endless belts 1 is circular. Also, in the embodiment, the belt reversing guide members 133*a* are fixedly mounted; however, those may rotatably be mounted sometimes. In the case where the belt reversing guide members 133*a* are used for the belt reversing part 133, air flows into the belt reversing part 133, through gaps between the belt reversing guide members 133*a,* whereby the air permeability is secured. Therefore, the air cooling effect is produced. In the case where the hollowed cylindrical members are used for the belt reversing guide members 133*a,* the cylindrical members are cooled by air passing therethrough, and more effective cooling effect is produced. In a case where cylindrical members, arcuate in cross section, which have grooves partially opened to the inside thereof are used for the belt reversing guide members 133*a,* the cooling effect is enhanced likewise.

The endless belts 1, laterally arranged side by side, independently circulate around the lower pressure applying member 103 having a noval cross sectional shape. The peripheral surface of the lower pressure applying member 103 is finished to have an oval shape so as to allow the endless belts 1 to smoothly circulate around the lower pressure applying member 103 in an oval shape fashion.

The belt pressing part 131 functions such that it presses the slit band sheets "a" by a surface pressure of a surface having a predetermined length in the moving direction of the slit band sheet "a" in a state that the endless belts 1 are interposed between them, whereby it applies a coiling tension to the slit band sheet "a". To this end, the belt pressing part 131 is linearly shaped to have a predetermined length in the moving direction of the slit band sheet "a" so that it is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 131, are circulated at a speed equal to that of the moving slit band sheets "a", in unison with the slit band sheet "a" and without their slippage, in a state that the outer surfaces 1*b* of the endless belts 1 are in close contact with the slit band sheet "a". The surface of the belt pressing part 131, which comes in contact with the endless belts 1, is flat, and is finished to have a small friction between it and the inner surfaces 1*a* of the endless belts 1.

A plurality of belt guide protrusions 134 are protruded from the outer periphery of the lower pressure applying member 103, while being arranged at fixed intervals in the circumferential direction. Those belt guide protrusions guide those separate endless belts 1 laterally arranged side by side. The belt guide protrusions 134 prevent the endless belts 1 from taking a zig-zag motion and varying in the width direction of the endless belt 1. Specifically, the belt guide protrusions 134 are provided on both the belt reversing parts 133 at proper spatial intervals, and if necessary, may be provided on the belt guide parts 132. Usually, pins are used for the belt guide protrusions 134, and sometimes belt guide plates 135, for example, are used in addition to the pins. When the belt guide plates 135 are used as shown in FIG. 13, the belt guide plates 135 are arcuately installed on the belt reversing parts 133 in a protruded fashion, respectively. The belt guide protrusions 134 formed with pins are protruded from the belt reversing parts 133, while being located on both sides of the belt guide plate 135.

A cooling chamber 136 is disposed within the lower pressure applying member 103 in a state that it extends across the array of the endless belts 1. The cooling chamber 136 functions to cool and to prevent the endless belts 1 circulating around the lower pressure applying member 103, from overheating by friction heat. The inner space of the cooling chamber 136 is partitioned, by an inner partitioning plate 103*a,* into three sectional spaces, inner spaces of the belt reversing parts 133 on both sides thereof, and an inner space of the belt pressing part 131 at the middle part. Sometimes, the inner space of the belt pressing part 131 is partitioned into more than three sectional spaces by the inner partitioning plates 103*b* or by two or more number of inner partitioning plates 103*b*. In some cases, some of the inner partitioning plates 103*b* each of which partitions the inner space of the belt pressing part 131 into a plurality of sectional inner spaces, are partially bored, and the sectional inner spaces parted by one of such inner partitioning plates 103*b* communicate with each other.

Those inner partitioning plates 3*a* and 3*b,* which partition the inner space of the lower pressure applying member 103, function to retain the shape of the lower pressure applying member 103 the inside of which is hollowed because of presence of the chamber 136. A compressing force vertically acts on the lower pressure applying member 103, which presses downward the endless belts 1. The inner partitioning plates 103*a* and 103*b* resist the vertical compressing force to prevent the lower pressure applying member 103 from being flexed or bent in its longitudinal direction.

The cooling chamber 136 includes a water cooling chamber 136*a* and an air cooling chamber 136*b*. The water cooling chamber 136*a* exercises its cooling function by flowing water into the inside thereof, and the air cooling chamber 136*b* exercises its cooling function by flowing air into the inside thereof. When the passing slit band sheet "a" is thick, and its moving speed is high, friction heat generated is large and it is likely to be overheated. In such a situation, the water cooling chamber 136*a* is used. The air cooling chamber 136*b* is used in such a situation that the passing slit band sheet "a" is thin, its moving speed is low, and it is hard to be overheated.

A modification of the lower pressure applying member 103 is shown in FIG. 15. As shown, the belt guide part 132 on the rear side of the belt pressing part 131 is lower in height than the upper ends of the semi-arc, belt reversing parts 133, for example, on both sides thereof. And a recess part 132*a* is formed on the rear side of the belt pressing part 131. The lower pressure applying member of the modification has such a cross section shape that the lower part contains the groove and the remaining part is substantially oval. In this case, a gap is present between the lower side endless belts 1 and the inside of the recess part 132*a*. As shown in FIG. 15A, a belt tensioning roll 137 is disposed in the recess part 132*a*. The roll presses the inner surfaces 1*a* of the endless belts 1 to tighten the endless belts 1.

As shown in FIG. 15B, a lubricant 139 for lubricating the inner surfaces 1*a* of the endless belts 1 is disposed within the recess part 132*a,* in place of the belt tensioning roll 137 or together with the same. The lubricant 139 is contained in a recessed, lubricant holder 139*a* located on the bottom of the recess part 132*a*. The lubricant 139 may take the form of a bar-like non-woven fabric or porous foam impregnated with paraffin, which is solid at normal temperature and becomes liquid when it is heated to be high in excess of its melting point. It is located in contact with the inner surfaces 1*a* of the endless belts 1. The paraffin flows out of the lubricant by friction heat generated by the rotation of the endless belts 1, and lubricates the inner surfaces 1*a* of the endless belts 1 to reduce the friction coefficient thereof. Since the inner surfaces 1*a* of the endless belts 1 are lubricated by the lubricant 139 during their rotation, there is no necessity of frequently stopping the production line and lubricating the inner surfaces 1*a*. In this respect, the lubricant 139 provided within the recess part 132*a* contributes to improvement of the productivity.

Both ends of the lower pressure applying member 103 are rotatably supported by gate-like stands 104 disposed on both sides thereof, with the aid of a shaft 138. As shown, the end parts of the shaft 138 are respectively extended out of both ends of the lower pressure applying member 103. The end parts of the shaft 138 are shaft-supported at the center positions of upper lateral beams 141 of the gate-like stands 104.

Each of the gate-like stands 104, which are disposed on both sides of the lower pressure applying member 103, is formed with the upper lateral beam 141 and right and left vertical beams 142, which support the lower sides of both ends of the upper lateral beam 141. The stands 104 support the upper pressure applying member 102 and the lower pressure applying member 103. Upper bearings 143 for supporting both sides of the upper pressure applying member 102 are respectively provided above the upper lateral beams 141 of the gate-like stands in a liftable manner. The lower ends of the stands 104, located on both sides thereof, are secured to a plate-like base 145.

Both end sides of the upper pressure applying member 102 are supported at the shaft 128 by the gate-like stands 104. The end parts of the shaft 128 are protruded out of both ends of the upper pressure applying member 102, respectively. The end parts of the shaft 128 are supported at the center positions of the upper bearings 143, which are provided above the upper lateral beam 141 of the gate-like stands 104 in a liftable manner.

A hydraulic cylinder 105 is provided in the inner space of the gate-like stands 104, viz., a space defined by the upper lateral beam 141 and the right and left vertical beams 142. The hydraulic cylinder 105 vertically moves or lifts the upper bearings 143, and further applies a depressing force to the upper pressure applying member 102 through the lifting upper bearings 143. A hydraulic cylinder, for example, is used of the hydraulic cylinder 105.

The hydraulic cylinder 105 is suspended at the upper end from the center position of the lower end of the upper lateral beam 141, whereby the hydraulic cylinder is expandable downward. The lower end of the piston rod 151, which is extended downward from the lower end of the hydraulic cylinder 105, is coupled to a center position of a lateral coupling plate 152. The lower ends of lift shafts 144 are coupled to both ends of the lateral coupling plate 152, respectively. The lift shafts support the upper bearings 143 in a liftable manner.

The lift shafts 144, which vertically extend, are movably passed through the upper lateral beam 141, and the upper ends of the lift shafts, located above the upper lateral beam, are coupled to the lower ends of the upper bearings 143. When the lift shafts 144 are vertically moved by the hydraulic cylinder 105, the upper bearings 143, which support the upper pressure applying member 102, also vertically moves together with the lift shafts.

Specifically, when the piston rod 151 of the hydraulic cylinder 105 extends downward, the lift shafts 144 move downward. With the downward movement, the upper bearings 143 and the upper pressure applying member 102 also descend. A depressing force exerts on the endless belts 1. The upper pressure applying member 102 and the lower pressure applying member 103 cooperate to compress the slit band sheet "a" and applies a coiling tension to the slit band sheet "a".

When the piston rod 151 of the hydraulic cylinder 105 retracts, the lift shafts 144 ascend. With the ascending motion, the upper bearings 143 and the upper pressure applying member 102 also ascend. The depressing force acting on the endless belts 1 disappears, and the coiling tension of the slit band sheet "a" caused by the endless belts 1 also disappears.

In the illustration, the hydraulic cylinder 105 is installed downward, viz., it is suspended from the upper lateral beam 141, so that the piston rod 151 directed downward is extendible and retractable. In an alternative, the hydraulic cylinder 105 is installed upward, viz., the lower end of the hydraulic cylinder 105 is placed on the base 145 and the piston rod 151 is directed upward, and the piston rod 151 is extendible and retractable in a state that it is directed upward. A pressure adjusting device (not shown) is associated with the hydraulic cylinder 105, and adjusts a hydraulic pressure to the hydraulic cylinder 105 so as to provide a tension as determined in accordance with a thickness and width of the slit band sheet "a".

Operation of the band sheet coiling tension applying apparatus thus constructed will be described.

The piston rod 151 of the hydraulic cylinder 105, which is suspended within the gate-like stands 104 disposed on both sides of the upper and lower pressure applying members 102 and 103, is retracted, and the upper bearings 143 located above the gate-like stands 104 are lifted. With the lifting of the upper bearings 143, the upper pressure applying member 102 which is supported at both the ends by the upper bearings 143, ascends, and the upper and lower pressure applying members 102 and 103 are vertically moved apart from each other.

Slit band sheets "a" are passed through between the outer surfaces 1*b* of the endless belts 1 as moved apart from each other. The piston rod 151 of the hydraulic cylinder 105 is extended downward to lower the upper pressure applying member 102. The upper and lower pressure applying members 102 and 103 are made to approach to each other to be in contact with each other and the setting work of the slit band sheets "a" is completed. The slit band sheets "a" are compressed, by a predetermined pressing force, between the endless belts 1 mounted on the upper and lower pressure applying members 102 and 103.

The belt pressing part 121 of the upper pressure applying member 102 presses downward the inner surfaces 1*a* of the endless belts 1 to be brought into completely close contact with the inner surfaces 1*a*. The outer surfaces 1*b* of the endless belts 1, which is pressed downward by the belt pressing part 121, is brought into close contact with the surfaces of the slit band sheets "a". After the outer surfaces 1*b* of the endless belts 1 are in close contact with the surface of the slit band sheet "a", it presses the slit band sheets "a" downward.

The lower side, endless belts 1, which are in contact with the back surface of the slit band sheet "a", presses upward the inner surfaces 1*a* of the lower side, endless belts 1 by a counter force, or the belt pressing part 131 of the lower pressure applying member 103, whereby the outer surfaces 1*b* of the endless belts 1 are brought into close contact with the back surfaces of the slit band sheets "a". The front and back sides of the slit band sheets "a" are pressed by equal forces by the outer surfaces 1*b* of the endless belts 1 which are vertically and oppositely arranged. At this time, a pressure is applied uniformly to the entire front and back sides of the slit band sheets "a" being in close contact with the outer surfaces 1*b* of the endless belts 1 vertically and oppositely arranged.

When the operation of coiling the slit band sheets "a" starts, the upper and lower side, endless belts 1 circulate around the oval, upper and lower pressure applying members 102 and 103 in an oval shape fashion, by a friction caused by the close contact between the obverse and reverse sides of the moving slit band sheets "a" and the outer surfaces 1*b* of the upper and lower side, endless belts 1. At this time, the upper and lower side, endless belts 1 independently circulate at equal speeds without their slippage on the moving slit band sheets "a".

By a friction force caused by a slip between the surfaces of the belt pressing part 121 of the upper pressure applying member 102 and the belt pressing part 131 of the lower pressure applying member 103, viz., their friction engagement with the moving slit band sheet "a", the belt pressing part 121 and the belt pressing part 131, which press the inner surfaces 1*a* of the endless belts 1 circulating in an oval shape fashion, function like a brake to thereby a necessary coiling tension in the slit band sheet "a" between the slit band sheet coiling apparatus "b" (see FIG. 20) and the band sheet coiling tension applying apparatus.

[Embodiment-4]

Figure 16:
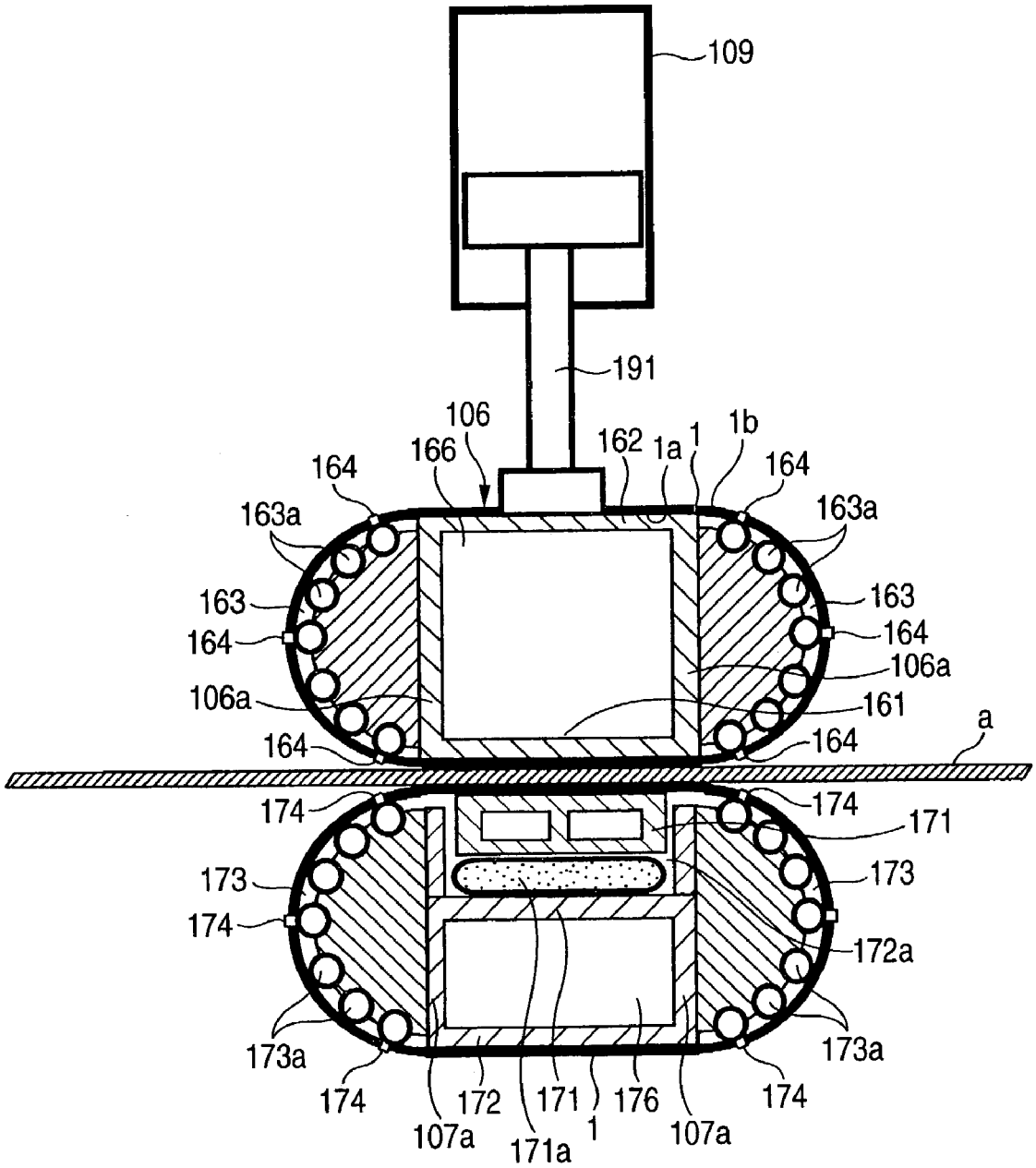
FIG. 16 is a cross sectional view showing a basic construction of an embodiment-4 of the present invention.
Figure 17:
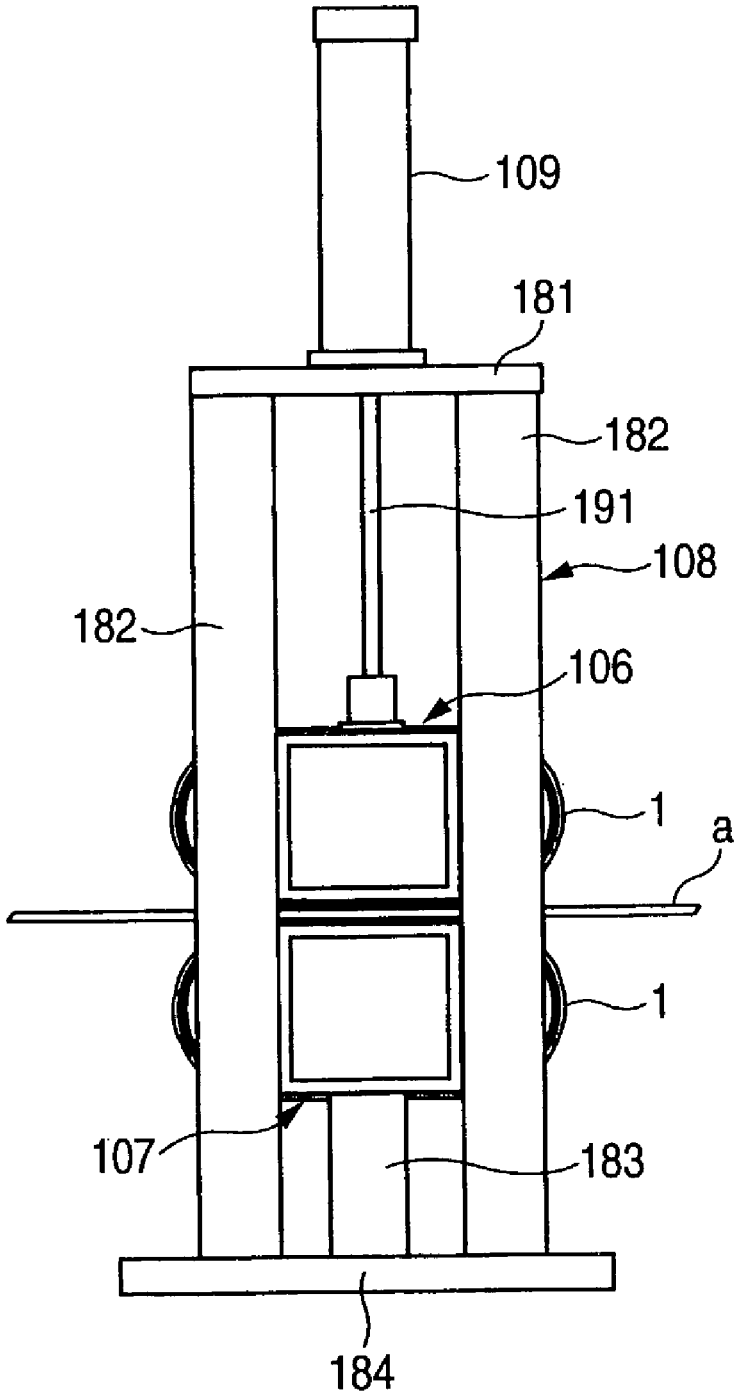
FIG. 17 is a side view showing an overall band sheet coiling tension applying apparatus of the embodiment-4 of the invention.
Figure 18:
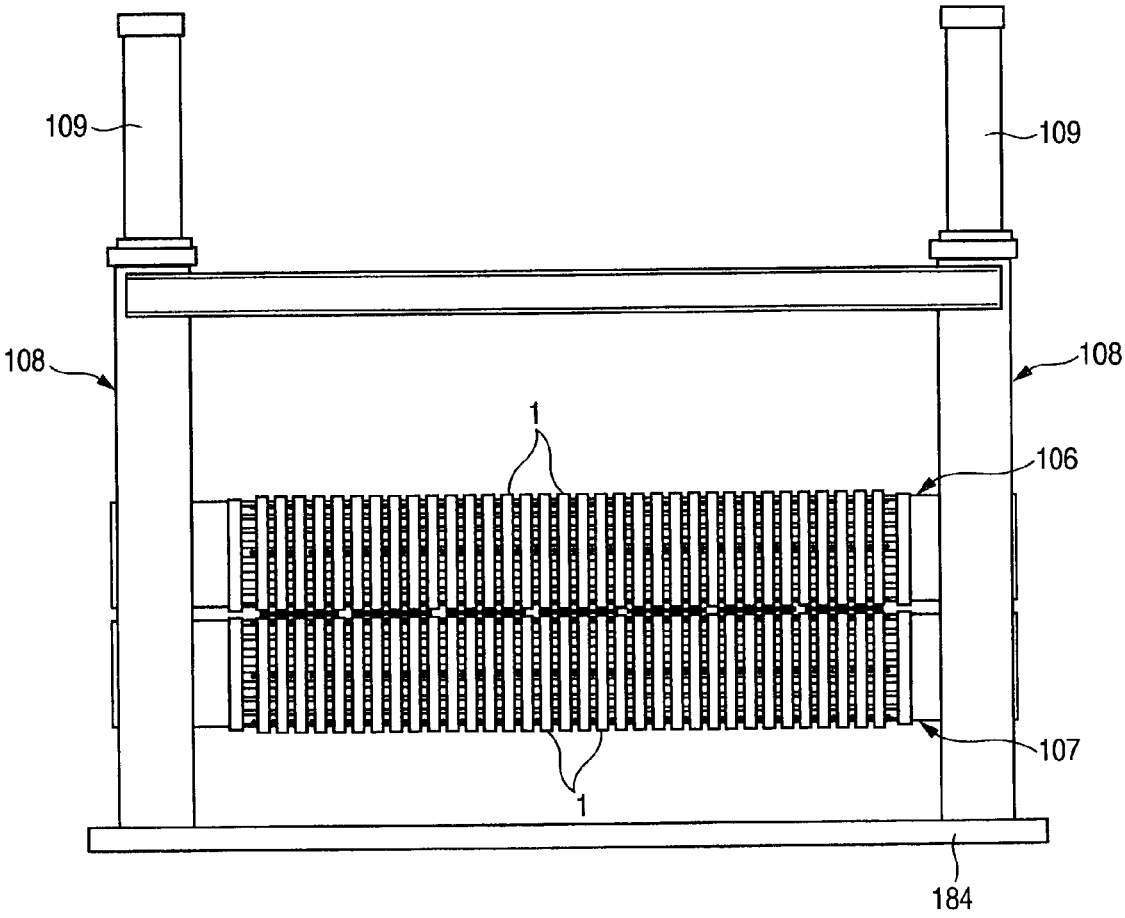
FIG. 18 is a front view showing an overall band sheet coiling tension applying apparatus of the embodiment-4 of the invention.
Figure 19:
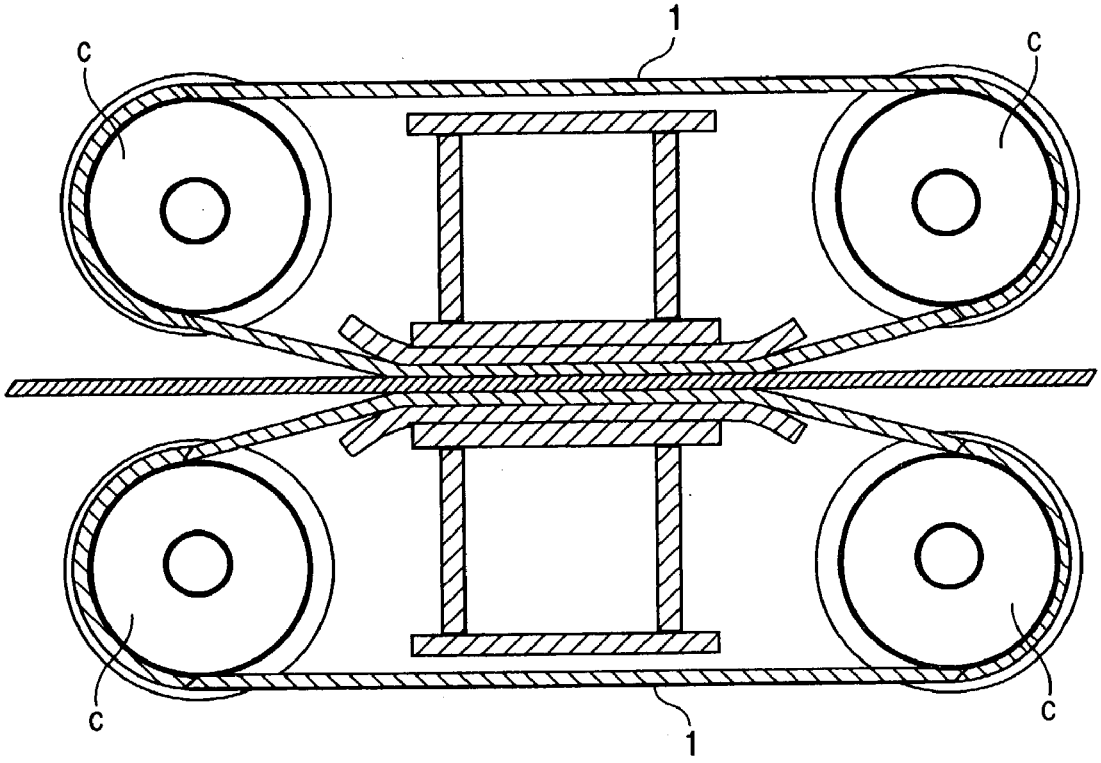
FIG. 19 is a cross sectional view showing a basic construction of a conventional band sheet coiling tension applying apparatus.

FIG. 16 is a cross sectional view showing a basic construction of an embodiment-4 of the present invention. FIG. 17 is a side view showing an overall band sheet coiling tension applying apparatus of the embodiment. FIG. 18 is a front view showing the overall band sheet coiling tension applying apparatus of the embodiment.

The band sheet coiling tension applying apparatus is an apparatus for applying a predetermined coiling tension to a slit band sheets "a". The band sheet coiling tension applying apparatus is disposed at the middle of a moving path of the slit band sheets "a" in front of a slit band sheet coiling apparatus "b" (see FIG. 20).

The band sheet coiling tension applying apparatus is composed mainly of a couple of upper and lower endless belts 1, a couple of upper and lower pressure applying members 106 and 107, a stand 108, and a hydraulic cylinder 109. The endless belts 1 are held to be freely circularly movable in an elliptic shape fashion, while being vertically and oppositely disposed. The upper and lower side, endless belts 1 freely circulate around the upper and lower pressure applying members 106 and 107 in an elliptical shape fashion. Those pressure applying members press the inner surfaces 1*a* of the endless belts 1. The stands 108 supports both the pressure applying members 106 and 107. The hydraulic cylinder 109 applies a depressing force to the upper pressure applying member 106.

The upper pressure applying member 106 presses downward the endless belts 1 disposed in an upper part, while the lower pressure applying member 107 presses upward the endless belts 1 disposed in a lower part. The upper and lower pressure applying members 106 and 107 cooperate to compress the slit band sheets "a", which pass through between the upper and lower endless belts 1 vertically and oppositely disposed, indirectly with aid of the endless belts 1, whereby a fixed tension is applied to the slit band sheets.

The endless belt 1 are disposed to freely circulate in the moving directions of the slit band sheets "a". Specifically, a set of the endless belts is arranged in a lateral directional, viz., direction orthogonal to the moving directions of the slit band sheets "a". Those sets of endless belts are arranged vertically or one above the other.

The endless belts 1, which are vertically disposed and arranged laterally and side by side, are each formed with an endless belt. Those endless belts 1 are installed around the outer periphery of the upper pressure applying member 106 which is disposed in an upper part and oval in cross section, and the lower periphery of the upper pressure applying member 107 which is disposed in a lower part and oval in cross section, in a state that hose belts are held to be independently and freely circularly movable in an oval shape fashion. Those endless belts 1 are able to independently circulate in the moving direction of the slit band sheet "a".

The upper and lower pressure applying members 106 and 107 on which the endless belts 1 are installed, do not include drive sources for circulating the endless belts 1. The endless belts 1 are circularly moved by a friction engagement between the belts and the moving slit band sheets "a". And those never circulate by their own power. In other words, the endless belts 1 installed respectively on the upper and lower pressure applying members 106 and 107, will circulate until the belts contact with the slit band sheets "a".

An outer surface 1*b* of each endless belt 1 functions to move the slit band sheet "a" in unison with the slit band sheets "a". The inner surfaces 1*a* of the endless belts 1 functions to generate a tension in the slit band sheets "a" by a friction force by a slip between the upper and lower pressure applying members 106 and 107. For this reason, a coefficient of friction of the inner surface 1*a* of the endless belt 1 is smaller than that of the outer surface 1*b,* and the inner surface is easy to slip.

The inner surface 1*a* of the endless belt 1 is formed with a woven fabric made of synthetic fibers so as to allow a lubricant to penetrate into the fibers and sunken parts of the knit meshes of the woven fabric. The outer surface 1*b* of the endless belt 1 is formed with a relatively thin, flexible material which has a low compressive elasticity and such a hardness as to generate little compression strain even under pressure.

Use of the woven fabric for the inner surface 1*a* of the endless belt 1 brings about the following advantages. A friction coefficient of the belt may be set to be small by impregnating the fibers and the sunken parts of the knit meshes of the woven fabric with a lubricant in advance. A rotation resistance of the endless belt installed onto the upper pressure applying member 106 (107) is small since the woven fabric is more flexible than a plate-like member. The woven fabric may be made of synthetic fibers of polyester, vinylon, nylon or the like.

In the case of the endless belts associated with the complete round shaped pressure applying member, a material constituting the belt must have sufficiently large compressive elasticity and recovery property in the thickness direction, and the belt utilizes a compression elastic strain of the belt in its pressed state close to a linear contact of the complete round shaped tension applying member. A pressed area (of the endless belts) is considerably large in the invention of the present patent application, when comparing with the endless belts just mentioned. Therefore, a low surface pressure suffices to secure a friction resistance (tension) comparable with that in the complete round case. And in the invention, there is no need of a compression strain deformation resistance, which is essential to the case of the complete round shaped pressure applying member. Accordingly, the endless belt exhibits satisfactory functions by using the combined synthetic resin materials which are relatively thin and small in compressive elasticity. Further, the fibers and the sunken parts of the knit meshes of the woven fabric may be impregnated with a lubricant in advance. Therefore, there is no limit of the material of the endless belt to a combination of the material of the inner surface 1*a* and the material of the outer surface 1*b* of the endless belt 1 of which the friction coefficients are different from each other.

The outer surface 1*b* of the endless belt 1 may be made of a material whose friction coefficient is larger than that of the inner surface 1*a*. Specifically, the inner surface 1*a* of the endless belt 1 is made of a material having good abrasion resistance, for example, a soft synthetic resin-based material having a low friction coefficient. The outer surface of the endless belt is made of an elastic material having a high friction coefficient, for example, rubber or synthetic resin. If required, a coefficient of friction of the inner surface 1*a* of the endless belt may be smaller than that of the outer surface 1*b* by coating the inner surfaces 1*a* of the endless belts 1 and the sliding surfaces of the upper and lower pressure applying members 106 and 107, with a lubricant.

The upper pressure applying member 106 is disposed while being passed through the inner pat of a number of endless belts 1 located in the upper part. The upper pressure applying member 106 thus disposed is integrally formed with a belt pressing part 161 which has a linear shaped side surface for directly pressing the inner surfaces 1*a* of the endless belts 1, a belt guide part 162 which has a linear shaped side surface and is disposed parallel to and above the belt pressing part 161, and belt reversing parts 163 which are respectively formed on both sides of the belt guide part 162 and the belt pressing part 161, and belt reversing parts 163 each having a plurality of belt reversing guide members 163*a* arranged thereon at given intervals. The contact surfaces of the belt reversing guide members 163*a* to be in contact with the endless belts 1 are circular as viewed from side. The belt reversing parts 163 are each disposed such that a contact locus of each belt reversing part with the endless belts 1 is arcuate, e.g., semi-arcuate.

The upper pressure applying member 106, which is integrally formed with the upper and lower, belt guide part 162 and belt pressing part 161, and the belt reversing parts 163 located on both sides thereof each including belt reversing guide members 163*a* semi-arcuately arranged, is, for example, oval in cross section. The plurality of belt reversing guide members 163*a* forming each belt reversing part 163 maybe arranged semi-arcuately, partially ellipse-arcuately or partially parabolically. In this case, the upper pressure applying member 106 is oval in cross section. The upper pressure applying member 106 is integrally formed with the upper and lower, belt guide part 162 and belt pressing part 161, and the belt reversing parts 163 located on both sides thereof, and is, for example, oval in cross section. The belt reversing part 163 may take a partially ellipse arc shape or a partially parabolic shape other than the semi-arc shape. In this case, the upper pressure applying member 106 is oval in cross section. The upper pressure applying member 106 is disposed with its longitudinal direction being orthogonal to the moving direction of the slit band sheets "a", and is passed through the inner part of an array of the endless belts 1.

In the instant embodiment, the belt reversing guide members 163*a* forming each belt reversing part 163 are each a cylindrical member or a bar member circular in cross section of which the contact surface with the inner surfaces 1*a* of the endless belts 1 is circular. Also, in the embodiment, the belt reversing guide members 163*a* are fixedly mounted; however, those may rotatably be mounted sometimes. In the case where the belt reversing guide members 163*a* are used for the belt reversing part 163, air flows into the belt reversing part 163 through gaps between the belt reversing guide members 163*a,* whereby the air permeability is secured. Therefore, the air cooling effect is produced. In the case where the hollowed cylindrical members are used for the belt reversing guide members 163*a,* the cylindrical members are cooled by air passing there through, and more effective cooling effect is produced. In a case where cylindrical members, arcuate in cross section, which have grooves partially opened to the inside thereof are used for the belt reversing guide members 163*a,* the cooling effect is enhanced likewise.

The endless belts 1, laterally arranged side by side, independently circulate around the upper pressure applying member 106 having an oval cross sectional shape. The peripheral surface of the upper pressure applying member 106 has an oval shape so as to allow the endless belts 1 to smoothly circulate around the upper pressure applying member 106 in an oval shape fashion.

The belt pressing part 161 functions such that it presses the slit band sheet "a" by a surface pressure of a surface having a predetermined length in the moving direction of the slit band sheet "a" with the endless belts 1 being interposed therebetween, to thereby applying a coiling tension to the slit band sheet "a". To this end, the belt pressing part 161 is linear in shape while having a predetermined length in the moving direction of the slit band sheet "a", and is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 161, are circulated at a speed equal to that of the moving slit band sheet "a", in unison with the slit band sheet "a" and without their slippage, in a state that the outer surfaces 1*b* of the endless belts 1 are in close contact with the slit band sheet "a". The surface of the belt pressing part 161, which comes in contact with the endless belts 1, is flat, and is finished to have a small friction between it and the inner surfaces 1*a* of the endless belts 1.

A plurality of belt guide protrusions 164 are protruded from the outer periphery of the upper pressure applying member 106, while being circumferentially arranged at fixed intervals in the circumferential direction. Those belt guide protrusions guide those separate endless belts 1 laterally arranged side by side. The belt guide protrusions 164 prevent the endless belts 1 from taking a zig-zag motion or varying in the width direction of the endless belt 1. Specifically, the belt guide protrusions 164 are provided on both the belt reversing parts 163 at proper spatial intervals, and if necessary, may be provided on the belt guide parts 162. Usually, pins are used for the belt guide protrusions 164, and sometimes belt guide plates, for example, are used in addition to the pins. Where the belt guide plates are used as shown in FIG. 13, the belt guide plates are arcuately installed on the belt reversing parts 163 in a protruded fashion, respectively. The belt guide protrusions 164 formed with pins are protruded from the belt reversing parts 163, while being located on both sides of the belt guide plate.

A cooling chamber 166 is disposed within the upper pressure applying member 106 in a state that it extends across the array of the endless belts 1. The cooling chamber 166 functions to cool and to prevent the endless belts 1 circulating around the upper pressure applying member 106, from overheating by friction heat. The cooling chamber 166 includes a water cooling chamber and an air cooling chamber. This is just the same as of the embodiment-1. When the passing slit band sheet "a" is thick, and its moving speed is high, friction heat generated is large and it is likely to be overheated. In such a situation, the water cooling chamber is used. The air cooling chamber is used in such a situation that the passing slit band sheet "a" is thin, its moving speed is low, and it is hard to be overheated.

The inner space of the cooling chamber 166 is partitioned, by an inner partitioning plate 106*a,* into three sectional spaces, inner spaces of the belt reversing parts 163 on both sides thereof, and an inner space of the belt pressing part 161 at the middle part. Sometimes, the inner space of the belt pressing part 161 is partitioned into more than three sectional spaces by inner partitioning plates (not shown) or by two or more number of inner partitioning plates. In some cases, some of the inner partitioning plates each of which partitions the inner space of the belt pressing part 161 into a plurality of sectional inner spaces, are partially bored, and the sectional inner spaces parted by one of such inner partitioning plates communicate with each other. The technical feature that the inner space is further partitioned by the inner partitioning plates (not shown) is just the same as of the embodiment-3.

Those inner partitioning plates 106*a,* which partition the inner space of the upper pressure applying member 106, function to retain the shape of the upper pressure applying member 106 the inside of which is hollowed because of presence of the chamber 166. A compressing force vertically acts on the upper pressure applying member 106, which presses downward the endless belts 1. The inner partitioning plate 106*a* resists the vertical compressing force to prevent the upper pressure applying member 106 from being flexed or bent in its longitudinal direction. This technical feature is just the same as of the embodiment-1.

The lower pressure applying member 107 is disposed while being passed through the inner part of a number of endless belts 1 located in the lower part. The lower pressure applying member 107 thus disposed is integrally formed with a belt pressing part 171 which has a linear shaped side surface for directly pressing the inner surfaces 1*a* of the endless belts 1, an expandable bag body 171*a* disposed under the belt pressing part 171, a recess part 172*a* for accommodating the belt pressing part 171 and the expandable bag body 171*a,* a belt guide part 172 which has a linear shaped side surface and is disposed parallel to and under the recess part 172*a,* and belt reversing parts 173 which are respectively formed on both sides of the belt pressing part 171 and the belt guide part 172, and belt reversing parts 173 each having a plurality of belt reversing guide members 173*a* arranged thereon at given intervals. The contact surfaces of the belt reversing guide members 173*a* to be in contact with the endless belts 1 are circular as viewed from side. The belt reversing parts 173 are each disposed such that a contact locus of each belt reversing part with the endless belts 1 is arcuate, e.g., semi-arcuate.

The belt pressing part 171 is unconnected to the belt guide part 172 and the belt reversing parts 173 on both sides. The belt guide part 172 and the belt reversing parts 173 on both sides are integrally provided. The recess part 172*a* in which the belt pressing part 171 and the expandable bag body 171*a* are housed, is formed in upper and center part of the lower pressure applying member 107 where the belt pressing part 171 is disposed.

The lower pressure applying member 107, which is integrally formed with the upper and lower belt pressing part 171 ad belt pressing part 172, and the belt reversing parts 173 located on both sides thereof each including belt reversing guide members 173*a* semi-arcuately arranged, is, for example, oval in cross section. The plurality of belt reversing guide members 173*a* forming each belt reversing part 173 may be arranged semi-arcuately, partially ellipse-arcuately or partially parabolically. In this case, the upper pressure applying member 102 is oval in cross section. The lower pressure applying member 107 is disposed such that its longitudinal direction is orthogonal to the moving direction of the slit band sheets "a", and is passed through the inner part of an array of the endless belts 1.

In the instant embodiment, the belt reversing guide members 173*a* forming each belt reversing part 173 are each a cylindrical member or a bar member circular in cross section of which the contact surface with the inner surfaces 1*a* of the endless belts 1 is circular. Also, in the embodiment, the belt reversing guide members 173*a* are fixedly mounted; however, those may rotatably be mounted sometimes. In the case where the belt reversing guide members 173*a* are used for the belt reversing part 173, air flows into the belt reversing part 173, through gaps between the belt reversing guide members 173*a,* whereby the air permeability is secured. Therefore, the air cooling effect is produced. In the case where the hollowed cylindrical members are used for the belt reversing guide members 173*a,* the cylindrical members are cooled by air passing therethrough, and more effective cooling effect is produced. In a case where cylindrical members, arcuate in cross section, which have grooves partially opened to the inside thereof are used for the belt reversing guide members 173*a,* the cooling effect is enhanced likewise.

The endless belts 1, laterally arranged side by side, independently circulate around the lower pressure applying member 107 having an oval cross sectional shape. The peripheral surface of the lower pressure applying member 107 is finished to have an oval shape so as to allow the endless belts 1 to smoothly circulate around the lower pressure applying member 107 in an oval shape fashion.

The belt pressing part 171 functions such that it is pressed by the expandable bag body 171*a,* and presses the slit band sheet "a" by a pressure by a surface having a predetermined length in the moving direction of the slit band sheet "a" in a state that the endless belts 1 are interposed between the belt pressing part and the slit band sheet, whereby it applies a coiling tension to the slit band sheet "a". To this end, the belt pressing part 171 is linearly shaped to have a predetermined length in the moving direction of the slit band sheet "a" so that it is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 171, are circulated at a speed equal to that of the moving slit band sheets "a", in unison with the slit band sheet "a" and without their slippage, in a state that the outer surfaces 1*b* of the endless belts 1 are in close contact with the slit band sheet "a". The surface of the belt pressing part 171, which comes in contact with the endless belts 1, is flat, and is finished to have a small friction between it and the inner surfaces 1*a* of the endless belts 1.

The expandable bag body 171*a* is held in a state that it is put between the belt pressing part 171 and the bottom surface of the recess part 172*a*. The expandable bag body 171*a* is formed with a hollowed bag having a predetermined width and a predetermined length. The longitudinal direction of the expandable bag body is orthogonal to the moving direction of the slit band sheet "a", and the bag body is passed through the inner part of the endless belts 1 laterally arranged side by side. The expandable bag body 171*a* is filled with a fluid of gas or liquid, and sealed up. The expandable bag body is made of a material having a good sealing property of preventing the fluid from leaking out of the bag body, and a good expandability. A synthetic resin may typically be enumerated for such a material.

The expandable bag body 171*a* is expanded and contracted by a pressure of the fluid contained in the expandable bag body 171*a*. A flat surface of the lower part of the belt pressing part 171, located above the expandable bag body, is uniformly pressed by utilizing a nature of the fluid pressure. And, the expandable bag body 171*a* is capable of uniformly pressing the slit band sheet "a" with the aid of the belt pressing part 171. A pressing force for pressing the belt pressing part 171 is varied by varying a pressure of the fluid contained in the expandable bag body 171*a,* and a pressing force for pressing the slit band sheet "a" may be varied by the belt pressing part 171. Gas, e.g., air, or liquid, e.g., oil, is used for the fluid.

A plurality of belt guide protrusions 174 are protruded from the outer periphery of the lower pressure applying member 107, while being arranged at fixed intervals in the circumferential direction. Those belt guide protrusions guide those separate endless belts 1 laterally arranged side by side. The belt guide protrusions 174 prevent the endless belts 1 from taking a zig-zag motion and varying in the width direction of the endless belt 1. Specifically, the belt guide protrusions 174 are provided on both the belt reversing parts 173 at proper spatial intervals, and if necessary, may be provided on the belt guide parts 172. Usually, pins are used for the belt guide protrusions 174, and sometimes belt guide plates, for example, are used in addition to the pins. When the belt guide plates are used as shown in FIG. 13, the belt guide plates are arcuately installed on the belt reversing parts 173 in a protruded fashion, respectively. The belt guide protrusions 174 formed with pins are protruded from the belt reversing parts 173, while being located on both sides of the belt guide plate.

A cooling chamber 176 is disposed within the lower pressure applying member 107 in a state that it extends across the array of the endless belts 1. The cooling chamber 176 functions to cool and to prevent the endless belts 1 circulating around the lower pressure applying member 107, from overheating by friction heat. The cooling chamber 176 includes a water cooling chamber and an air cooling chamber. This is just the same as of the embodiment-1. When the passing slit band sheet "a" is thick, and its moving speed is high, friction heat generated is large and it is likely to be overheated. In such a situation, the water cooling chamber is used. The air cooling chamber is used in such a situation that the passing slit band sheet "a" is thin, its moving speed is low, and it is hard to be overheated.

The inner space of the cooling chamber 176 is partitioned, by an inner partitioning plate 107*a,* into three sectional spaces, inner spaces of the belt reversing parts 173 on both sides thereof, and a lower inner part of the recess part 172*a* at the middle part.

Sometimes, the lower inner part of the recess part 172*a* is partitioned into more than three sectional spaces by inner partitioning plates (not shown) or by two or more number of inner partitioning plates. In some cases, some of the inner partitioning plates each of which partitions the lower inner part of the recess part 172*a* into a plurality of sectional inner spaces, are partially bored, and the sectional inner spaces parted by one of such inner partitioning plates communicate with each other. The technical feature that the inner space is further partitioned by the inner partitioning plates (not shown) is just the same as of the embodiment-3.

Those inner partitioning plates 107*a,* which partition the inner space of the lower pressure applying member 107, function to retain the shape of the lower pressure applying member 107 the inside of which is hollowed because of presence of the chamber 176. A compressing force vertically acts on the upper pressure applying member 107, which presses downward the endless belts 1. The inner partitioning plate 107*a* resists the vertical compressing force to prevent the upper pressure applying member 107 from being flexed or bent in its longitudinal direction.

The center parts of both ends of the upper pressure applying member 106 and the lower pressure applying member 107 are fit to a gate-like stand 108 installed on both sides of them. The upper pressure applying member 106 is coupled with the stand 108 while being freely movable up and down. The center parts of both ends of the lower pressure applying member 107 are supported by a support beam 183.

The stand 108, which is installed on both sides of the upper pressure applying member 106 and the lower pressure applying member 107, is shaped like a gate, and is formed with an upper lateral beam 181 and right and left vertically extending beams 182 for supporting the lower parts of both ends of the upper lateral beam 181. The stand 108 supports the upper pressure applying member 106 and the lower pressure applying member 107. The upper pressure applying member 106 is moved up and down inside the stand 108, viz., a space enclosed by the upper lateral beam 181 and the right and left vertical beams 182. The vertical beams 182 are longer in height than the ascending/descending length of the upper pressure applying member 106. The stand 108, which is installed on both sides of the upper pressure applying member 106 and the lower pressure applying member 107, are secured at the lower end to a plate-like base 184.

A hydraulic cylinder 109 is provided on the upper end of the mid-part of the upper lateral beam 181 of the gate-like stand 108. The hydraulic cylinder 109 has at least two functions: to move up and down the upper pressure applying member 106 and to apply to the moving-up/down upper pressure applying member 106 a depressing force to be applied to the endless belt 1. The hydraulic cylinder 109 may be a hydraulic cylinder.

The hydraulic cylinder 109 is suspended at the upper end from the center position of the lower end of the upper lateral beam 181, whereby the hydraulic cylinder is expandable downward. A piston rod 191, which extends downward from the upper end, extends downward through the upper lateral beam 181. The lower end of the piston rod 191 is coupled to the upper end of the mid-position between both the side ends of the upper pressure applying member 106. The hydraulic cylinder 109 presses down both the side ends of the upper pressure applying member 106.

When the piston rod 191 of the hydraulic cylinder 109 extends downward, the upper pressure applying member 106 both sides ends of which are coupled thereto also descends. A depressing force exerts on the endless belts 1, The upper pressure applying member 106 and the lower pressure applying member 107 cooperate to compress the slit band sheet "a" and applies a coiling tension to the slit band sheet "a".

When the piston rod 191 of the hydraulic cylinder 109 retracts, the upper pressure applying member 106 also ascends, the depressing force acting on the endless belts 1 disappears, and the coiling tension of the slit band sheet "a" caused by the endless belts 1 also disappears.

A pressure adjusting device (not shown) is associated with the hydraulic cylinder , and adjusts a hydraulic pressure to the hydraulic cylinder 109 so as to provide a tension as determined in accordance with a thickness and width of the slit band sheet "a".

Operation of the band sheet coiling tension applying apparatus thus constructed will be described. When the piston rod 191 of the hydraulic cylinder 109, which is suspended from the center of the upper end of the upper lateral beams 181 of the stands 108 disposed on both sides of the upper and lower pressure applying members 106 and 107, is retracted, then the upper pressure applying member 106 both side ends of which are coupled to the lower end of the piston rod 191, ascends, and the upper and lower pressure applying members 106 and 107 are vertically moved apart from each other.

Each slit band sheet "a" is passed through between the outer surfaces 1*b* of the endless belts 1 as moved apart from each other. The piston rod 191 of the hydraulic cylinder 109 is extended downward to lower the upper pressure applying member 106. The upper and lower pressure applying members 106 and 107 are made to approach to each other to be in contact with each other and the setting work of the slit band sheet "a" is completed. A fluid is fed into the expandable bag body 171*a* under the belt pressing part 171 of the lower pressure applying member 107 to expand the expandable bag body 171*a*. The fluid is forcibly fed into the expandable bag body 171*a* by means of a pump, not shown.

The expanded expandable bag body 171*a* presses the belt pressing part 171 above the expandable bag body 171*a*. The expandable bag body 171*a* presses, by an equal force, the entire areal range of the belt pressing part 171, which is in contact with the expandable bag body 171*a,* by the utilization of the nature of the fluid that ever point in the fluid is at an equal pressure. Then, the belt pressing part 171 is pressed upward by the upward expansion of the expandable bag body 171*a* as expanded, so that the upper surface thereof is brought into completely close contact with the inner surfaces 1*a* of the under side, endless belts 1. The belt pressing part 171 as pressed upward by the fluid of the expandable bag body 171*a* presses the endless belts 1 upward, and the outer surfaces 1*b* of the endless belts 1 are brought into completely close contact with the reverse side of the slit band sheet "a".

The lower side, endless belts 1, which are in contact with the back surface of the slit band sheet "a", presses upward the inner surfaces 1*a* of the lower side, endless belts 1 by a counter force, or the belt pressing part 161 of the lower pressure applying member 106, whereby the outer surfaces 1*b* of the endless belts 1 are brought into close contact with the back surfaces of the slit band sheets "a". The front and back sides of the slit band sheets "a" are pressed by equal forces by the outer surfaces 1*b* of the endless belts 1 which are vertically and oppositely arranged. At this time, a pressure is uniformly applied to the entire front and back sides of the slit band sheet "a" being in close contact with the outer surfaces 1*b* of the endless belts 1, which are vertically and oppositely arranged, because of the nature of the fluid that ever point in the fluid is at an equal pressure.

When the operation of coiling the slit band sheets "a" starts, the upper and lower side, endless belts 1 circulate around the oval, upper and lower pressure applying members 106 and 107 in an oval shape fashion, by a friction caused by the close contact between the obverse and reverse sides of the moving slit band sheets "a" and the outer surfaces 1*b* of the upper and lower side, endless belts 1. At this time, the upper and lower side, endless belts 1 independently circulate at equal speeds without their slippage on the moving slit band sheets "a".

By a friction force caused by a slip between the surfaces of the belt pressing part 161 of the upper pressure applying member 106 and the belt pressing part 171 of the lower pressure applying member 107, viz., their friction engagement with the moving slit band sheet "a", the belt pressing part 161 and the belt pressing part 171, which press the inner surfaces 1*a* of the endless belts 1 circulating in an oval shape fashion, function like a brake to thereby a necessary coiling tension in the slit band sheet "a" between the slit band sheet coiling apparatus "b" (see FIG. 20) and the band sheet coiling tension applying apparatus. The generated tension may be adjusted as desired by controlling the fluid pressure in the upper pressure applying member 106.

<Embodiment-5>

Figure 21:
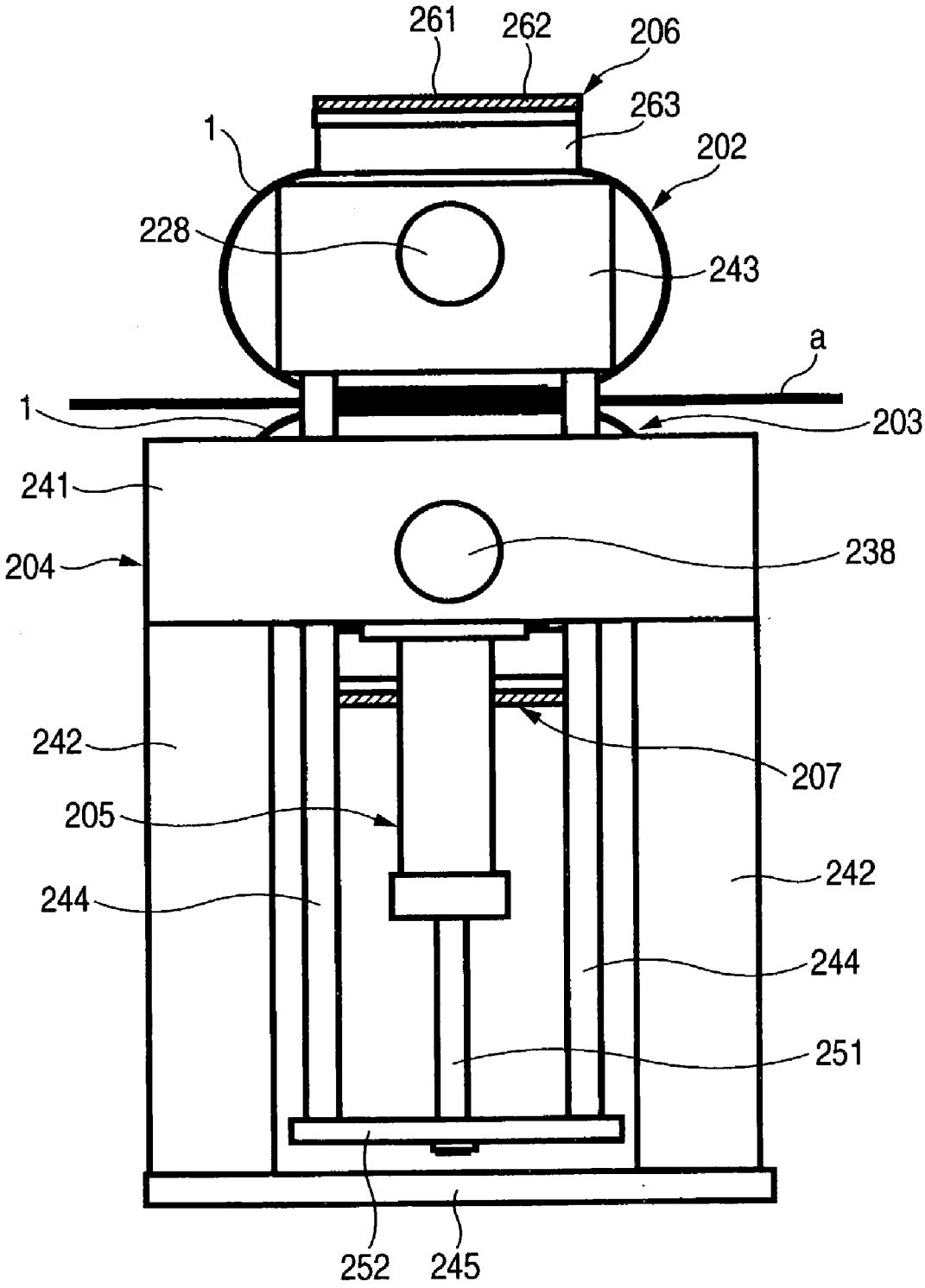
FIG. 21 is a side view showing an overall band sheet coiling tension applying apparatus of an embodiment-5 of the present invention.
Figure 22:
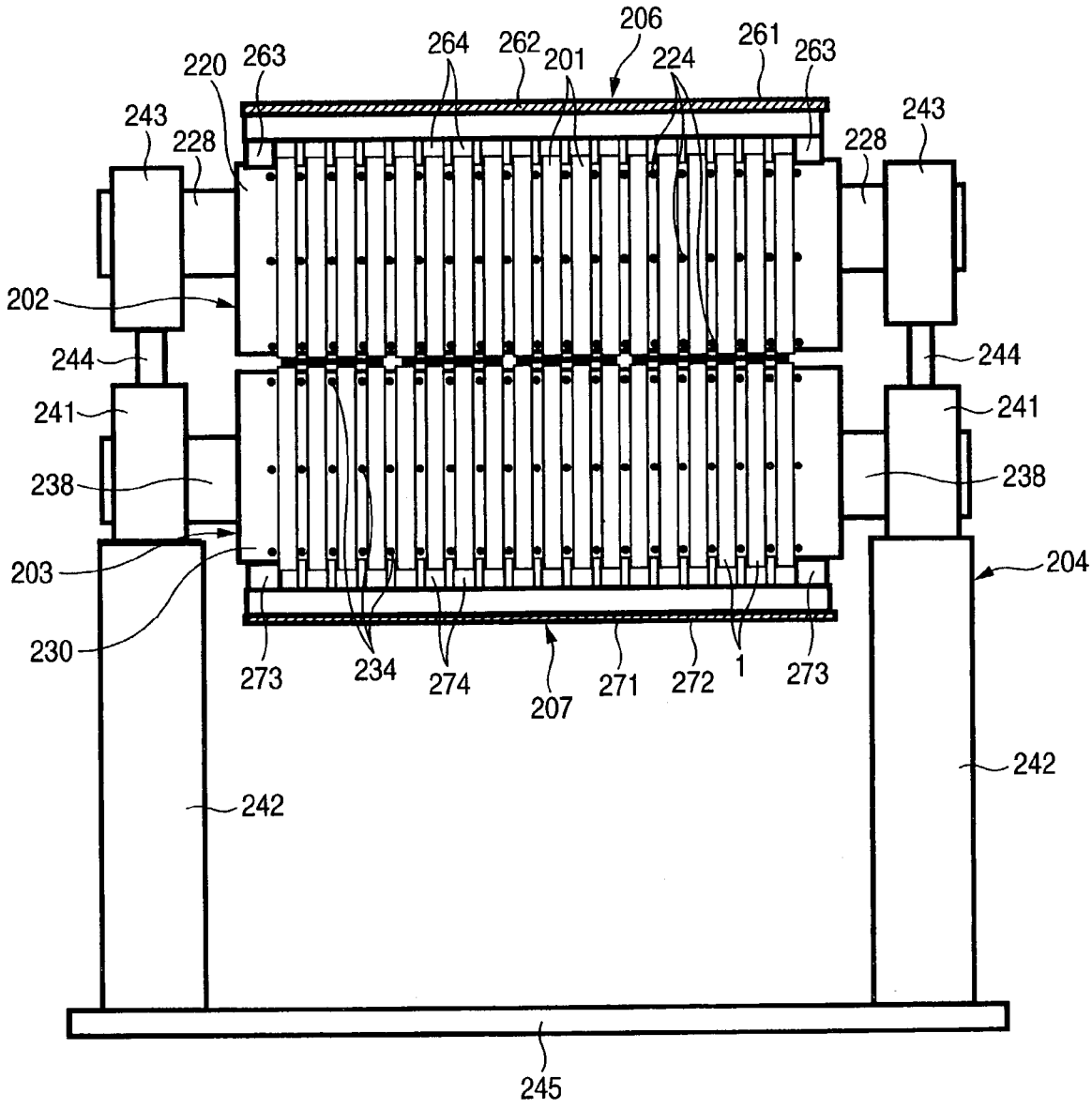
FIG. 22 is a side view showing an overall band sheet coiling tension applying apparatus of the embodiment-5 of the invention.
Figure 23:
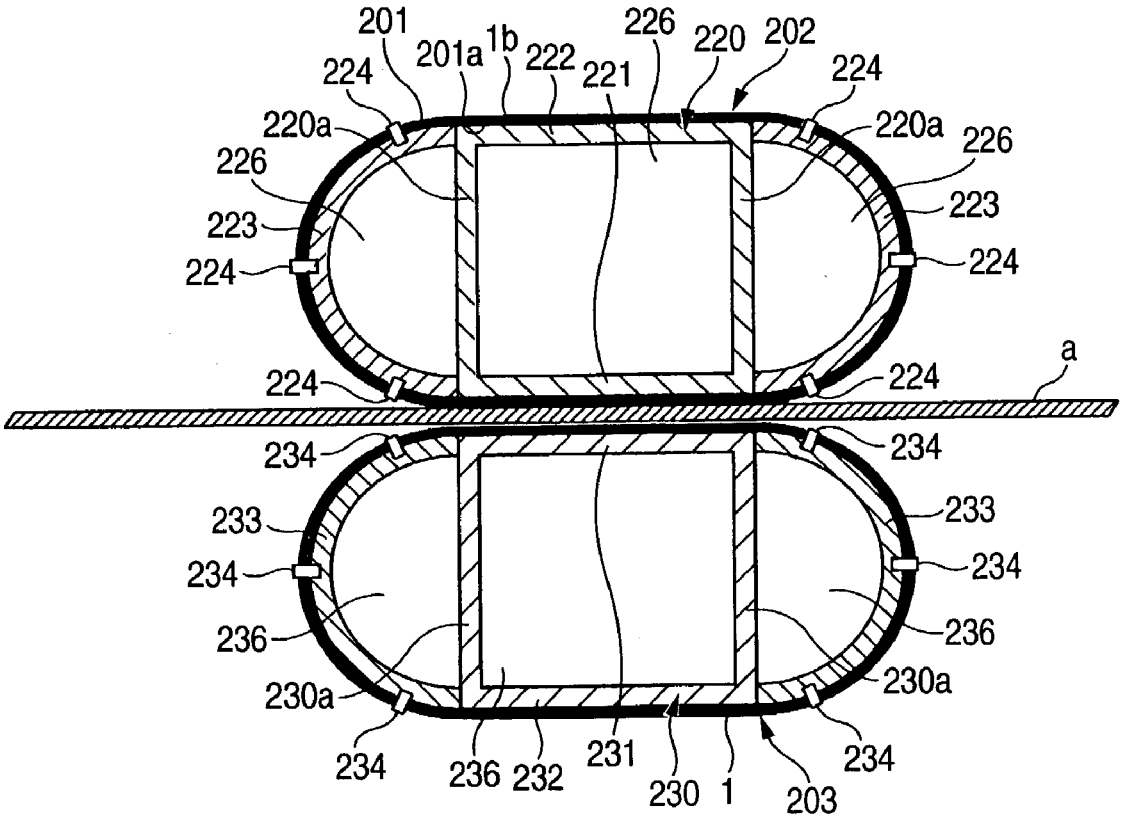
FIG. 23 is a cross sectional view showing a basic construction of sheet-pressing-surface movable type pressure applying members showing an embodiment-5 of the present invention.
Figure 24:
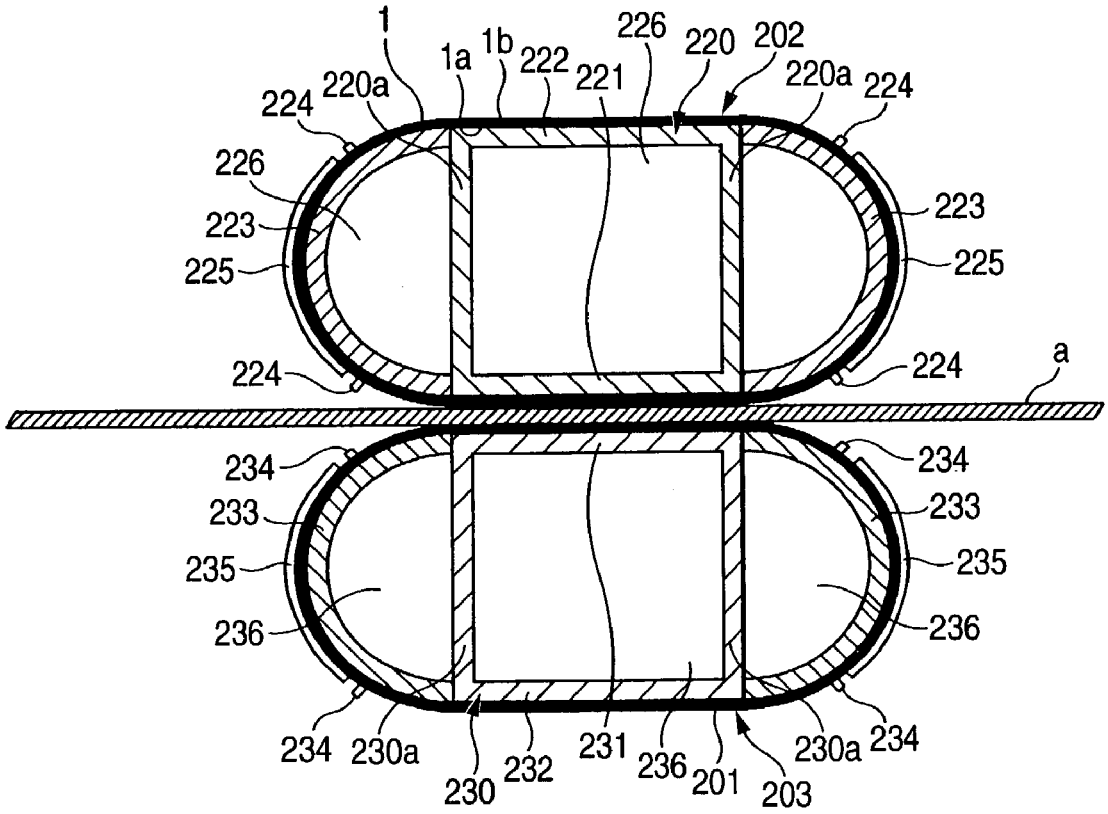
FIG. 24 is a cross sectional view showing an instance where pins and plates are combined for the belt guide protrusions in the embodiment-5.
Figure 25A:
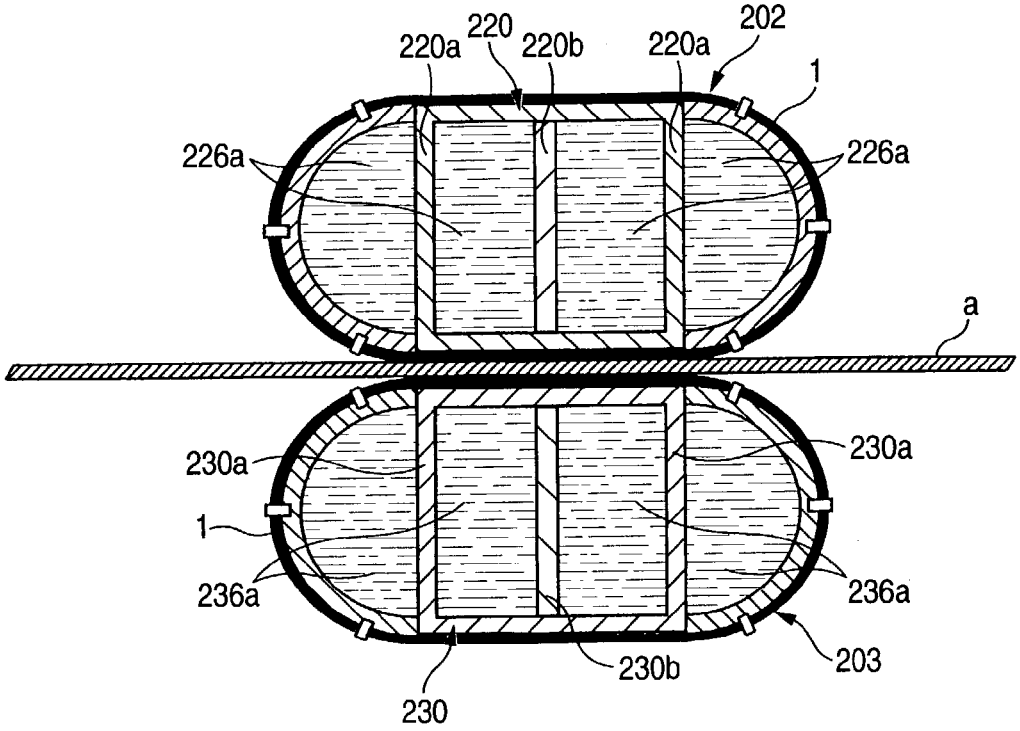
FIG. 25A is a cross sectional view showing the sheet-pressing-surface movable type pressure applying members each equipped with a water cooling chamber in the embodiment-1 and FIG. 25B is a cross sectional view showing the sheet-pressing-surface movable type pressure applying members each equipped with a water cooling chamber and an air cooling chamber in the embodiment-5.
Figure 25B:
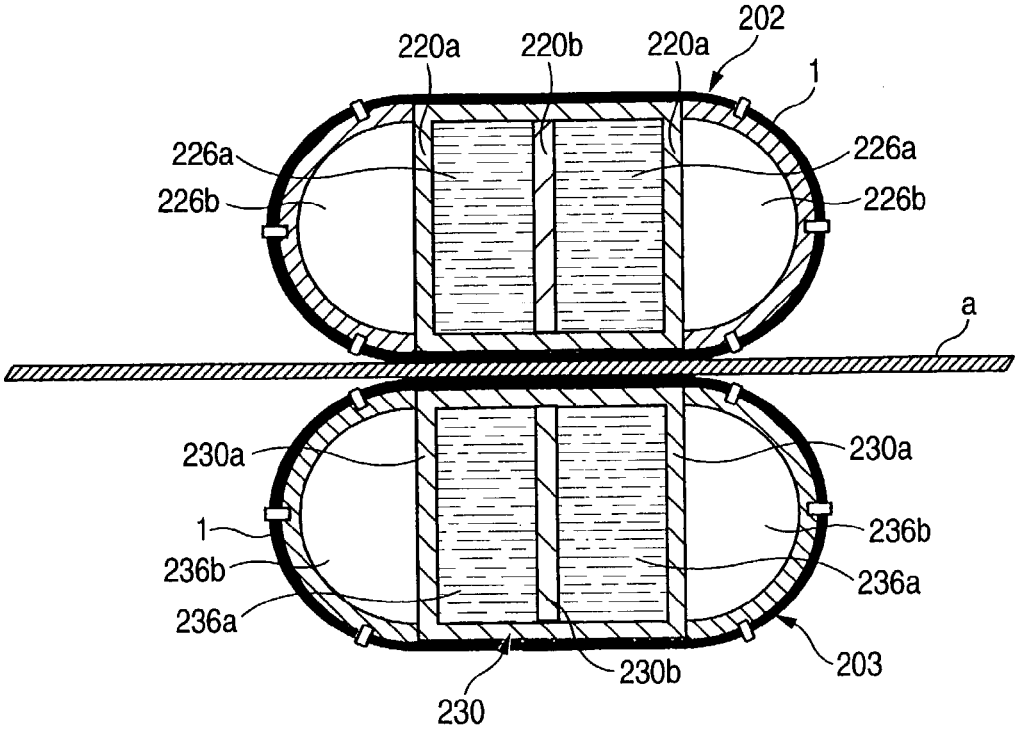

FIG. 21 is a side view showing an overall band sheet coiling tension applying apparatus of an embodiment-5 of the present invention. FIG. 22 is a side view showing the overall band sheet coiling tension applying apparatus. FIG. 23 is a cross sectional view showing a basic construction of sheet-pressing-surface movable type pressure applying members in the embodiment-5. FIG. 24 is a cross sectional view showing an instance where pins and plates are combined for the belt guide protrusions. FIG. 25A is a cross sectional view showing the sheet-pressing-surface movable type pressure applying members each equipped with a water cooling chamber. FIG. 25B is a cross sectional view showing the sheet-pressing-surface movable type pressure applying members each equipped with a water cooling chamber and an air cooling chamber. FIG. 26 is a cross sectional view showing a modification of the sheet-pressing-surface movable type pressure applying members. FIG. 27 is a diagram for explaining how to use the embodiment-5 of the invention. FIG. 28 is a diagram for explaining combinations of the upper and lower sheet-pressing-surface movable type pressure applying members and the upper and lower sheet-pressing-surface non-movable type pressure applying members in the embodiment-5.

The band sheet coiling tension applying apparatus is an apparatus for applying a predetermined coiling tension to slit band sheets "a". The band sheet coiling tension applying apparatus (not shown) is disposed at the middle of a moving path of the slit band sheets "a" in front of a slit band sheet coiling apparatus.

The band sheet coiling tension applying apparatus is composed mainly of endless belts 1, an upper sheet-pressing-surface movable type pressure applying member 202 and a lower sheet-pressing-surface movable type pressure applying member 203, stands 204, a hydraulic cylinder 205, and an upper sheet-pressing-surface non-movable type pressure applying member 206 and a lower sheet-pressing-surface non-movable type pressure applying member 207. The endless belts 1 are held to be freely circularly movable in an elliptic shape fashion, while being vertically and oppositely disposed. The upper sheet-pressing-surface movable type pressure applying member 202 includes an upper pressure applying member 220 which presses the inner surfaces 1*a* of the endless belts 1. The lower sheet-pressing-surface movable type pressure applying member 203 includes a lower pressure applying member 230 which presses the inner surfaces 1*a* of the endless belts 1. The endless belts 1 freely circulate around the upper sheet-pressing-surface movable type pressure applying member in an oval fashion, and also around the lower sheet-pressing-surface movable type pressure applying member in an oval fashion. The gate-like stands 204 support both the pressure applying member 220 and 230. The hydraulic cylinder 5 applies a depressing force to the upper pressure applying member 220. The upper sheet-pressing-surface non-movable type pressure applying member 206 is provided on the upper sheet-pressing-surface movable type pressure applying member 202. The lower sheet-pressing-surface non-movable type pressure applying member 207 is provided on the lower sheet-pressing-surface movable type pressure applying member 203.

The upper sheet-pressing-surface movable type pressure applying member 202 includes the upper pressure applying member 220 and the endless belts 1 which circulate around the outer periphery surface of the upper pressure applying member 220 while being arrayed side by side. The upper pressure applying member 220 presses downward the endless belts 1 located in an upper part, and the lower pressure applying member 230 presses upward the endless belts 1 located in a lower part. The upper and lower pressure applying members 220 and 230 cooperate to compress the slit band sheets "a", which pass through between the upper and lower endless belts 1 vertically and oppositely disposed, indirectly with aid of the endless belts 1, whereby a fixed tension is applied to the slit band sheets.

The endless belt 1 are disposed to freely circulate in the moving directions of the slit band sheets "a". Specifically, a set of the endless belts is arranged in a lateral directional, viz., direction orthogonal to the moving directions of the slit band sheets "a". Those sets of endless belts are arranged vertically or one above the other.

The endless belts 1, which are vertically disposed and arranged laterally and side by side, are each formed with an endless belt. Those endless belts 1 are installed around the outer periphery of the upper pressure applying member 220 which is disposed in an upper part and oval in cross section, and the outer periphery of the lower pressure applying member 230 which is disposed in a lower part and oval in cross section, in a state that those belts are held to be independently and freely circularly movable in an oval shape fashion. Those endless belts 1 are able to independently circulate in the moving direction of the slit band sheet "a".

The upper and lower pressure applying members 220 and 230 on which the endless belts 1 are installed, do not include drive sources for circulating the endless belts 1. The endless belts 1 are circularly moved by a friction engagement between the belts and the moving slit band sheets "a". And those never circulate by their own power. In other words, the endless belts 1 installed respectively on the upper and lower pressure applying members 220 and 230, will circulate until the belts contact with the slit band sheets "a".

An outer surface 1*b* of each endless belt 1 functions to move the slit band sheets "a" in unison with the slit band sheets "a". The inner surfaces 1*a* of the endless belts 1 functions to generate a tension in the slit band sheets "a" by a friction force by a slip between the upper and lower pressure applying members 220 and 230. For this reason, a coefficient of friction of the inner surface 1*a* of the endless belt 1 is smaller than that of the outer surface 1*b,* and the inner surface is easy to slip.

The inner surface 1*a* of the endless belt 1 is formed with a woven fabric made of synthetic fibers so as to allow a lubricant to penetrate into the fibers and sunken parts of the knit meshes of the woven fabric. The outer surface 1*b* of the endless belt 1 is formed with a relatively thin, flexible material which has a low compressive elasticity and such a hardness as to generate little compression strain even under pressure.

Use of the woven fabric for the inner surface 1*a* of the endless belt 1 brings about the following advantages. A friction coefficient of the belt may be set to be small by impregnating the fibers and the sunken parts of the knit meshes of the woven fabric with a lubricant in advance. A rotation resistance of the endless belt installed onto the upper pressure applying member 220 (230) is small since the woven fabric is more flexible than a plate-like member. The woven fabric may be made of synthetic fibers of polyester, vinylon, nylon or the like.

In the case of the endless belts associated with the complete round shaped pressure applying member, a material constituting the belt must have sufficiently large compressive elasticity and recovery property in the thickness direction, and the belt utilizes a compression elastic strain of the belt in its pressed state close to a linear contact of the complete round shaped tension applying member. A pressed area of the endless belts is considerably large in the invention of the present patent application, when comparing with the endless belts just mentioned. Therefore, a low surface pressure suffices to secure a friction resistance (tension) comparable with that in the complete round case. And in the invention, there is no need of a compression strain deformation resistance, which is essential to the case of the complete round shaped pressure applying member. Accordingly, the endless belt exhibits satisfactory functions by using the combined synthetic resin materials which are relatively thin and small in compressive elasticity. Further, the fibers and the sunken parts of the knit meshes of the woven fabric may be impregnated with a lubricant in advance. Therefore, there is no limit of the material of the endless belt to a combination of the material of the inner surface 1*a* and the material of the outer surface 1*b* of the endless belt 1 of which the friction coefficients are different from each other.

The outer surface 1*b* of the endless belt 1 may be made of a material whose friction coefficient is larger than that of the inner surface 1*a*. Specifically, the inner surface 1*a* of the endless belt 1 is made of a material having good abrasion resistance, for example, a soft synthetic resin-based material having a low friction coefficient. The outer surface of the endless belt is made of an elastic material having a high friction coefficient, for example, rubber or synthetic resin. If required, a coefficient of friction of the inner surface 1*a* of the endless belt may be smaller than that of the outer surface 1*b* by coating the inner surfaces 1*a* of the endless belts 1 and the sliding surfaces of the upper and lower pressure applying members 220 and 230, with a lubricant.

The upper pressure applying member 220 is disposed while being passed through the inner pat of a number of endless belts 1 located in the upper part. The upper pressure applying member 220 thus disposed is integrally formed with a belt pressing part 221 which has a linear shaped side surface for directly pressing the inner surfaces 1*a* of the endless belts 1, a belt guide part 222 which has a linear shaped side surface and is disposed parallel to and above the belt pressing part 221 and belt reversing parts 223 which are respectively formed on both sides of the belt guide part 222 and the belt pressing part 221 and are arcuate, e.g., semi-arcuate, in cross section.

The upper pressure applying member 220 is integrally formed with the upper and lower, belt guide part 222 and belt pressing part 221 and the belt reversing parts 223 located on both sides thereof, and is, for example, oval in cross section. Each belt reversing part 223 may take a partially ellipse arc shape or a partially parabolic shape other than the semi-arc shape. In this case, the upper pressure applying member 220 is oval in cross section. The upper pressure applying member 220 is disposed with its longitudinal direction being orthogonal to the moving direction of the slit band sheets "a", and is passed through the inner part of an array of the endless belts 1.

The endless belts 1, laterally arranged side by side, independently circulate around the upper pressure applying member 220 having an oval cross sectional shape. The peripheral surface of the upper pressure applying member 220 has an oval shape so as to allow the endless belts 1 to smoothly circulate around the upper pressure applying member 220 in an oval shape fashion.

The belt pressing part 221 functions such that it presses the slit band sheet "a" by a surface pressure of a surface having a predetermined length in the moving direction of the slit band sheet "a" with the endless belts 1 being interposed therebetween, to thereby applying a coiling tension to the slit band sheet "a". To this end, the belt pressing part 221 is linear in shape while having a predetermined length in the moving direction of the slit band sheet "a", and is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 221 are circulated at a speed equal to that of the moving slit band sheet "a", in unison with the slit band sheet "a" and without their slippage, in a state that the outer surfaces 1*b* of the endless belts 1 are in close contact with the slit band sheet "a". The surface of the belt pressing part 221, which comes in contact with the endless belts 1, is flat, and is finished to have a small friction between it and the inner surfaces 1*a* of the endless belts 1.

A plurality of belt guide protrusions 224 are protruded from the outer periphery of the upper pressure applying member 220, while being circumferentially arranged at fixed intervals in the circumferential direction. Those belt guide protrusions guide those separate endless belts 1 laterally arranged side by side. The belt guide protrusions 224 prevent the endless belts 1 from taking a zig-zag motion or varying in the width direction of the endless belt 1. Specifically, the belt guide protrusions 224 are provided on both the belt reversing parts 223 at proper spatial intervals, and if necessary, may be provided on the belt guide parts 222. Usually, pins are used for the belt guide protrusions 224, and sometimes belt guide plates 225, for example, are used in addition to the pins. Where the belt guide plates 225 are used as shown in FIG. 24, the belt guide plates 225 are arcuately installed on the belt reversing parts 223 in a protruded fashion, respectively. The belt guide protrusions 224 formed with pins are protruded from the belt reversing parts 223, while being located on both sides of the belt guide plate 225.

A cooling chamber 226 is disposed within the upper pressure applying member 220 in a state that it extends across the array of the endless belts 1. The cooling chamber 226 functions to cool and to prevent the endless belts 1 circulating around the upper pressure applying member 220, from overheating by friction heat. The inner space of the cooling chamber 226 is partitioned, by an inner partitioning plate 220*a,* into three sectional spaces, inner spaces of the belt reversing parts 223 on both sides thereof, and an inner space of the belt pressing part 221 at the middle part. Sometimes, if necessary, the inner space of the belt pressing part 221 is partitioned into more than three sectional spaces by the inner partitioning plates 220*b* or by two or more number of inner partitioning plates 220*b.* In some cases, some of the inner partitioning plates 220*b* each of which partitions the inner space of the belt pressing part 221 into a plurality of sectional inner spaces, are partially bored, and the sectional inner spaces parted by one of such inner partitioning plates 220*b* communicate with each other.

Those inner partitioning plates 220*a* and 220*b,* which partition the inner space of the upper pressure applying member 220, function to retain the shape of the upper pressure applying member 220 the inside of which is hollowed because of presence of the chamber 226. A compressing force vertically acts on the upper pressure applying member 220, which presses downward the endless belts 1. The inner partitioning plates 220*a* and 20*b* resist the vertical compressing force to prevent the upper pressure applying member 220 from being flexed or bent in its longitudinal direction.

The cooling chamber 226 includes a water cooling chamber 226*a* and an air cooling chamber 226*b.* The water cooling chamber 226*a* exercises its cooling function by flowing water into the inside thereof, and the air cooling chamber 226*b* exercises its cooling function by flowing air into the inside thereof. When the passing slit band sheet "a" is thick, and its moving speed is high, friction heat generated is large and it is likely to be overheated. In such a situation, the water cooling chamber 226*a* is used. The air cooling chamber 226*b* is used in such a situation that the passing slit band sheet "a" is thin, its moving speed is low, and it is hard to be overheated.

Figure 26A:
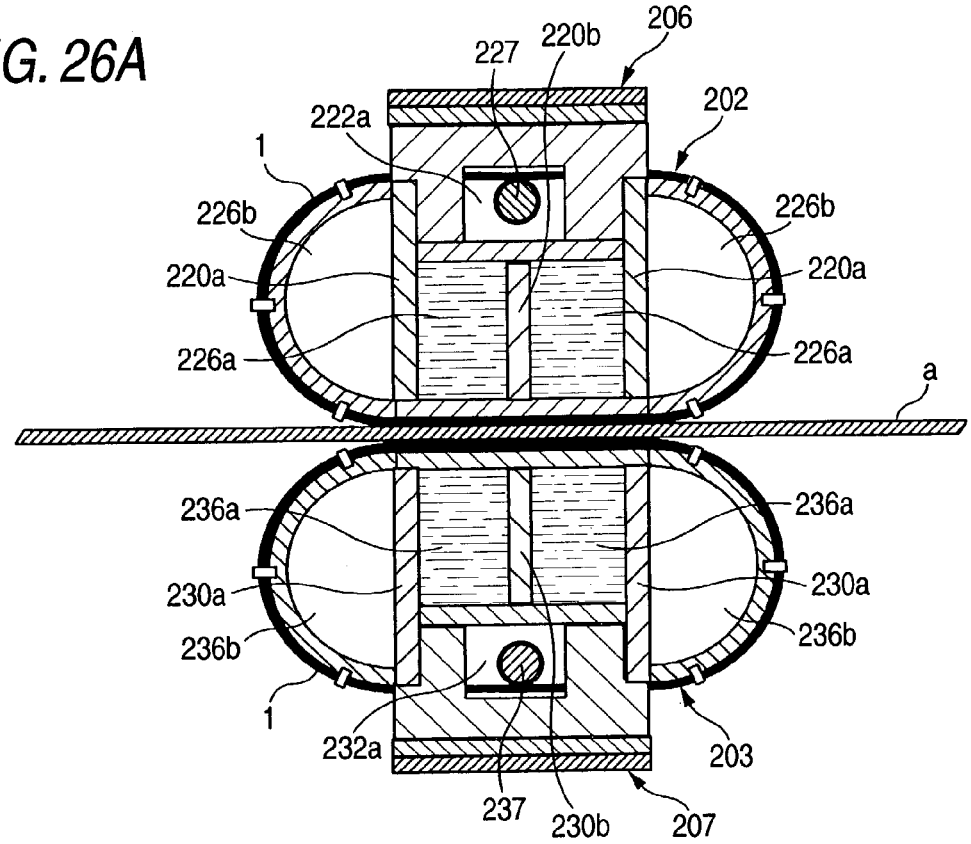
FIGS. 26A and 26B are cross sectional views showing modifications of the sheet-pressing-surface movable type pressure applying members in the embodiment-5 of the invention.

A modification of the upper pressure applying member 220 is shown in FIG. 26. As shown, the belt guide part 222 on the rear side of the belt pressing part 221 is lower in height than the upper ends of the semi-arc, belt reversing parts 223, for example, on both sides thereof. And a recess part 222*a* is formed on the rear side of the belt pressing part 221. The upper pressure applying member of the modification has such a cross section shape that the upper part contains the groove and the remaining part is substantially oval. In this case, a gap is present between the upper side endless belts 1 and the inside of the recess part 222*a.* As shown in FIG. 26A, a belt tensioning roll 227 is disposed in the recess part 222*a.* The roll presses the inner surfaces 1*a* of the endless belts 1 to tighten the endless belts 1.

Figure 26B:
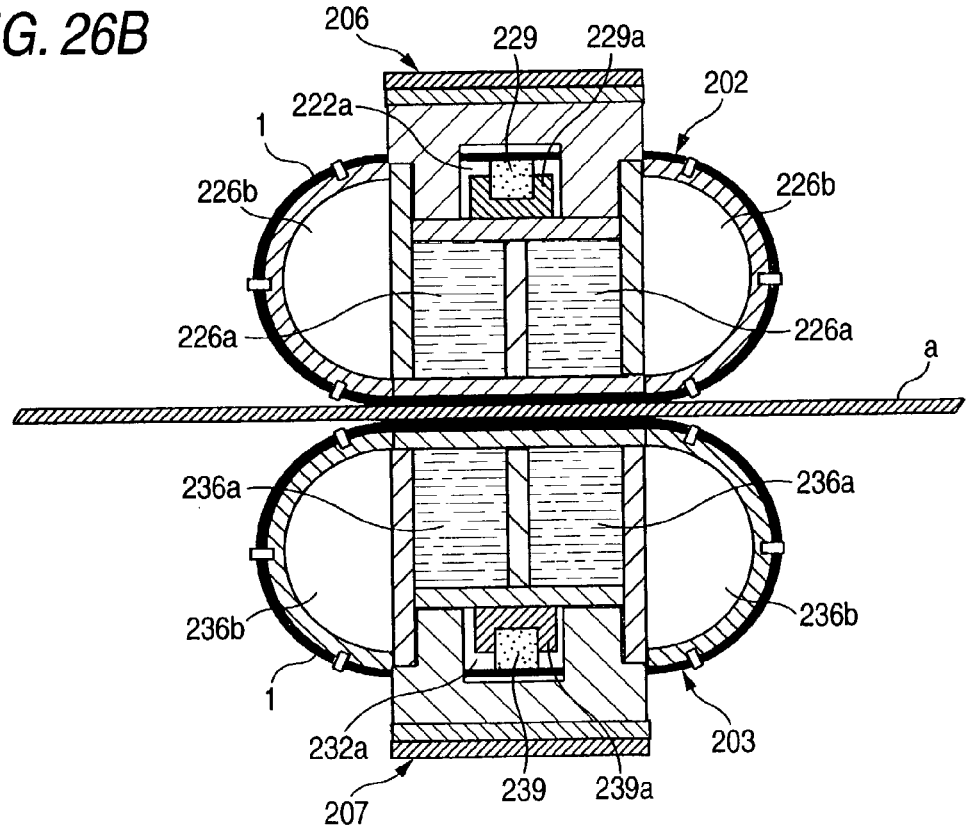
Figure 27A:
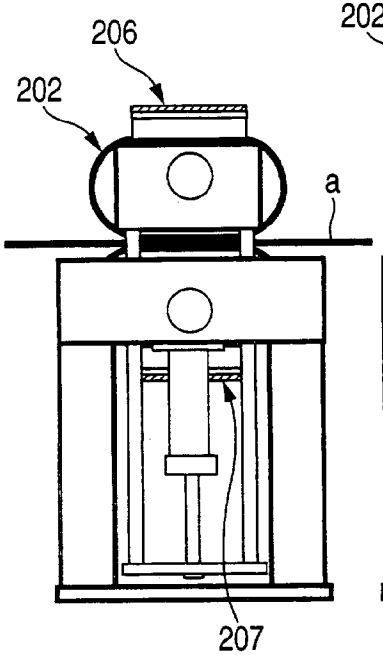
FIGS. 27A and 27B are diagrams for explaining how to use the embodiment-5 of the invention.
Figure 27B:
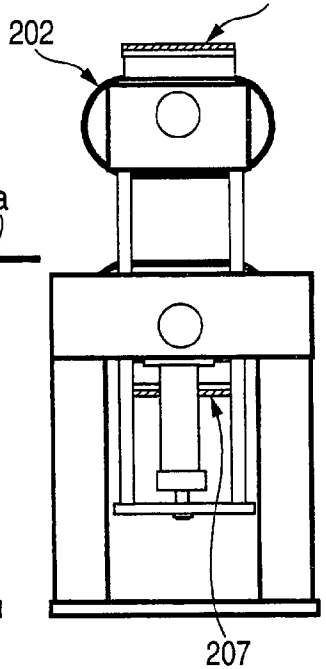
Figure 27C:
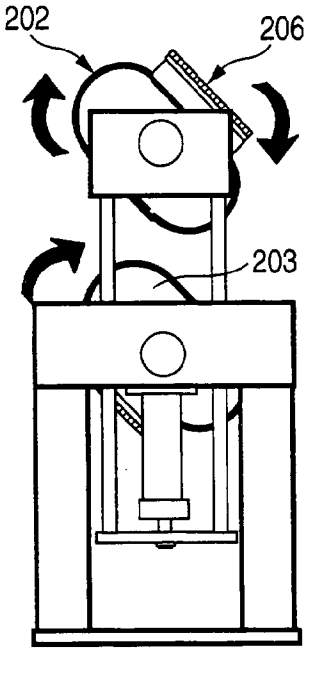
Figure 27D:
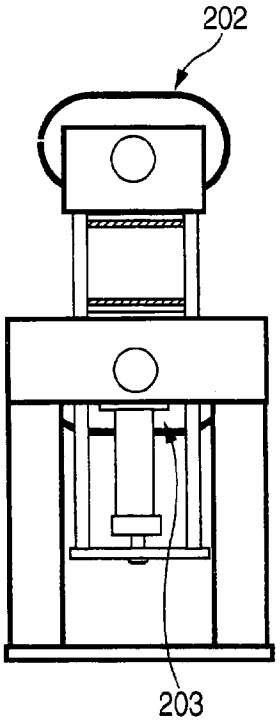
Figure 27E:
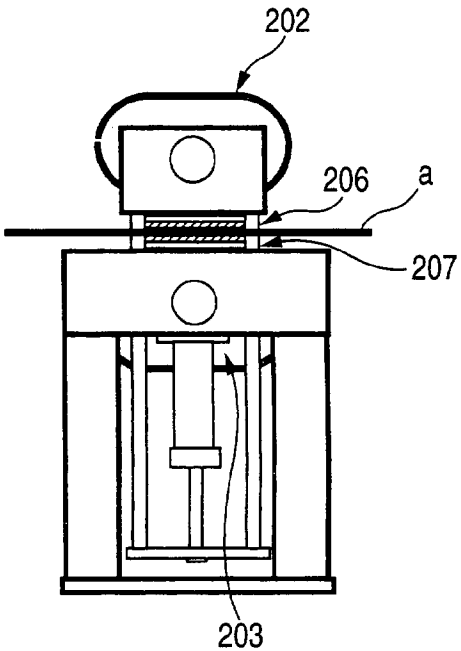

As shown in FIG. 26B, a lubricant 229 is disposed within the recess part 222*a,* in place of the belt tensioning roll 227 or together with the same. The lubricant is for lubricating the inner surfaces 1*a* of the endless belts 1. The lubricant 229 is contained in a recessed, lubricant holder 229*a* located on the bottom of the recess part 222*a.* The lubricant 229 may take the form of a bar-like non-woven fabric or porous foam impregnated with paraffin, which is solid at normal temperature and becomes liquid when it is heated to be high in excess of its melting point. The bar-like lubricant is located in contact with the inner surfaces 1*a* of the endless belts 1. The paraffin flows out of the lubricant by friction heat generated by the rotation of the endless belts 1 and lubricates the inner surfaces 1*a* of the endless belts 1 to reduce the friction coefficient thereof. Since the inner surfaces 1*a* of the endless belts 1 are lubricated by the lubricant 229 during their rotation, there is no necessity of frequently stopping the production line and lubricating the inner surfaces 1*a.* In this respect, the lubricant 229 provided within the recess part 222*a* contributes to improvement of the productivity.

The lower sheet-pressing-surface movable type pressure applying member 203 includes the lower pressure applying member 230 and the endless belts 1 which are circulated around the outer periphery of the lower pressure applying member 230 while being arranged side by side. The lower pressure applying member 230 is disposed while being passed through the inner part of a number of endless belts 1 located in the lower part. The lower pressure applying member 230 thus disposed is integrally formed with a belt pressing part 231 which has a linear shaped side surface for directly pressing the inner surfaces 1*a* of the endless belts 1, a belt guide part 232 which has a linear shaped side surface and is disposed parallel to and under the belt pressing part 231 and belt reversing parts 233 which are respectively provided on both sides of the belt pressing part 231 and the belt guide part 232, and are arcuate, e.g., semi-arcuate, in cross section.

The lower pressure applying member 230, which is integrally formed with upper and lower, belt guide part 232 and belt pressing part 231 and the semi-arc belt reversing parts 233, being located on both sides thereof, is oval in cross section, for example. Each belt reversing part 233 may take a partially elliptical shape or a partially ellipse-arcuately shape other than the arc shape. In this case, the lower pressure applying member 230 is oval in cross section. The lower pressure applying member 230 is disposed such that its longitudinal direction is orthogonal to the moving direction of the slit band sheets "a", and is passed through the inner part of an array of the endless belts 1.

The endless belts 1, laterally arranged side by side, independently circulate around the lower pressure applying member 230 having an oval cross sectional shape. The peripheral surface of the lower pressure applying member 230 is finished to have an oval shape so as to allow the endless belts 1 to smoothly circulate around the lower pressure applying member 230 in an oval shape fashion.

The belt pressing part 231 functions such that it presses the slit band sheets "a" by a surface pressure of a surface having a predetermined length in the moving direction of the slit band sheet "a" in a state that the endless belts 1 are interposed between them, whereby it applies a coiling tension to the slit band sheet "a". To this end, the belt pressing part 231 is linearly shaped to have a predetermined length in the moving direction of the slit band sheet "a" so that it is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 31 are circulated at a speed equal to that of the moving slit band sheets "a", in unison with the slit band sheet "a" and without their slippage, in a state that the outer surfaces 1*b* of the endless belts 1 are in close contact with the slit band sheet "a". The surface of the belt pressing part 231, which comes in contact with the endless belts 1, is flat, and is finished to have a small friction between it and the inner surfaces 1*a* of the endless belts 1.

A plurality of belt guide protrusions 234 are protruded from the outer periphery of the lower pressure applying member 230, while being arranged at fixed intervals in the circumferential direction. Those belt guide protrusions guide those separate endless belts 1 laterally arranged side by side. The belt guide protrusions 234 prevent the endless belts 1 from taking a zig-zag motion and varying in the width direction of the endless belt 1. Specifically, the belt guide protrusions 34 are provided on both the belt reversing parts 233 at proper spatial intervals, and if necessary, may be provided on the belt guide parts 232. Usually, pins are used for the belt guide protrusions 234, and sometimes belt guide plates 235, for example, are used in addition to the pins. When the belt guide plates 235 are used as shown in FIG. 24, the belt guide plates 235 are arcuately installed on the belt reversing parts 233 in a protruded fashion, respectively. The belt guide protrusions 234 formed with pins are protruded from the belt reversing parts 233, while being located on both sides of the belt guide plate 235.

A cooling chamber 236 is disposed within the lower pressure applying member 230 in a state that it extends across the array of the endless belts 1. The cooling chamber 236 functions to cool and to prevent the endless belts 1 circulating around the lower pressure applying member 230, from overheating by friction heat. The inner space of the cooling chamber 236 is partitioned, by an inner partitioning plate 230*a,* into three sectional spaces, inner spaces of the belt reversing parts 233 on both sides thereof, and an inner space of the belt pressing part 231 at the middle part. Sometimes, the inner space of the belt pressing part 231 is partitioned into more than three sectional spaces by the inner partitioning plates 230*b* or by two or more number of inner partitioning plates 230*b*. In some cases, some of the inner partitioning plates 230*b* each of which partitions the inner space of the belt pressing part 231 into a plurality of sectional inner spaces, are partially bored, and the sectional inner spaces parted by one of such inner partitioning plates 230*b* communicate with each other.

Those inner partitioning plates 230*a* an 230*b,* which partition the inner space of the lower pressure applying member 230, function to retain the shape of the lower pressure applying member 230 the inside of which is hollowed because of presence of the chamber 236. A compressing force vertically acts on the lower pressure applying member 230, which presses downward the endless belts 1. The inner partitioning plates 230*a* and 230*b* resist the vertical compressing force to prevent the lower pressure applying member 230 from being flexed or bent in its longitudinal direction.

The cooling chamber 236 includes a water cooling chamber 236*a* and an air cooling chamber 236*b*. The water cooling chamber 236*a* exercises its cooling function by flowing water into the inside thereof, and the air cooling chamber 236*b* exercises its cooling function by flowing air into the inside thereof. When the passing slit band sheet "a" is thick, and its moving speed is high, friction heat generated is large and it is likely to be overheated. In such a situation, the water cooling chamber 236*a* is used. The air cooling chamber 226*b* is used in such a situation that the passing slit band sheet "a" is thin, its moving speed is low, and it is hard to be overheated.

A modification of the lower pressure applying member 230 is shown in FIG. 26. As shown, the belt guide part 232 on the rear side of the belt pressing part 231 is lower in height than the upper ends of the semi-arc, belt reversing parts 233, for example, on both sides thereof. And a recess part 232*a* is formed on the rear side of the belt pressing part 231. The lower pressure applying member of the modification has such a cross section shape that the lower part contains the groove and the remaining part is substantially oval. In this case, a gap is present between the lower side endless belts 1 and the inside of the recess part 232*a*. As shown in FIG. 26A, a belt tensioning roll 237 is disposed in the recess part 232*a*. The roll presses the inner surfaces 1*a* of the endless belts 1 to tighten the endless belts 1.

As shown in FIG. 26B, a lubricant 239 for lubricating the inner surfaces 1*a* of the endless belts 1 is disposed within the recess part 232*a,* in place of the belt tensioning roll 237 or together with the same. The lubricant 239 is contained in a recessed, lubricant holder 239*a* located on the bottom of the recess part 232*a*. The lubricant 239 may take the form of a bar-like non-woven fabric or porous foam impregnated with paraffin, which is solid at normal temperature and becomes liquid when it is heated to be high in excess of its melting point. It is located in contact with the inner surfaces 1*a* of the endless belts 1. The paraffin flows out of the lubricant by friction heat generated by the rotation of the endless belts 1, and lubricates the inner surfaces 1*a* of the endless belts 1 to reduce the friction coefficient thereof. Since the inner surfaces 1*a* of the endless belts 1 are lubricated by the lubricant 239 during their rotation, there is no necessity of frequently stopping the production line and lubricating the inner surfaces 1*a*. In this respect, the lubricant 239 provided within the recess part 232*a* contributes to improvement of the productivity.

Both ends of the lower pressure applying member 230 are rotatably supported by gate-like stands 204 disposed on both sides thereof, with the aid of a shaft 238. The lower pressure applying member 230 is rotatable about the shaft 238. It is readily rotated manually. As shown, the end parts of the shaft 238 are respectively extended out of both ends of the lower pressure applying member 230. The end parts of the shaft 238 are shaft-supported at the center positions of upper lateral beams 241 of the gate-like stands 204.

Each of the gate-like stands 204, which are disposed on both sides of the lower pressure applying member 230, is formed with the upper lateral beam 241 and right and left vertical beams 242, which support the lower sides of both ends of the upper lateral beam 241. The stands 204 support the upper pressure applying member 220 and the lower pressure applying member 230. Upper bearings 243 for supporting both sides of the upper pressure applying member 220 are respectively provided above the upper lateral beams 241 of the gate-like stands in a liftable manner. The lower ends of the stands 204, located on both sides thereof, are secured to a plate-like base 245.

Both ends of the upper pressure applying member 220 are rotatably supported by gate-like stands 204 disposed on both sides thereof, with the aid of a shaft 228. The upper pressure applying member 220 is rotatable about the shaft 228. It is readily rotated manually. As shown, the end parts of the shaft 238 are respectively extended out of both ends of the upper pressure applying member 220. The end parts of the shaft 228 are shaft-supported at the center positions of the upper bearings 243, which are liftably provided above the upper lateral beam 241 of the stands 204.

A hydraulic cylinder 205 is provided in the inner space of the gate-like stands 204, viz., a space defined by the upper lateral beam 241 and the right and left vertical beams 242. The hydraulic cylinder 205 vertically moves or lifts the upper bearings 243, and further applies a depressing force to the upper pressure applying member 220 through the lifting upper bearings 243. A hydraulic cylinder, for example, is used of the hydraulic cylinder 205.

The hydraulic cylinder 205 is suspended at the upper end from the center position of the lower end of the upper lateral beam 241, whereby the hydraulic cylinder is expandable downward. The lower end of the piston rod 251, which is extended downward from the lower end of the hydraulic cylinder 205, is coupled to a center position of a lateral coupling plate 252. The lower ends of lift shafts 244 are coupled to both ends of the lateral coupling plate 252, respectively. The lift shafts support the upper bearings 243 in a liftable manner.

The lift shafts 244, which vertically extend, are movably passed through the upper lateral beam 241, and the upper ends of the lift shafts, located above the upper lateral beam, are coupled to the lower ends of the upper bearings 243. When the lift shafts 244 are vertically moved by the hydraulic cylinder 205, the upper bearings 243, which support the upper pressure applying member 202, also vertically moves together with the lift shafts.

Specifically, when the piston rod 251 of the hydraulic cylinder 205 extends downward, the lift shafts 244 move downward. With the downward movement, the upper bearings 243 and the upper pressure applying member 220 also descend. A depressing force exerts on the endless belts 1. The upper pressure applying member 220 and the lower pressure applying member 230 cooperate to compress the slit band sheet "a" and applies a coiling tension to the slit band sheet "a".

When the piston rod 251 of the hydraulic cylinder 205 retracts, the lift shafts 244 ascend. With the ascending motion, the upper bearings 243 and the upper pressure applying member 220 also ascend. The depressing force acting on the endless belts 1 disappears, and the coiling tension of the slit band sheet "a" caused by the endless belts 1 also disappears.

The upper sheet-pressing-surface non-movable type pressure applying member 206 provided on the upper sheet-pressing-surface movable type pressure applying member 202 is provided longitudinally along and on the outer periphery surface of the upper sheet-pressing-surface movable type pressure applying member 202, while extending across the plurality of endless belts 1, which are arranged side by side on the outer periphery surface of the upper sheet-pressing-surface movable type pressure applying member 202 and may circulate in the moving direction of the slit band sheets "a". The upper sheet-pressing-surface non-movable type pressure applying member 206 is mounted on the belt guide part 222, which is located in opposition to the belt pressing part 221 of the upper pressure applying member 220.

The upper sheet-pressing-surface non-movable type pressure applying member 206 is formed with a pressing plate 262 having a felt 261 mounted on the pressing surface thereof, a support beam 263 for coupling and supporting both ends of the pressing plate 262 on the central parts of both end sides of the belt guide part 222 of the upper pressure applying member 220, and a plurality of separate support pieces 264 supported on the surface of the belt guide part 222 of the upper pressure applying member 220 at parts thereof each between the adjacent endless belts of those endless belts 1 arranged side by side.

In the upper sheet-pressing-surface non-movable type pressure applying member 206, the surface of the felt 261 of the pressing plate 262 presses the surface of the moving slit band sheets "a". At this time, the felt 261 is fixed, and a slip occurs between it and the surface of the moving slit band sheets "a".

The separate support pieces 264 support the part of the pressing plate 262 except both ends thereof, and prevents the pressing plate 262 from being bent when the surface of the slit band sheets "a" are pressed by the pressing plate 262. The separate support pieces 264 are high enough to prevent the surface of the pressing plate 262 opposed to the felt 261 from coming in contact with the endless belts 1.

The lower sheet-pressing-surface non-movable type pressure applying member 207 provided on the lower sheet-pressing-surface movable type pressure applying member 203 is provided longitudinally along and on the outer periphery surface of the lower sheet-pressing-surface movable type pressure applying member 203, while extending across the plurality of endless belts 1, which are arranged side by side on the outer periphery surface of the lower sheet-pressing-surface movable type pressure applying member 203 and may circulate in the moving direction of the slit band sheets "a". The lower sheet-pressing-surface non-movable type pressure applying member 207 is mounted on the belt guide part 232, which is located in opposition to the belt pressing part 231 of the upper pressure applying member 230.

The lower sheet-pressing-surface non-movable type pressure applying member 207 is formed with a pressing plate 272, a support beam 273 for coupling and supporting both ends of the pressing plate 272 on the central parts of both end sides of the belt guide part 232 of the lower pressure applying member 230, and a plurality of separate support pieces 274 supported on the surface of the belt guide part 232 of the lower pressure applying member 230 at parts thereof each between the adjacent endless belts of those endless belts 1 arranged side by side.

In the lower sheet-pressing-surface non-movable type pressure applying member 207, the surface of the felt 271 of the pressing plate 272 presses the surface of the moving slit band sheets "a". At this time, the felt 271 is fixed, and a slip occurs between it and the surface of the moving slit band sheets "a".

The separate support pieces 274 support the part of the pressing plate 272 except both ends thereof, and prevents the pressing plate 272 from being bent when the surface of the slit band sheets "a" are pressed by the pressing plate 272. The separate support pieces 274 are high enough to prevent the surface of the pressing plate 272 opposed to the felt 271 from coming in contact with the endless belts 1.

In the illustration, the hydraulic cylinder 205 is installed downward, viz., it is suspended from the upper lateral beam 241, so that the piston rod 251 directed downward is extendible and retractable. In an alternative, the hydraulic cylinder 205 is installed upward, viz., the lower end of the hydraulic cylinder 205 is placed on the base 245 and the piston rod 251 is directed upward, and the piston rod 251 is extendible and retractable in a state that it is directed upward. A pressure adjusting device (not shown) is associated with the hydraulic cylinder 205, and adjusts a hydraulic pressure to the hydraulic cylinder 205 so as to provide a tension as determined in accordance with a thickness and width of the slit band sheet "a".

Operation of the band sheet coiling tension applying apparatus thus constructed will be described.

To apply a coiling tension to the slit band sheets "a" by nipping the slit band sheets "a" between the upper sheet-pressing-surface non-movable type pressure applying member 206 and the lower sheet-pressing-surface non-movable type pressure applying member 207, the piston rod 251 of the hydraulic cylinder 205, which is suspended within the gate-like stands 204 disposed on both sides of the upper and lower pressure applying members 220 and 230, is retracted, and the upper bearings 243 located above the gate-like stands 204 are lifted. With the lifting of the upper bearings 243, the upper pressure applying member 220 which is supported at both the ends by the upper bearings 243, ascends, and the upper and lower pressure applying members 220 and 230 are vertically moved apart from each other.

The upper pressure applying member 220 is rotated about the shaft 28 by 180°, to turn downward the felt 261 of the pressing plate 262, which has been positioned on the upper side of the upper pressure applying member 220. Similarly, the lower pressure applying member 230 is turned about the shaft 238 by 180°, to turn upward the felt 271 of the pressing plate 272, which has been positioned on the lower side of the lower pressure applying member 230. The rotation of those members may simply be performed manually. A drive force generated by a motor may be used for the rotation, in place of the manual operation.

Each slit band sheet "a" is passed through between the felts 261 and 271 as vertically spaced from each other and oppositely disposed. The piston rod 251 of the hydraulic cylinder 205 is extended downward to lower the upper pressure applying member 220. The upper and lower pressure applying members 220 and 230 are made to approach to each other to be in contact with each other and the setting work of the slit band sheets "a" is completed. The slit band sheets "a" are compressed, by a predetermined pressing force, between the endless belts 1 mounted on the upper and lower pressure applying members 220 and 230.

To apply a coiling tension to the slit band sheets "a" by nipping the slit band sheets "a" between the upper sheet-pressing-surface movable type pressure applying member 202 and the lower sheet-pressing-surface movable type pressure applying member 203, the upper pressure applying member 20 is moved upward and rotated about the shaft 28 by 180°, and to turn upward the pressing plate 262 having been positioned on the lower side of the upper pressure applying member 220. Similarly, the lower pressure applying member 230 is rotated about the shaft 38 by 180° to turn downward the felt 271 of the pressing plate 272 having been positioned on the upper side of the lower pressure applying member 230. The rotation of the member is readily carried out manually.

Slit band sheets "a" are passed through between the outer surfaces 1*b* of the endless belts 1 as moved apart from each other. The piston rod 251 of the hydraulic cylinder 205 is extended downward to lower the upper pressure applying member 220. The upper and lower pressure applying members 220 and 230 are made to approach to each other to be in contact with each other and the setting work of the slit band sheets "a" is completed. The slit band sheets "a" are compressed, by a predetermined pressing force, between the endless belts 1 mounted on the upper and lower pressure applying members 220 and 230.

The belt pressing part 221 of the upper pressure applying member 220 presses downward the inner surfaces 1*a* of the endless belts 1 to be brought into completely close contact with the inner surfaces 1*a*. The outer surfaces 1*b* of the endless belts 1, which is pressed downward by the belt pressing part 221, is brought into completely close contact with the surfaces of the slit band sheets "a". After the outer surfaces 1*b* of the endless belts 1 are in completely close contact with the surface of the slit band sheets "a", it presses the slit band sheets "a" downward.

The lower side, endless belts 1, which are in contact with the back surface of the slit band sheet "a", presses upward the inner surfaces 1*a* of the lower side, endless belts 1 by a counter force, or the belt pressing part 231 of the lower pressure applying member 230, whereby the outer surfaces 1*b* of the endless belts 1 are brought into close contact with the back surfaces of the slit band sheets "a". The front and back sides of the slit band sheets "a" are pressed by equal forces by the outer surfaces 1*b* of the endless belts 1 which are vertically and oppositely arranged. At this time, a pressure is applied uniformly to the entire front and back sides of the slit band sheets "a" being in close contact with the outer surfaces 1*b* of the endless belts 1 vertically and oppositely arranged.

When the operation of coiling the slit band sheets "a" starts, the upper and lower side, endless belts 1 circulate around the oval, upper and lower pressure applying members 220 and 230 in an oval shape fashion, by a friction caused by the close contact between the obverse and reverse sides of the moving slit band sheets "a" and the outer surfaces 1*b* of the upper and lower side, endless belts 1. At this time, the upper and lower side, endless belts 1 independently circulate at equal speeds without their slippage on the moving slit band sheets "a".

By a friction force caused by a slip between the surfaces of the belt pressing part 221 of the upper pressure applying member 220 and the belt pressing part 231 of the lower pressure applying member 230, viz., their friction engagement with the moving slit band sheet "a", the belt pressing part 221 and the belt pressing part 231, which press the inner surfaces 1*a* of the endless belts 1 circulating in an oval shape fashion, function like a brake to thereby a necessary coiling tension in the slit band sheet "a" between the slit band sheet coiling apparatus and the band sheet coiling tension applying apparatus.

Figure 28A:
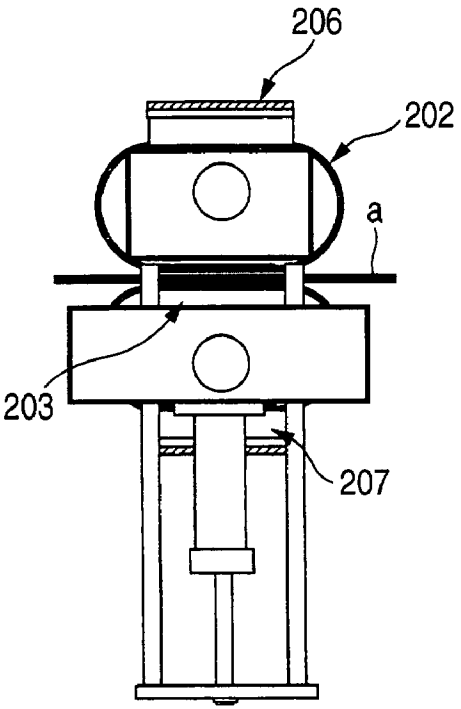
FIGS. 28A and 28B are diagrams for explaining combinations of the upper and lower sheet-pressing-surface movable type pressure applying members and the upper and lower sheet-pressing-surface non-movable type pressure applying members in the embodiment-5.
Figure 28B:
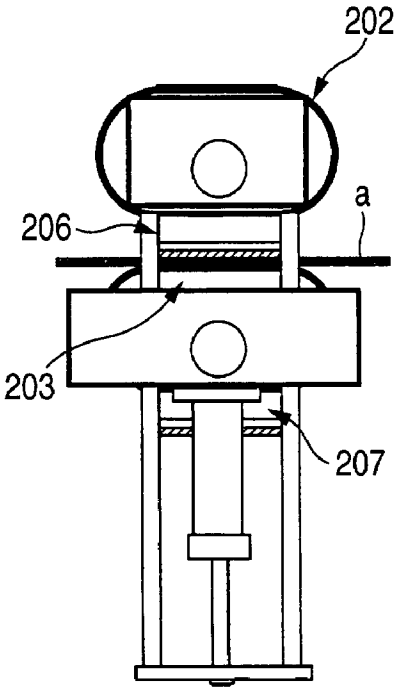
Figure 28C:
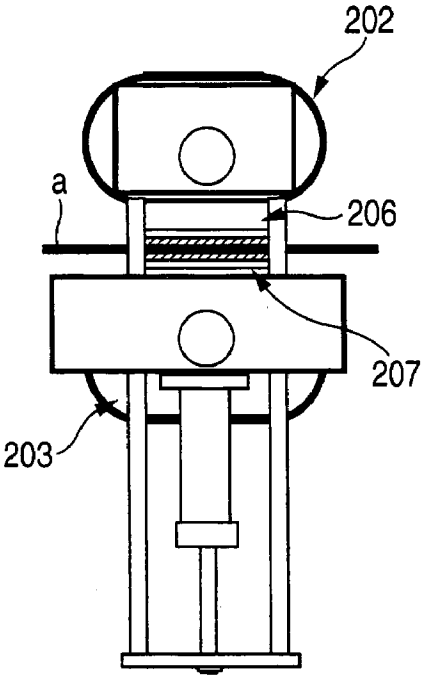
Figure 28D:
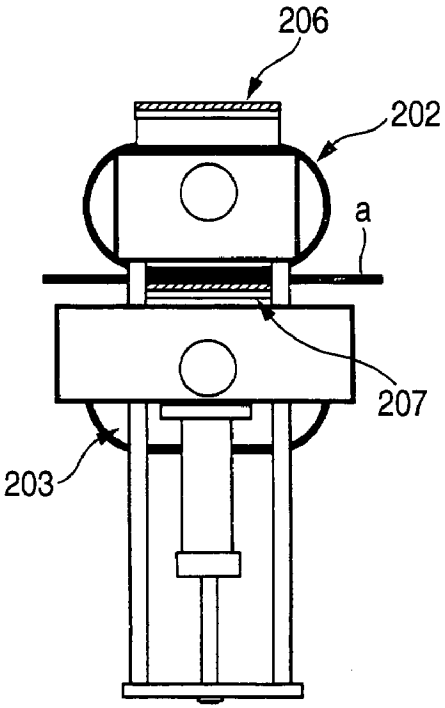

Possible combinations of the upper sheet-pressing-surface movable type pressure applying member 202 (203) and the upper sheet-pressing-surface non-movable type pressure applying member 206 (207) are: a combination of the same types of the pressure applying member s (FIGS. 28A and 28C), a combination of the upper sheet-pressing-surface non-movable type pressure applying member 6 and the lower sheet-pressing-surface movable type pressure applying member 203 (FIG. 28B), and a combination of the upper sheet-pressing-surface movable type pressure applying member 202 and the lower sheet-pressing-surface non-movable type pressure applying member 207 (FIG. 28D).

<Embodiment-6>

Figure 29:
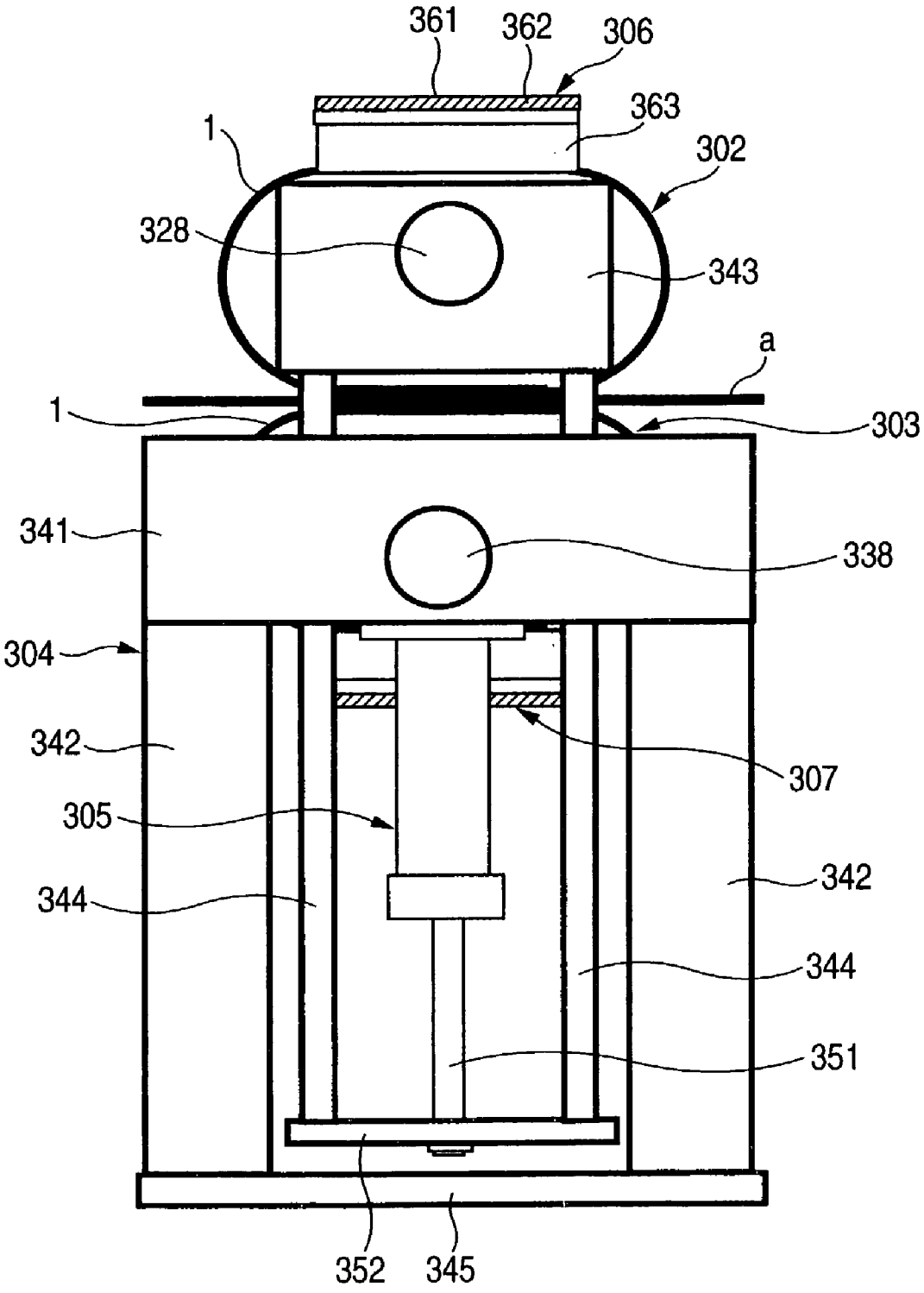
FIG. 29 is a side view showing an overall band sheet coiling tension applying apparatus of an embodiment-6 of the present invention.
Figure 30:
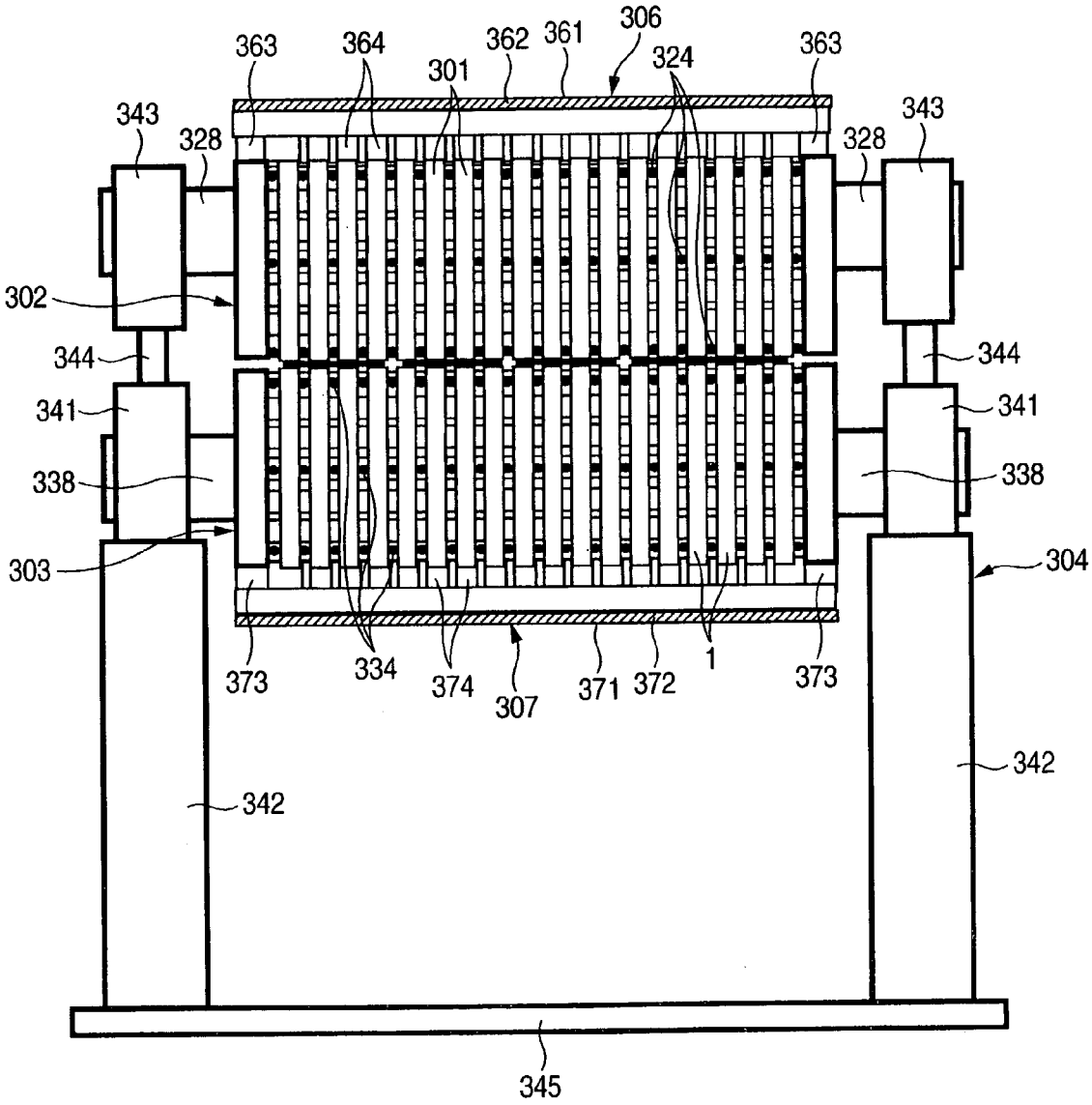
FIG. 30 is a front view showing an overall band sheet coiling tension applying apparatus of the embodiment-6 of the invention.
Figure 31:
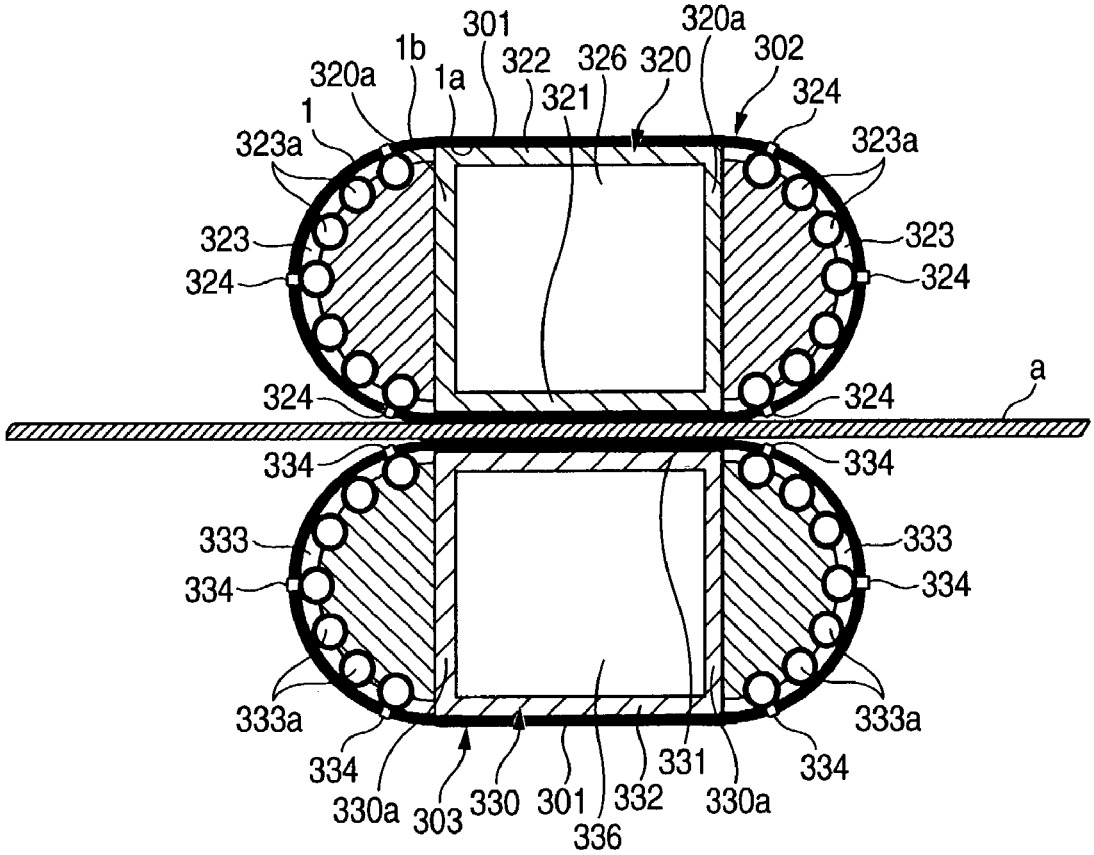
FIG. 31 is a cross sectional view showing a basic construction of sheet-pressing-surface movable type pressure applying members showing an embodiment-6 of the present invention.
Figure 32:
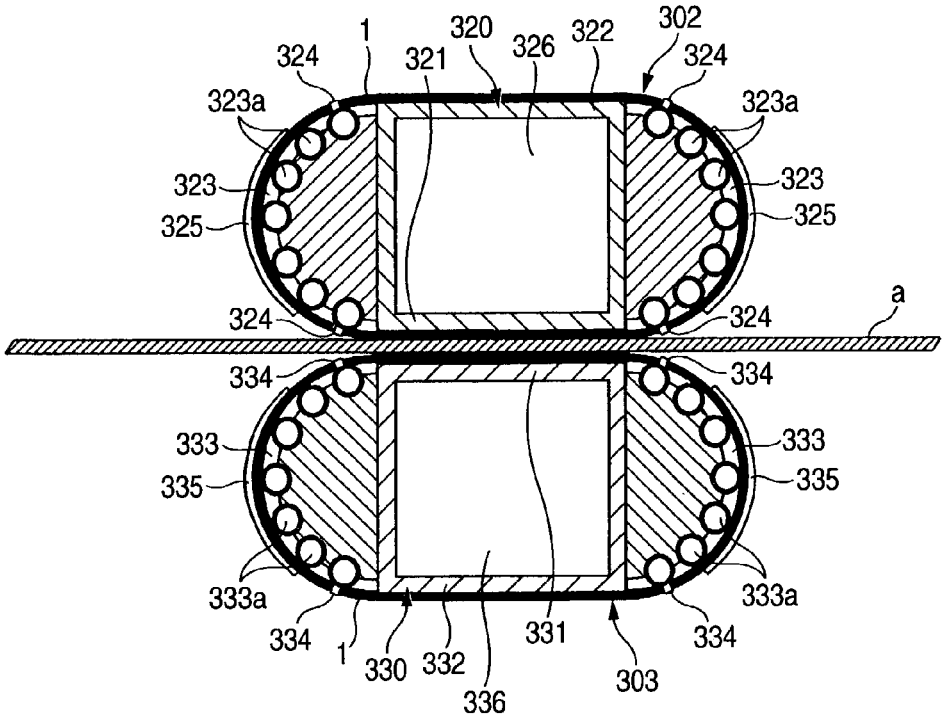
FIG. 32 is a cross sectional view showing an instance where pins and plates are combined for the belt guide protrusions in the embodiment-6.
Figure 33:
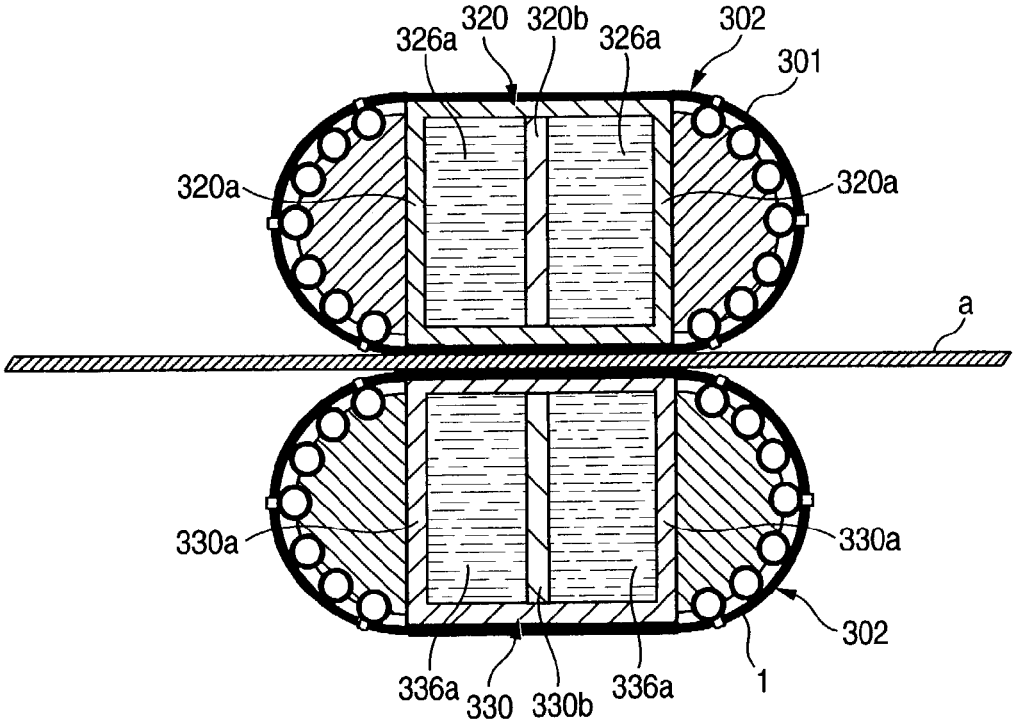
FIG. 33 is a cross sectional view showing the sheet-pressing-surface movable type pressure applying members each equipped with a water cooling chamber in the embodiment-6.

FIG. 29 is a side view showing an overall band sheet coiling tension applying apparatus of an embodiment-6 of the present invention. FIG. 30 is a front view showing the overall band sheet coiling tension applying apparatus. FIG. 31 is a cross sectional view showing a basic construction of sheet-pressing-surface movable type pressure applying members in the embodiment-6. FIG. 32 is a cross sectional view showing an instance where pins and plates are combined for the belt guide protrusions. FIG. 33 is a cross sectional view showing the sheet-pressing-surface movable type pressure applying members each equipped with a water cooling chamber. FIG. 34 is a cross sectional view showing a modification of the sheet-pressing-surface movable type pressure applying members. FIG. 35 is a diagram for explaining how to use the embodiment-6 of the invention. FIG. 36 is a diagram for explaining combinations of the upper and lower sheet-pressing-surface movable type pressure applying members and the upper and lower sheet-pressing-surface non-movable type pressure applying members in the embodiment-6.

The band sheet coiling tension applying apparatus is an apparatus for applying a predetermined coiling tension to slit band sheets "a". The band sheet coiling tension applying apparatus is disposed at the middle of a moving path of the slit band sheets "a" in front of a slit band sheet coiling apparatus.

The band sheet coiling tension applying apparatus is composed mainly of endless belts 1, an upper sheet-pressing-surface movable type pressure applying member 302 and a lower sheet-pressing-surface movable type pressure applying member 303, stands 304, a hydraulic cylinder 305, and an upper sheet-pressing-surface non-movable type pressure applying member 306 and a lower sheet-pressing-surface non-movable type pressure applying member 307. The endless belts 1 are held to be freely circularly movable in an elliptic shape fashion, while being vertically and oppositely disposed. The upper sheet-pressing-surface movable type pressure applying member 302 includes an upper pressure applying member 320 which presses the inner surfaces 1*a* of the endless belts 1. The lower sheet-pressing-surface movable type pressure applying member 303 includes a lower pressure applying member 330 which presses the inner surfaces 1*a* of the endless belts 1. The endless belts 1 freely circulate around the upper sheet-pressing-surface movable type pressure applying member in an oval fashion, and also around the lower sheet-pressing-surface movable type pressure applying member in an oval fashion. The gate-like stands 304 support both the pressure applying member 320 and 330. The hydraulic cylinder 305 applies a depressing force to the upper pressure applying member 320. The upper sheet-pressing-surface non-movable type pressure applying member 306 is provided on the upper sheet-pressing-surface movable type pressure applying member 302. The lower sheet-pressing-surface non-movable type pressure applying member 307 is provided on the lower sheet-pressing-surface non-movable type pressure applying member 303.

The upper sheet-pressing-surface movable type pressure applying member 302 includes the upper pressure applying member 320 and the endless belts 1 which circulate around the outer periphery surface of the upper pressure applying member 320 while being arrayed side by side. The upper pressure applying member 320 presses downward the endless belts 1 located in an upper part, and the lower pressure applying member 330 presses upward the endless belts 1 located in a lower part. The upper and lower pressure applying members 320 and 330 cooperate to compress the slit band sheets "a", which pass through between the upper and lower endless belts 1 vertically and oppositely disposed, indirectly with aid of the endless belts 1, whereby a fixed tension is applied to the slit band sheets.

The endless belt 1 are disposed to freely circulate in the moving directions of the slit band sheets "a". Specifically, a set of the endless belts is arranged in a lateral directional, viz., direction orthogonal to the moving directions of the slit band sheets "a". Those sets of endless belts are arranged vertically or one above the other.

The endless belts 1, which are vertically disposed and arranged laterally and side by side, are each formed with an endless belt. Those endless belts 1 are installed around the outer periphery of the upper pressure applying member 320 which is disposed in an upper part and oval in cross section, and the outer periphery of the lower pressure applying member 330 which is disposed in a lower part and oval in cross section, in a state that hose belts are held to be independently and freely circularly movable in an oval shape fashion. Those endless belts 1 are able to independently circulate in the moving direction of the slit band sheet "a".

The upper and lower pressure applying members 320 and 330 on which the endless belts 1 are installed, do not include drive sources for circulating the endless belts 1. The endless belts 1 are circularly moved by a friction engagement between the belts and the moving slit band sheets "a". And those never circulate by their own power. In other words, the endless belts 1 installed respectively on the upper and lower pressure applying members 320 and 330, will circulate until the belts contact with the slit band sheets "a".

An outer surface 1*b* of each endless belt 1 functions to move the slit band sheets "a" in unison with the slit band sheets "a". The inner surfaces 1*a* of the endless belts 1 functions to generate a tension in the slit band sheets "a" by a friction force by a slip between the upper and lower pressure applying members 320 and 330. For this reason, a coefficient of friction of the inner surface 1*a* of the endless belt 1 is smaller than that of the outer surface 1*b*, and the inner surface is easy to slip.

The inner surface 1*a* of the endless belt 1 is formed with a woven fabric made of synthetic fibers so as to allow a lubricant to penetrate into the fibers and sunken parts of the knit meshes of the woven fabric. The outer surface 1*b* of the endless belt 1 is formed with a relatively thin, flexible material which has a low compressive elasticity and such a hardness as to generate little compression strain even under pressure.

Use of the woven fabric for the inner surface 1*a* of the endless belt 1 brings about the following advantages. A friction coefficient of the belt may be set to be small by impregnating the fibers and the sunken parts of the knit meshes of the woven fabric with a lubricant in advance. A rotation resistance of the endless belt installed onto the upper pressure applying member 320 (330) is small since the woven fabric is more flexible than a plate-like member. The woven fabric may be made of synthetic fibers of polyester, vinylon, nylon or the like.

In the case of the endless belts associated with the complete round shaped pressure applying member, a material constituting the belt must have sufficiently large compressive elasticity and recovery property in the thickness direction, and the belt utilizes a compression elastic strain of the belt in its pressed state close to a linear contact of the complete round shaped tension applying member. A pressed area of the endless belts is considerably large in the invention of the present patent application, when comparing with the endless belts just mentioned. Therefore, a low surface pressure suffices to secure a friction resistance (tension) comparable with that in the complete round case. And in the invention, there is no need of a compression strain deformation resistance, which is essential to the case of the complete round shaped pressure applying member. Accordingly, the endless belt exhibits satisfactory functions by using the combined synthetic resin materials which are relatively thin and small in compressive elasticity. Further, the fibers and the sunken parts of the knit meshes of the woven fabric may be impregnated with a lubricant in advance. Therefore, there is no limit of the material of the endless belt to a combination of the material of the inner surface 1*a* and the material of the outer surface 1*b* of the endless belt 1 of which the friction coefficients are different from each other.

The outer surface 1*b* of the endless belt 1 may be made of a material whose friction coefficient is larger than that of the inner surface 1*a*. Specifically, the inner surface 1*a* of the endless belt 1 is made of a material having good abrasion resistance, for example, a soft synthetic resin-based material having a low friction coefficient. The outer surface of the endless belt is made of an elastic material having a high friction coefficient, for example, rubber or synthetic resin. If required, a coefficient of friction of the inner surface 1*a* of the endless belt may be smaller than that of the outer surface 1*b* by coating the inner surfaces 1*a* of the endless belts 1 and the sliding surfaces of the upper and lower pressure applying members 320 and 330, with a lubricant.

The upper pressure applying member 320 is disposed while being passed through the inner pat of a number of endless belts 1 located in the upper part. The upper pressure applying member 320 thus disposed is integrally formed with a belt pressing part 321 which has a linear shaped side surface for directly pressing the inner surfaces 1*a* of the endless belts 1, a belt guide part 322 which has a linear shaped side surface and is disposed parallel to and above the belt pressing part 321 and belt reversing parts 323 which are respectively formed on both sides of the belt guide part 322 and the belt pressing part 321, and belt reversing parts 323 each having a plurality of belt reversing guide members 323*a* arranged thereon at given intervals. The contact surfaces of the belt reversing guide members 323*a* to be in contact with the endless belts 1 are circular as viewed from side. The belt reversing parts 323 are each disposed such that a contact locus of each belt reversing part with the endless belts 1 is arcuate or semi-arcuate.

The upper pressure applying member 320, which is integrally formed with the upper and lower, belt guide part 322 ad belt pressing part 321, and the belt reversing parts 323 located on both sides thereof each including belt reversing guide members 323*a* semi-arcuately arranged, is, for example, oval in cross section. The plurality of belt reversing guide members 323*a* forming each belt reversing part 323 may be arranged semi-arcuately, partially ellipse-arcuately or partially parabolically. In this case, the upper pressure applying member 320 is oval in cross section. The upper pressure applying member 320 is disposed with its longitudinal direction being orthogonal to the moving direction of the slit band sheets "a", and is passed through the inner part of an array of the endless belts 1.

In the instant embodiment, the belt reversing guide members 323*a* forming each belt reversing part 323 are each a cylindrical member or a bar member circular in cross section of which the contact surface with the inner surfaces 1*a* of the endless belts 1 is circular. Also, in the embodiment, the belt reversing guide members 323*a* are fixedly mounted; however, those may rotatably be mounted sometimes. In the case where the belt reversing guide members 323*a* are used for the belt reversing part 323 air flows into the belt reversing part 323 through gaps between the belt reversing guide members 323*a,* whereby the air permeability is secured. Therefore, the air cooling effect is produced. In the case where the hollowed cylindrical members are used for the belt reversing guide members 323*a,* the cylindrical members are cooled by air passing therethrough, and more effective cooling effect is produced. In a case where cylindrical members, arcuate in cross section, which have grooves partially opened to the inside thereof are used for the belt reversing guide members 323*a,* the cooling effect is enhanced likewise.

The endless belts 1, laterally arranged side by side, independently circulate around the upper pressure applying member 320 having an oval cross sectional shape. The peripheral surface of the upper pressure applying member 320 has an oval shape so as to allow the endless belts 1 to smoothly circulate around the upper pressure applying member 320 in an oval shape fashion.

The belt pressing part 321 functions such that it presses the slit band sheet "a" by a surface pressure of a surface having a predetermined length in the moving direction of the slit band sheet "a" with the endless belts 1 being interposed therebetween, to thereby applying a coiling tension to the slit band sheet "a". To this end, the belt pressing part 321 is linear in shape while having a predetermined length in the moving direction of the slit band sheet "a", and is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 321 are circulated at a speed equal to that of the moving slit band sheet "a", in unison with the slit band sheet "a" and without their slippage, in a state that the outer surfaces 1*b* of the endless belts 1 are in close contact with the slit band sheet "a". The surface of the belt pressing part 321, which comes in contact with the endless belts 1, is flat, and is finished to have a small friction between it and the inner surfaces 1*a* of the endless belts 1.

A plurality of belt guide protrusions 324 are protruded from the outer periphery of the upper pressure applying member 320, while being circumferentially arranged at fixed intervals in the circumferential direction. Those belt guide protrusions guide those separate endless belts 1 laterally arranged side by side. The belt guide protrusions 324 prevent the endless belts 1 from taking a zig-zag motion or varying in the width direction of the endless belt 1. Specifically, the belt guide protrusions 324 are provided on both the belt reversing parts 123 at proper spatial intervals, and if necessary, may be provided on the belt guide parts 322. Usually, pins are used for the belt guide protrusions 324, and sometimes belt guide plates 325, for example, are used in addition to the pins. Where the belt guide plates 325 are used as shown in FIG. 32, the belt guide plates 325 are arcuately installed on the belt reversing parts 323 in a protruded fashion, respectively. The belt guide protrusions 324 formed with pins are protruded from the belt reversing parts 323, while being located on both sides of the belt guide plate 325.

A cooling chamber 326 is disposed within the upper pressure applying member 320 in a state that it extends across the array of the endless belts 1. The cooling chamber 326 functions to cool and to prevent the endless belts 1 circulating around the upper pressure applying member 320, from overheating by friction heat. The inner space of the cooling chamber 326 is partitioned, by an inner partitioning plate 320*a,* into three sectional spaces, inner spaces of the belt reversing parts 323 on both sides thereof, and an inner space of the belt pressing part 321 at the middle part. Sometimes, if necessary, the inner space of the belt pressing part 321 is partitioned into more than three sectional spaces by the inner partitioning plates 320*b* or by two or more number of inner partitioning plates 320*b.* In some cases, some of the inner partitioning plates 320*b* each of which partitions the inner space of the belt pressing part 321 into a plurality of sectional inner spaces, are partially bored, and the sectional inner spaces parted by one of such inner partitioning plates 320*b* communicate with each other.

Those inner partitioning plates 320*a* an 320*b,* which partition the inner space of the upper pressure applying member 320, function to retain the shape of the upper pressure applying member 320 the inside of which is hollowed because of presence of the chamber 326. A compressing force vertically acts on the upper pressure applying member 320, which presses downward the endless belts 1. The inner partitioning plates 320*a* and 320*b* resist the vertical compressing force to prevent the upper pressure applying member 320 from being flexed or bent in its longitudinal direction.

The cooling chamber 326 is used as a water cooling chamber 326*a,* and sometimes it is used as a air cooling chamber. The water cooling chamber 326*a* exercises its cooling function by flowing water into the inside thereof, and the air cooling chamber exercises its cooling function by flowing air into the inside thereof. When the passing slit band sheet "a" is thick, and its moving speed is high, friction heat generated is large and it is likely to be overheated. In such a situation, the water cooling chamber 326*a* is used. The air cooling chamber 326*b* is used in such a situation that the passing slit band sheet "a" is thin, its moving speed is low, and it is hard to be overheated.

Figure 34A:
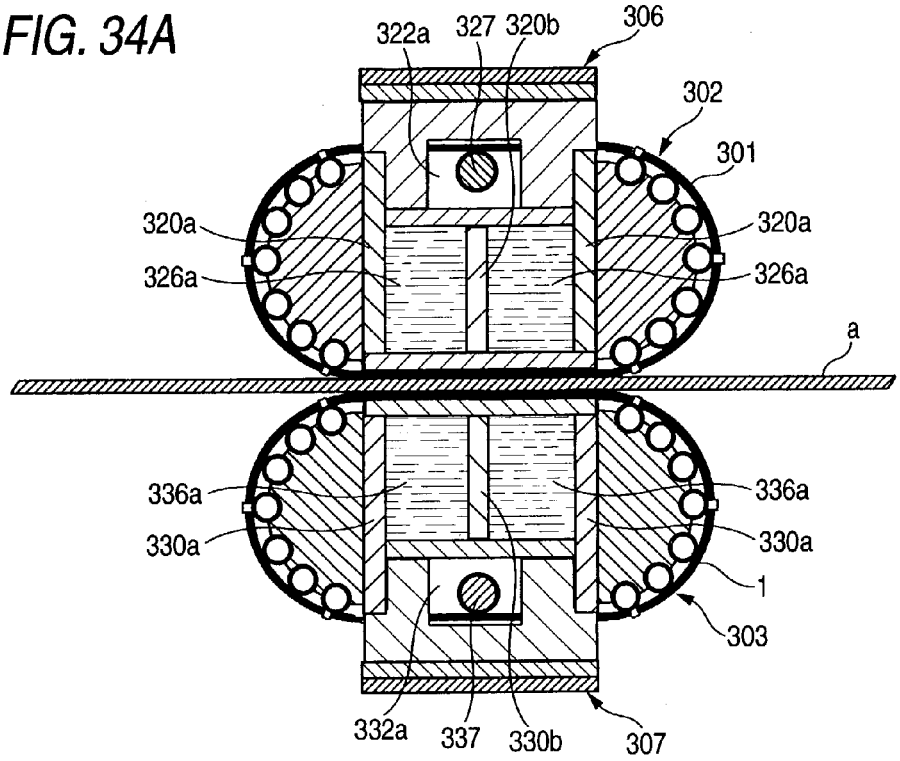
FIGS. 34A and 34B are cross sectional views showing modifications of the combined sheet-pressing-surface movable type pressure applying members in the embodiment-6.

A modification of the upper pressure applying member 320 is shown in FIG. 34. As shown, the belt guide part 322 on the rear side of the belt pressing part 321 is lower in height than the upper ends of the semi-arc, belt reversing parts 323, for example, on both sides thereof. And a recess part 322*a* is formed on the rear side of the belt pressing part 321. The upper pressure applying member of the modification has such a cross section shape that the upper part contains the groove and the remaining part is substantially oval. In this case, a gap is present between the upper side endless belts 1 and the inside of the recess part 322*a*. As shown in FIG. 34A, a belt tensioning roll 327 is disposed in the recess part 322*a*. The roll presses the inner surfaces 1*a* of the endless belts 1 to tighten the endless belts 1.

Figure 34B:
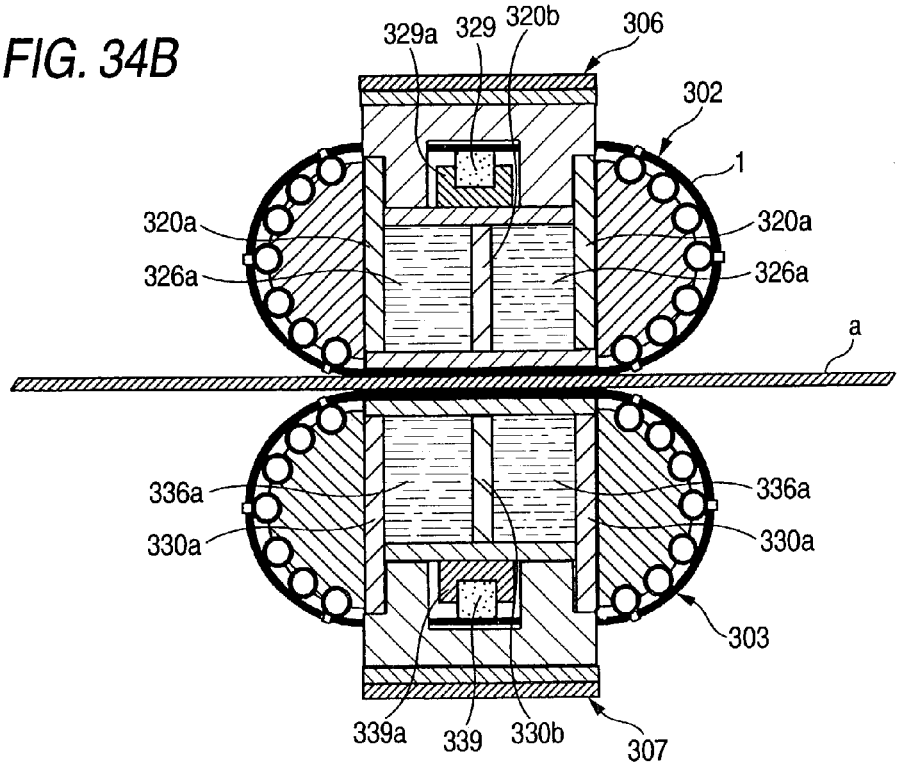
Figure 35A:
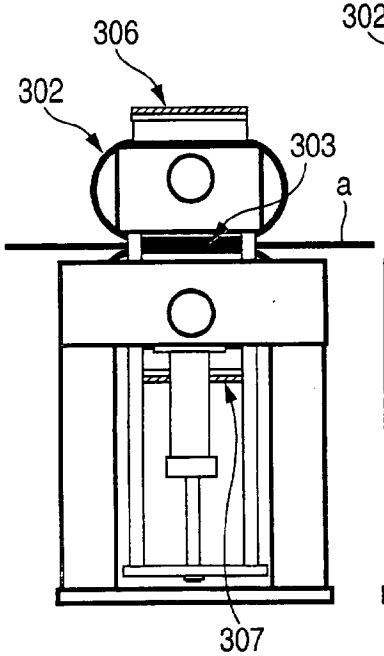
FIGS. 35A and 35B are diagrams for explaining how to use the embodiment-6 of the invention.
Figure 35B:
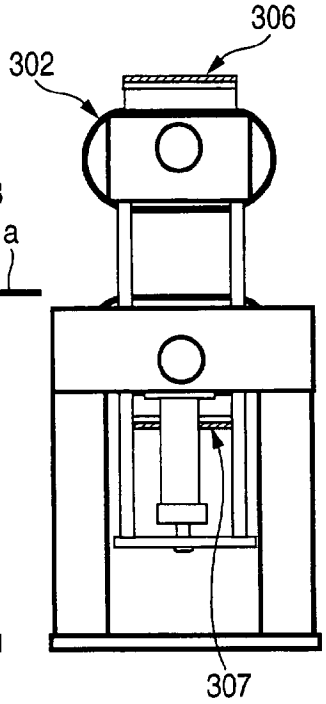
Figure 35C:
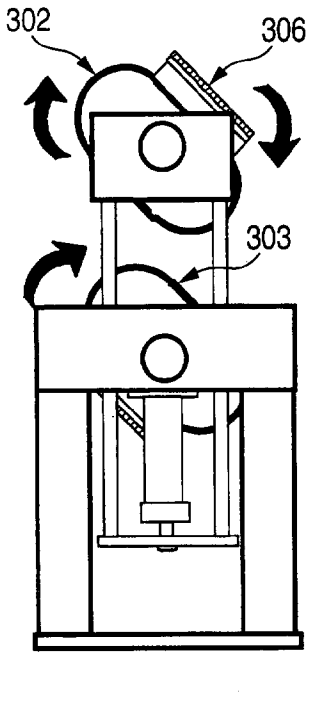
Figure 35D:
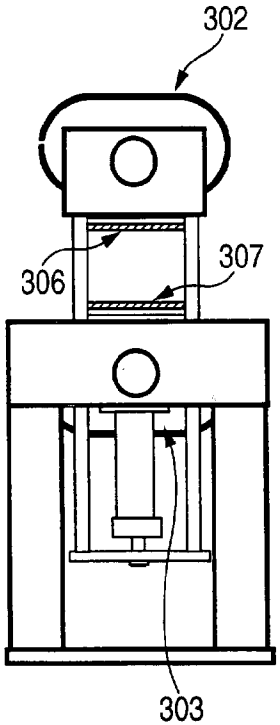
Figure 35E:
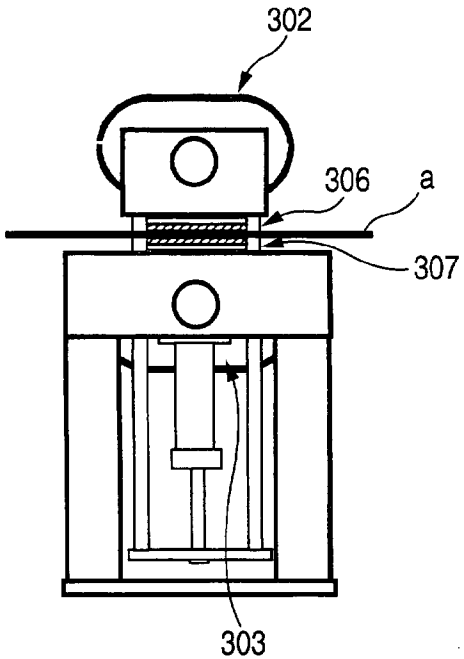

As shown in FIG. 34B, a lubricant 329 is disposed within the recess part 322*a,* in place of the belt tensioning roll 327 or together with the same. The lubricant is for lubricating the inner surfaces 1*a* of the endless belts 1. The lubricant 329 is contained in a recessed, lubricant holder 329*a* located on the bottom of the recess part 322*a*. The lubricant 329 may take the form of a bar-like non-woven fabric or porous foam impregnated with paraffin, which is solid at normal temperature and becomes liquid when it is heated to be high in excess of its melting point. The bar-like lubricant is located in contact with the inner surfaces 1*a* of the endless belts 1. The paraffin flows out of the lubricant by friction heat generated by the rotation of the endless belts 1 and lubricates the inner surfaces 1*a* of the endless belts 1 to reduce the friction coefficient thereof. Since the inner surfaces 1*a* of the endless belts 1 are lubricated by the lubricant 329 during their rotation, there is no necessity of frequently stopping the production line and lubricating the inner surfaces 1*a*. In this respect, the lubricant 329 provided within the recess part 322*a* contributes to improvement of the productivity.

The lower sheet-pressing-surface movable type pressure applying member 303 includes the lower pressure applying member 330 and the endless belts 1 which are circulated around the outer periphery of the lower pressure applying member 330 while being arranged side by side. The lower pressure applying member 330 is disposed while being passed through the inner part of a number of endless belts 1 located in the lower part. The lower pressure applying member 330 thus disposed is integrally formed with a belt pressing part 331 which has a linear shaped side surface for directly pressing the inner surfaces 1*a* of the endless belts 1, a belt guide part 332 which has a linear shaped side surface and is disposed parallel to and under the belt pressing part 331 and belt reversing parts 333 which are respectively provided on both sides of the belt pressing part 331 and the belt guide part 332, and belt reversing parts 333 each having a plurality of belt reversing guide members 333*a* arranged thereon at given intervals. The contact surfaces of the belt reversing guide members 333*a* to be in contact with the endless belts 1 are circular as viewed from side. The belt reversing parts 333 are each disposed such that a contact locus of each belt reversing part with the endless belts 1 is arcuate, e.g., semi-arcuate.

The upper pressure applying member 330 is composed of the upper and lower side, belt guide part 332 and belt pressing part 331, and belt reversing parts 333 which are disposed on both sides thereof, and each have a plurality of belt reversing guide members 333*a* arranged, for example, semi-arcuately. The upper pressure applying member is oval, for example, in cross section as a whole. The belt reversing guide members 333*a* forming each belt reversing part 333 may be arranged in a partially ellipse arc shape or a partially parabolic shape other than the semi-arc shape. In this case, the upper pressure applying member 330 is oval in cross section. The lower pressure applying member 330 is disposed such that its longitudinal direction is orthogonal to the moving direction of the slit band sheets "a", and is passed through the inner part of an array of the endless belts 1.

In the instant embodiment, the belt reversing guide members 323*a* forming each belt reversing part 333 are each a cylindrical member or a bar member circular in cross section of which the contact surface with the inner surfaces 1*a* of the endless belts 1 is circular. Also, in the embodiment, the belt reversing guide members 333*a* are fixedly mounted; however, those may rotatably be mounted sometimes. In the case where the belt reversing guide members 333*a* are used for the belt reversing part 333, air flows into the belt reversing part 333 through gaps between the belt reversing guide members 333*a,* whereby the air permeability is secured. Therefore, the air cooling effect is produced. In the case where the hollowed cylindrical members are used for the belt reversing guide members 333*a,* the cylindrical members are cooled by air passing therethrough, and more effective cooling effect is produced. In a case where cylindrical members, arcuate in cross section, which have grooves partially opened to the inside thereof are used for the belt reversing guide members 333*a,* the cooling effect is enhanced likewise.

The endless belts 1, laterally arranged side by side, independently circulate around the lower pressure applying member 330 having an oval cross sectional shape. The peripheral surface of the lower pressure applying member 330 is finished to have an oval shape so as to allow the endless belts 1 to smoothly circulate around the lower pressure applying member 330 in an oval shape fashion.

The belt pressing part 331 functions such that it presses the slit band sheets "a" by a surface pressure of a surface having a predetermined length in the moving direction of the slit band sheet "a" in a state that the endless belts 1 are interposed between them, whereby it applies a coiling tension to the slit band sheet "a". To this end, the belt pressing part 331 is linearly shaped to have a predetermined length in the moving direction of the slit band sheet "a" so that it is parallel to the passing slit band sheet "a". Further, it is shaped so as to uniformly press the inner surfaces 1*a* of the endless belts 1 laterally arranged side by side.

The endless belts 1, of which the outer surfaces 1*b* are in direct contact with the slit band sheet "a" when the inner surfaces 1*a* thereof are pressed by the belt pressing part 331 are circulated at a speed equal to that of the moving slit band sheets "a", in unison with the slit band sheet "a" and without their slippage, in a state that the outer surfaces 1*b* of the endless belts 1 are in close contact with the slit band sheet "a". The surface of the belt pressing part 331, which comes in contact with the endless belts 1, is flat, and is finished to have a small friction between it and the inner surfaces 1*a* of the endless belts 1.

A plurality of belt guide protrusions 334 are protruded from the outer periphery of the lower pressure applying member 330, while being arranged at fixed intervals in the circumferential direction. Those belt guide protrusions guide those separate endless belts 1 laterally arranged side by side. The belt guide protrusions 334 prevent the endless belts 1 from taking a zig-zag motion and varying in the width direction of the endless belt 1. Specifically, the belt guide protrusions 334 are provided on both the belt reversing parts 333 at proper spatial intervals, and if necessary, may be provided on the belt guide parts 332. Usually, pins are used for the belt guide protrusions 334, and sometimes belt guide plates 335, for example, are used in addition to the pins. When the belt guide plates 335 are used as shown in FIG. 32, the belt guide plates 335 are arcuately installed on the belt reversing parts 333 in a protruded fashion, respectively. The belt guide protrusions 334 formed with pins are protruded from the belt reversing parts 333, while being located on both sides of the belt guide plate 335.

A cooling chamber 336 is disposed within the lower pressure applying member 330 in a state that it extends across the array of the endless belts 1. The cooling chamber 336 functions to cool and to prevent the endless belts 1 circulating around the lower pressure applying member 330, from overheating by friction heat. The inner space of the cooling chamber 336 is partitioned, by an inner partitioning plate 330*a,* into three sectional spaces, inner spaces of the belt reversing parts 333 on both sides thereof, and an inner space of the belt pressing part 331 at the middle part. Sometimes, the inner space of the belt pressing part 331 is partitioned into more than three sectional spaces by the inner partitioning plates 330*b* or by two or more number of inner partitioning plates 330*b*. In some cases, some of the inner partitioning plates 330*b* each of which partitions the inner space of the belt pressing part 331 into a plurality of sectional inner spaces, are partially bored, and the sectional inner spaces parted by one of such inner partitioning plates 330*b* communicate with each other.

Those inner partitioning plates 330*a* an 330*b,* which partition the inner space of the lower pressure applying member 330, function to retain the shape of the lower pressure applying member 330 the inside of which is hollowed because of presence of the chamber 336. A compressing force vertically acts on the lower pressure applying member 330, which presses downward the endless belts 1. The inner partitioning plates 130*a* and 130*b* resist the vertical compressing force to prevent the lower pressure applying member 330 from being flexed or bent in its longitudinal direction.

The cooling chamber 336 is used as a water cooling chamber 136*a,* and sometimes it is used as a air cooling chamber. The water cooling chamber 336*a* exercises its cooling function by flowing water into the inside thereof, and the air cooling chamber exercises its cooling function by flowing air into the inside thereof. When the passing slit band sheet "a" is thick, and its moving speed is high, friction heat generated is large and it is likely to be overheated. In such a situation, the water cooling chamber 336*a* is used. The air cooling chamber is used in such a situation that the passing slit band sheet "a" is thin, its moving speed is low, and it is hard to be overheated.

A modification of the lower pressure applying member 330 is shown in FIG. 34. As shown, the belt guide part 332 on the rear side of the belt pressing part 331 is lower in height than the upper ends of the semi-arc, belt reversing parts 333, for example, on both sides thereof. And a recess part 332*a* is formed on the rear side of the belt pressing part 331. The lower pressure applying member of the modification has such a cross section shape that the lower part contains the groove and the remaining part is substantially oval. In this case, a gap is present between the lower side endless belts 1 and the inside of the recess part 332*a*. As shown in FIG. 34A, a belt tensioning roll 337 is disposed in the recess part 332*a*. The roll presses the inner surfaces 1*a* of the endless belts 1 to tighten the endless belts 1.

As shown in FIG. 34B, a lubricant 339 for lubricating the inner surfaces 1*a* of the endless belts 1 is disposed within the recess part 332*a,* in place of the belt tensioning roll 337 or together with the same. The lubricant 339 is contained in a recessed, lubricant holder 339*a* located on the bottom of the recess part 332*a*. The lubricant 339 may take the form of a bar-like non-woven fabric or porous foam impregnated with paraffin, which is solid at normal temperature and becomes liquid when it is heated to be high in excess of its melting point. It is located in contact with the inner surfaces 1*a* of the endless belts 1. The paraffin flows out of the lubricant by friction heat generated by the rotation of the endless belts 1, and lubricates the inner surfaces 1*a* of the endless belts 1 to reduce the friction coefficient thereof. Since the inner surfaces 1*a* of the endless belts 1 are lubricated by the lubricant 339 during their rotation, there is no necessity of frequently stopping the production line and lubricating the inner surfaces 1*a*. In this respect, the lubricant 339 provided within the recess part 332*a* contributes to improvement of the productivity.

Both ends of the lower pressure applying member 330 are rotatably supported by gate-like stands 304 disposed on both sides thereof, with the aid of a shaft 338. The lower pressure applying member 330 is rotatable about the shaft 338. It is readily rotated manually. As shown, the end parts of the shaft 338 are respectively extended out of both ends of the lower pressure applying member 330. The end parts of the shaft 338 are shaft-supported at the center positions of upper lateral beams 341 of the gate-like stands 304.

Each of the gate-like stands 304, which are disposed on both sides of the lower pressure applying member 330, is formed with the upper lateral beam 341 and right and left vertical beams 342, which support the lower sides of both ends of the upper lateral beam 341. The stands 304 support the upper pressure applying member 320 and the lower pressure applying member 330. Upper bearings 343 for supporting both sides of the upper pressure applying member 320 are respectively provided above the upper lateral beams 341 of the gate-like stands in a liftable manner. The lower ends of the stands 304, located on both sides thereof, are secured to a plate-like base 345.

Both ends of the upper pressure applying member 320 are rotatably supported by gate-like stands 304 disposed on both sides thereof, with the aid of a shaft 328. The upper pressure applying member 320 is rotatable about the shaft 328. It is readily rotated manually. As shown, the end parts of the shaft 328 are respectively extended out of both ends of the upper pressure applying member 320. The end parts of the shaft 328 are shaft-supported at the center positions of the upper bearings 343, which are liftably provided above the upper lateral beam 341 of the stands 304.

A hydraulic cylinder 305 is provided in the inner space of the gate-like stands 304, viz., a space defined by the upper lateral beam 341 and the right and left vertical beams 342. The hydraulic cylinder 305 vertically moves or lifts the upper bearings 343, and further applies a depressing force to the upper pressure applying member 320 through the lifting upper bearings 343. A hydraulic cylinder, for example, is used of the hydraulic cylinder 305.

The hydraulic cylinder 305 is suspended at the upper end from the center position of the lower end of the upper lateral beam 341, whereby the hydraulic cylinder is expandable downward. The lower end of the piston rod 351, which is extended downward from the lower end of the hydraulic cylinder 305, is coupled to a center position of a lateral coupling plate 352. The lower ends of lift shafts 344 are coupled to both ends of the lateral coupling plate 352, respectively. The lift shafts support the upper bearings 343 in a liftable manner.

The lift shafts 344, which vertically extend, are movably passed through the upper lateral beam 341, and the upper ends of the lift shafts, located above the upper lateral beam, are coupled to the lower ends of the upper bearings 343. When the lift shafts 344 are vertically moved by the hydraulic cylinder 305, the upper bearings 343, which support the upper pressure applying member 320, also vertically moves together with the lift shafts.

Specifically, when the piston rod 351 of the hydraulic cylinder 305 extends downward, the lift shafts 344 move downward. With the downward movement, the upper bearings 343 and the upper pressure applying member 320 also descend. A depressing force exerts on the endless belts 1. The upper pressure applying member 320 and the lower pressure applying member 330 cooperate to compress the slit band sheet "a" and applies a coiling tension to the slit band sheet "a".

When the piston rod 351 of the hydraulic cylinder 305 retracts, the lift shafts 344 ascend. With the ascending motion, the upper bearings 343 and the upper pressure applying member 320 also ascend. The depressing force acting on the endless belts 1 disappears, and the coiling tension of the slit band sheet "a" caused by the endless belts 1 also disappears.

The upper sheet-pressing-surface non-movable type pressure applying member 306 provided on the upper sheet-pressing-surface movable type pressure applying member 302 is provided longitudinally along and on the outer periphery surface of the upper sheet-pressing-surface movable type pressure applying member 302, while extending across the plurality of endless belts 1, which are arranged side by side on the outer periphery surface of the upper sheet-pressing-surface movable type pressure applying member 302 and may circulate in the moving direction of the slit band sheets "a". The upper sheet-pressing-surface non-movable type pressure applying member 306 is mounted on the belt guide part 322, which is located in opposition to the belt pressing part 321 of the upper pressure applying member 320.

The upper sheet-pressing-surface non-movable type pressure applying member 306 is formed with a pressing plate 362 having a felt 361 mounted on the pressing surface thereof, a support beam 363 for coupling and supporting both ends of the pressing plate 362 on the central parts of both end sides of the belt guide part 322 of the upper pressure applying member 320, and a plurality of separate support pieces 164 supported on the surface of the belt guide part 322 of the upper pressure applying member 320 at parts thereof each between the adjacent endless belts of those endless belts 1 arranged side by side.

In the upper sheet-pressing-surface non-movable type pressure applying member 306, the surface of the felt 361 of the pressing plate 362 presses the surface of the moving slit band sheets "a". At this time, the felt 361 is fixed, and a slip occurs between it and the surface of the moving slit band sheets "a".

The separate support pieces 364 support the part of the pressing plate 362 except both ends thereof, and prevents the pressing plate 362 from being bent when the surface of the slit band sheets "a" are pressed by the pressing plate 362. The separate support pieces 364 are high enough to prevent the surface of the pressing plate 362 opposed to the felt 361 from coming in contact with the endless belts 1.

The lower sheet-pressing-surface non-movable type pressure applying member 307 provided on the lower sheet-pressing-surface movable type pressure applying member 303 is provided longitudinally along and on the outer periphery surface of the lower sheet-pressing-surface movable type pressure applying member 303, while extending across the plurality of endless belts 1, which are arranged side by side on the outer periphery surface of the lower sheet-pressing-surface movable type pressure applying member 303 and may circulate in the moving direction of the slit band sheets "a". The lower sheet-pressing-surface non-movable type pressure applying member 307 is mounted on the belt guide part 332, which is located in opposition to the belt pressing part 331 of the upper pressure applying member 330.

The lower sheet-pressing-surface non-movable type pressure applying member 307 is formed with a pressing plate 372, a support beam 373 for coupling and supporting both ends of the pressing plate 372 on the central parts of both end sides of the belt guide part 332 of the lower pressure applying member 330, and a plurality of separate support pieces 374 supported on the surface of the belt guide part 332 of the lower pressure applying member 330 at parts thereof each between the adjacent endless belts of those endless belts 1 arranged side by side.

In the lower sheet-pressing-surface non-movable type pressure applying member 307, the surface of the felt 371 of the pressing plate 372 presses the surface of the moving slit band sheets "a". At this time, the felt 371 is fixed, and a slip occurs between it and the surface of the moving slit band sheets "a".

The separate support pieces 374 support the part of the pressing plate 372 except both ends thereof, and prevents the pressing plate 372 from being bent when the surface of the slit band sheets "a" are pressed by the pressing plate 372. The separate support pieces 374 are high enough to prevent the surface of the pressing plate 372 opposed to the felt 371 from coming in contact with the endless belts 1.

In the illustration, the hydraulic cylinder 305 is installed downward, viz., it is suspended from the upper lateral beam 341, so that the piston rod 351 directed downward is extendible and retractable. In an alternative, the hydraulic cylinder 305 is installed upward, viz., the lower end of the hydraulic cylinder 305 is placed on the base 345 and the piston rod 351 is directed upward, and the piston rod 351 is extendible and retractable in a state that it is directed upward. A pressure adjusting device (not shown) is associated with the hydraulic cylinder 305, and adjusts a hydraulic pressure to the hydraulic cylinder 305 so as to provide a tension as determined in accordance with a thickness and width of the slit band sheet "a".

Operation of the band sheet coiling tension applying apparatus thus constructed will be described.

To apply a coiling tension to the slit band sheets "a" by nipping the slit band sheets "a" between the upper sheet-pressing-surface non-movable type pressure applying member 306 and the lower sheet-pressing-surface non-movable type pressure applying member 307, the piston rod 351 of the hydraulic cylinder 305, which is suspended within the gate-like stands 304 disposed on both sides of the upper and lower pressure applying members 320 and 330, is retracted, and the upper bearings 343 located above the gate-like stands 304 are lifted. With the lifting of the upper bearings 343, the upper pressure applying member 320 which is supported at both the ends by the upper bearings 343, ascends, and the upper and lower pressure applying members 320 and 330 are vertically moved apart from each other.

The upper pressure applying member 320 is rotated about the shaft 328 by 180°, to turn downward the felt 361 of the pressing plate 362, which has been positioned on the upper side of the upper pressure applying member 320. Similarly, the lower pressure applying member 330 is turned about the shaft 338 by 180°, to turn upward the felt 371 of the pressing plate 372, which has been positioned on the lower side of the lower pressure applying member 330. The rotation of those members may simply be performed manually. A drive force generated by a motor may be used for the rotation, in place of the manual operation.

Each slit band sheet "a" is passed through between the felts 361 and 371 as vertically spaced from each other and oppositely disposed. The piston rod 351 of the hydraulic cylinder 305 is extended downward to lower the upper pressure applying member 320. The upper and lower pressure applying members 320 and 330 are made to approach to each other to be in contact with each other and the setting work of the slit band sheets "a" is completed. The slit band sheets "a" are compressed, by a predetermined pressing force, between the endless belts 1 mounted on the upper and lower pressure applying members 320 and 330.

To apply a coiling tension to the slit band sheets "a" by nipping the slit band sheets "a" between the upper sheet-pressing-surface movable type pressure applying member 302 and the lower sheet-pressing-surface movable type pressure applying member 303, the upper pressure applying member 320 is moved upward and rotated about the shaft 328 by 180°, and to turn upward the pressing plate 362 having been positioned on the lower side of the upper pressure applying member 320. Similarly, the lower pressure applying member 330 is rotated about the shaft 338 by 180° to turn downward the felt 371 of the pressing plate 372 having been positioned on the upper side of the lower pressure applying member 330. The rotation of the member is readily carried out manually.

Slit band sheets "a" are passed through between the outer surfaces 1*b* of the endless belts 1 as moved apart from each other. The piston rod 351 of the hydraulic cylinder 305 is extended downward to lower the upper pressure applying member 320. The upper and lower pressure applying members 320 and 330 are made to approach to each other to be in contact with each other and the setting work of the slit band sheets "a" is completed. The slit band sheets "a" are compressed, by a predetermined pressing force, between the endless belts 1 mounted on the upper and lower pressure applying members 320 and 330.

The belt pressing part 321 of the upper pressure applying member 320 presses downward the inner surfaces 1*a* of the endless belts 1 to be brought into completely close contact with the inner surfaces 1*a*. The outer surfaces 1*b* of the endless belts 1, which is pressed downward by the belt pressing part 321, is brought into completely close contact with the surfaces of the slit band sheets "a". After the outer surfaces 1*b* of the endless belts 1 are in completely close contact with the surface of the slit band sheets "a", it presses the slit band sheets "a" downward.

The lower side, endless belts 1, which are in contact with the back surface of the slit band sheet "a", presses upward the inner surfaces 1*a* of the lower side, endless belts 1 by a counter force, or the belt pressing part 331 of the lower pressure applying member 330, whereby the outer surfaces 1*b* of the endless belts 1 are brought into close contact with the back surfaces of the slit band sheets "a". The front and back sides of the slit band sheets "a" are pressed by equal forces by the outer surfaces 1*b* of the endless belts 1 which are vertically and oppositely arranged. At this time, a pressure is applied uniformly to the entire front and back sides of the slit band sheets "a" being in close contact with the outer surfaces 1*b* of the endless belts 1 vertically and oppositely arranged.

When the operation of coiling the slit band sheets "a" starts, the upper and lower side, endless belts 1 circulate around the oval, upper and lower pressure applying members 320 and 330 in an oval shape fashion, by a friction caused by the close contact between the obverse and reverse sides of the moving slit band sheets "a" and the outer surfaces 1*b* of the upper and lower side, endless belts 1. At this time, the upper and lower side, endless belts 1 independently circulate at equal speeds without their slippage on the moving slit band sheets "a".

By a friction force caused by a slip between the surfaces of the belt pressing part 321 of the upper pressure applying member 320 and the belt pressing part 331 of the lower pressure applying member 330, viz., their friction engagement with the moving slit band sheet "a", the belt pressing part 321 and the belt pressing part 331, which press the inner surfaces 1*a* of the endless belts 1 circulating in an oval shape fashion, function like a brake to thereby a necessary coiling tension in the slit band sheet "a" between the slit band sheet coiling apparatus and the band sheet coiling tension applying apparatus.

Figure 36A:
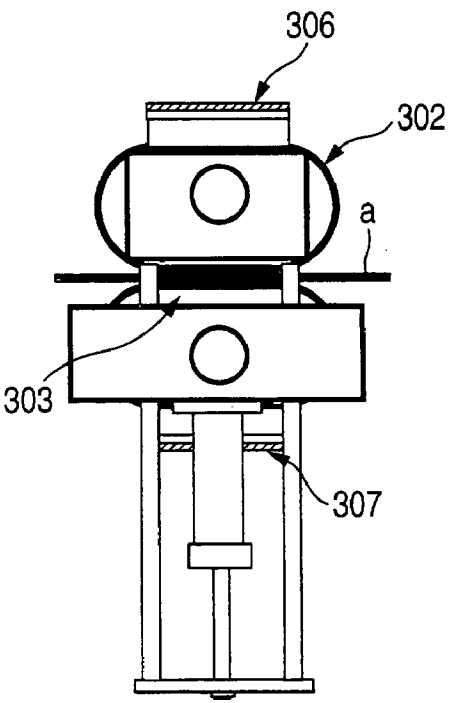
FIGS. 36A and 36B are diagrams for explaining combinations of the upper and lower sheet-pressing-surface movable type pressure applying members and the upper and lower sheet-pressing-surface non-movable type pressure applying members in the embodiment-6.
Figure 36B:
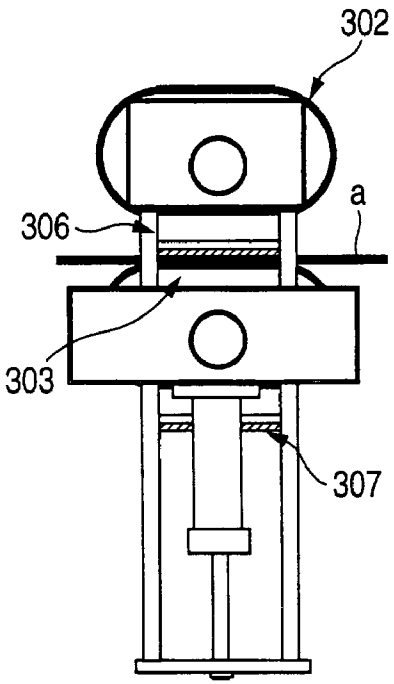
Figure 36C:
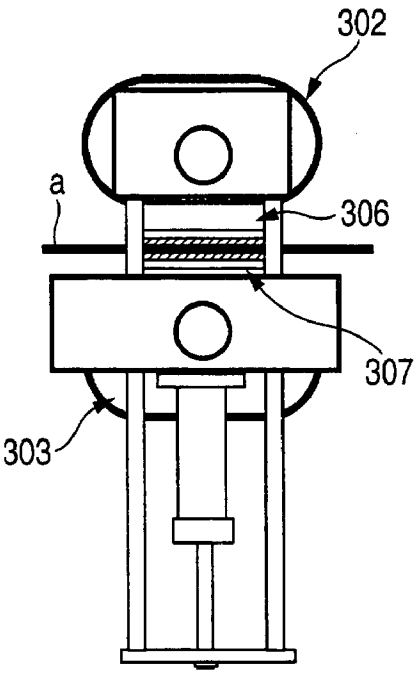
Figure 36D:
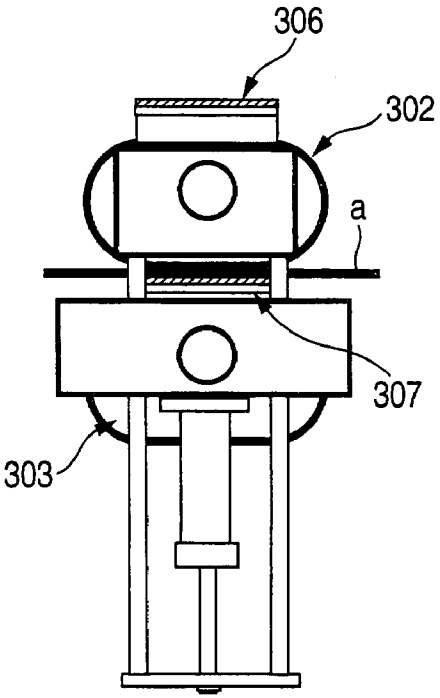

Possible combinations of the upper sheet-pressing-surface movable type pressure applying member 302 (303) and the upper sheet-pressing-surface non-movable type pressure applying member 306 (307) are: a combination of the same types of the pressure applying members (FIGS. 36A and 36C), a combination of the upper sheet-pressing-surface non-movable type pressure applying member 306 and the lower sheet-pressing-surface movable type pressure applying member 303 (FIG. 36B), and a combination of the upper sheet-pressing-surface movable type pressure applying member 302 and the lower sheet-pressing-surface non-movable type pressure applying member 307 (FIG. 36D).

Figure 37:
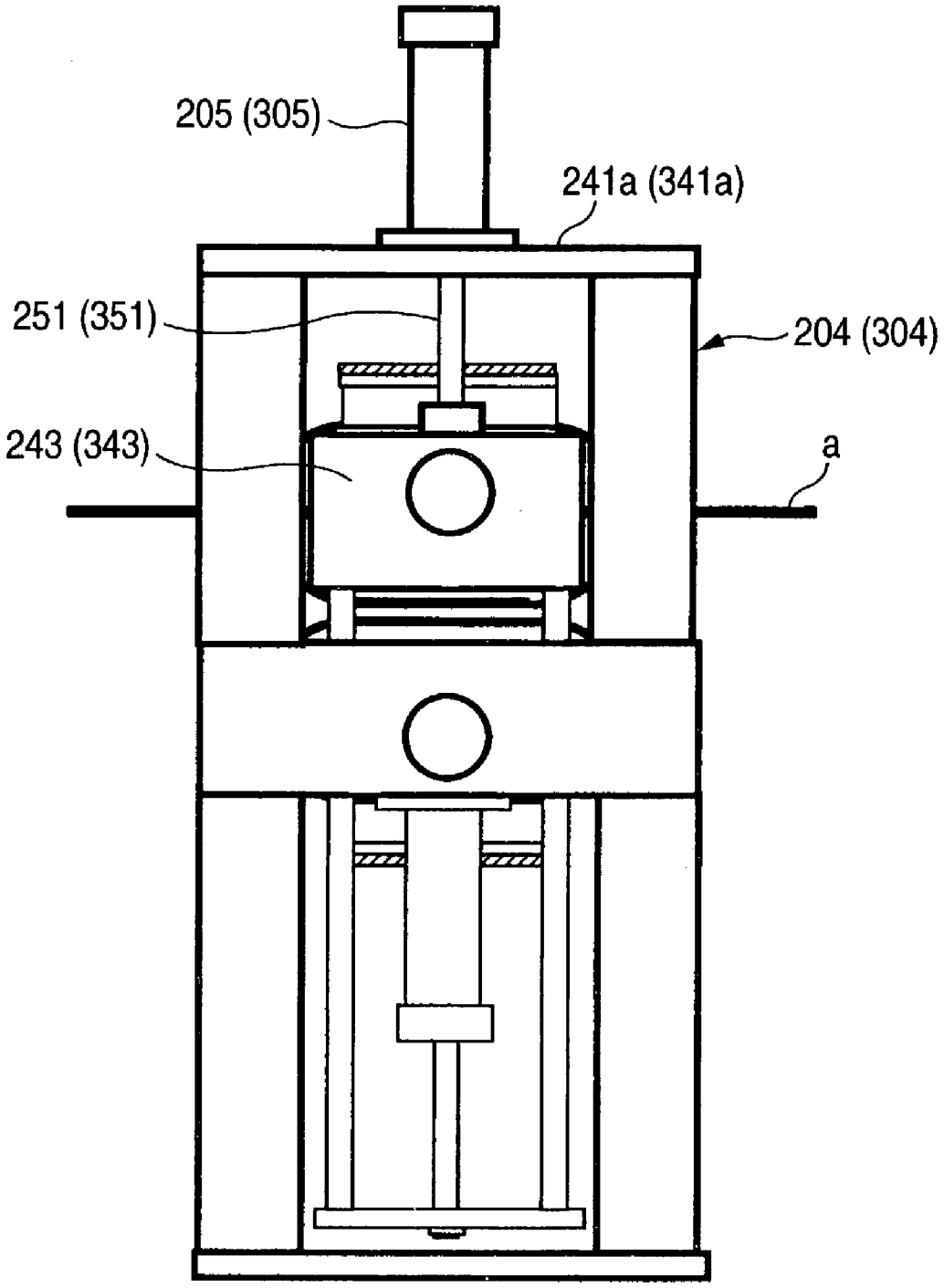
FIG. 37 is a side view showing an overall band sheet coiling tension applying apparatus which is a modification of the embodiments-1 and 6.
Figure 38:
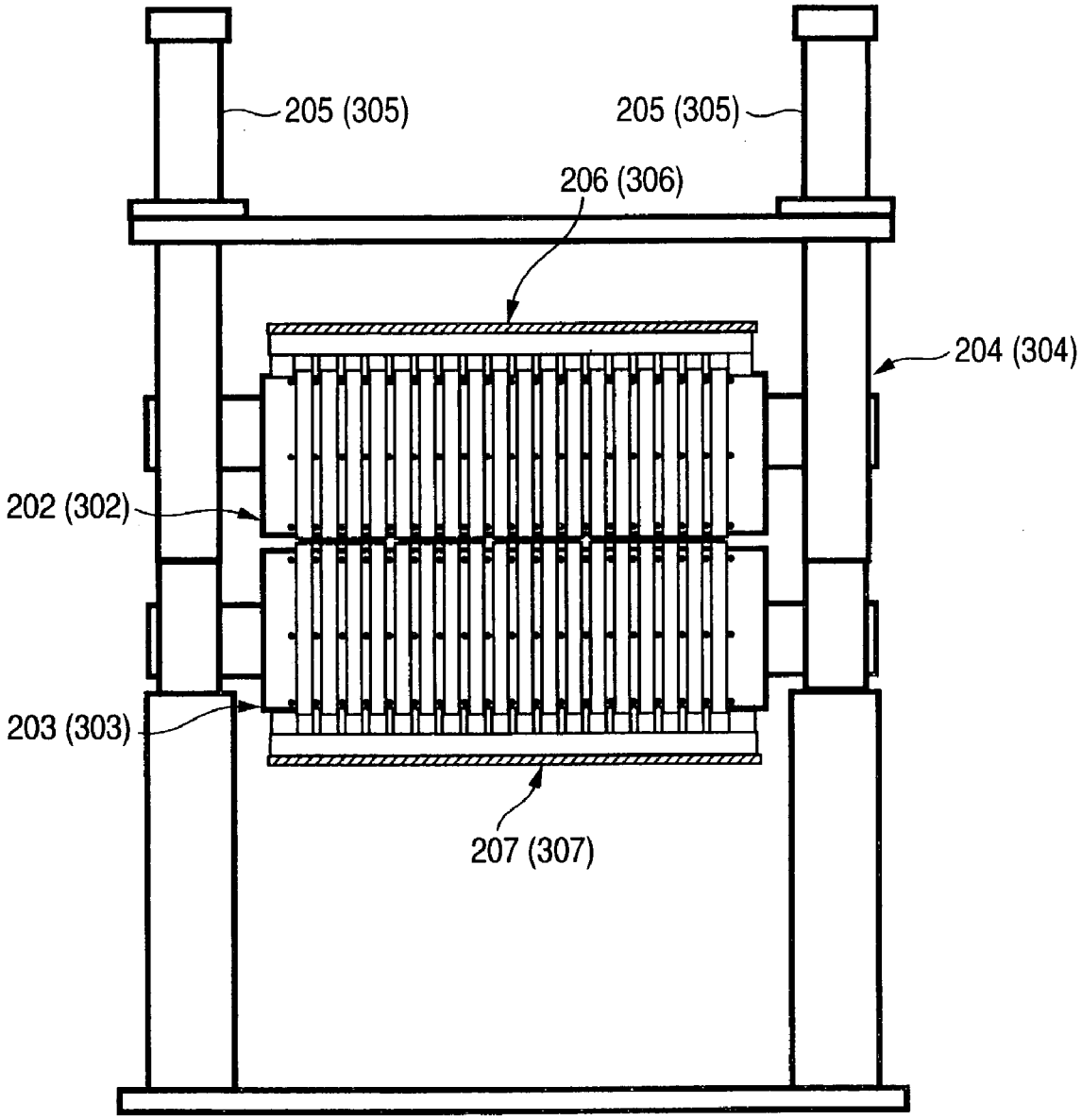
FIG. 38 is a front view showing an overall band sheet coiling tension applying apparatus which is the modification.
Figure 39:
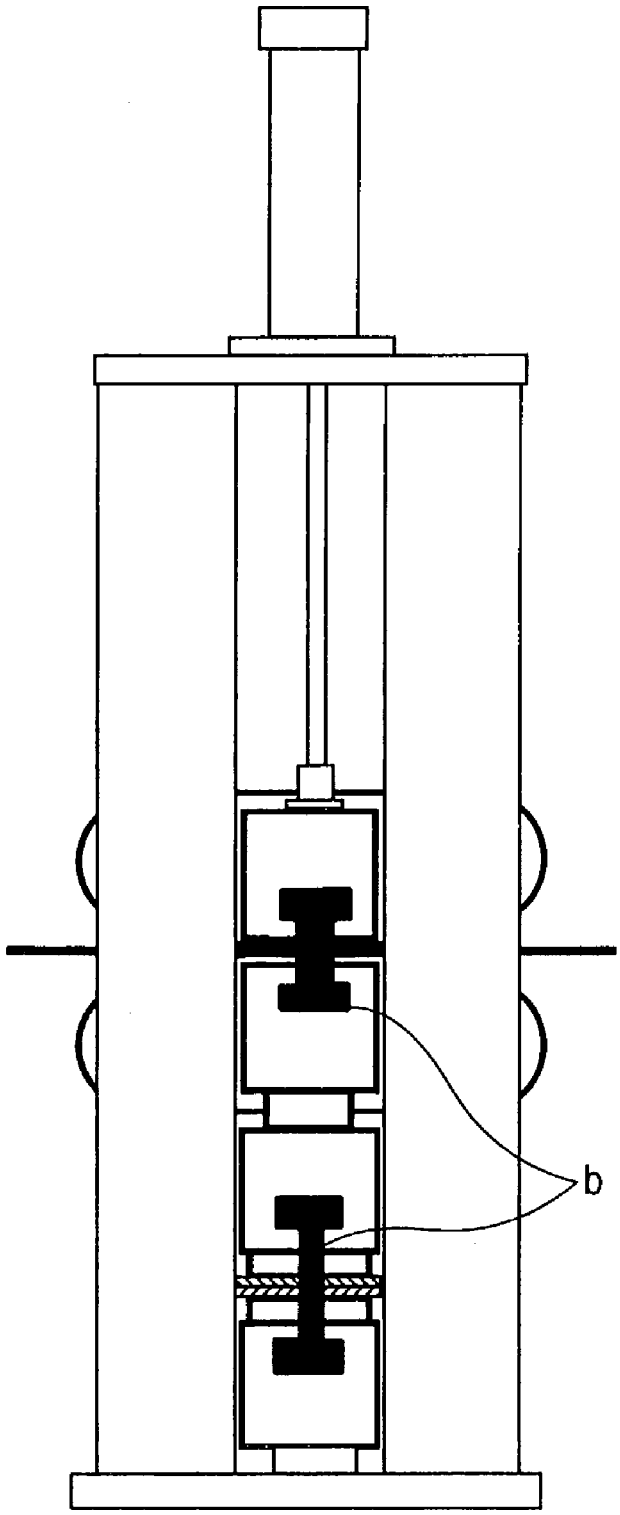
FIG. 39 is a cross sectional view showing a basic construction of a conventional band sheet coiling tension applying apparatus.

It should be understood that the present invention is not limited to the above-mentioned embodiments, but may variously be modified, altered and changed within the true spirits and scope of the invention. In the embodiments-5 and 6, the hydraulic cylinder 205 (305) is disposed under the upper lateral beams 241 (341) of the stands 204 (304) which shaft support the lower sheet-pressing-surface movable type pressure applying member 203 (303). In alternative, as shown in FIGS. 37 and 38, the upper parts of the stands 204 (304) are extended above the upper sheet-pressing-surface movable type pressure applying member 202 (302). The hydraulic cylinder 205 (305) is mounted, while being directed downward, on the upper surface of the central part of the upper-most lateral beam 241*a* (341*a*) bridging the extended upper parts of the stands. The piston rod 251 (351) is extendible downward through the upper-most lateral beam 241*a* (341*a*). The lower end of the piston rod 251 (351) is coupled to the upper bearings 243 (343). In the embodiments mentioned above, the application of a coiling tension to the multi slit band sheets "a" when those are coiled is described. It is evident that the present invention may be applied to a case where a coiling tension is applied to a single, wide metallic band sheet when it is coiled.

As seen from the foregoing description, the band sheet coiling tension applying apparatus of the invention produces the following advantages.

Pressure applying members are disposed on and under a band sheet, which are respectively associated with belt reversing parts arcuate in cross section, are disposed on both sides of a belt pressing part, with endless belts being put on the outer periphery of the pressure applying members. With this feature, there is no necessity of a large number of pulleys and parts associated with the pulleys, and this leads to cost reduction.

The endless belts also contact with the arcuate belt reversing parts of the pressure applying members. Therefore, if cooling water is fed to the inside of the arcuate parts in a circulating manner, heat generated at the friction parts is efficiently removed, while the friction heat removal is impossible in the case using the pulleys.

The structure of the band sheet coiling tension applying apparatus is much simpler than that of the conventional BELTBRIDLE apparatus using the pulleys. Accordingly, the cost to manufacture is reduced, maintenance work after the apparatus is installed is easy, and hence, maintenance cost is reduced.

Since the friction heat is efficiently removed, service life of the endless belts is increased, maintenance cost is reduced, time taken for replacing the endless belts is short, the number of endless belt replacements is small, and the productivity is improved. Further, the length of the endless belt is reduced and cost of the belts is reduced.

Since the guide distance of the endless belts is shorter than that in the case using the pulleys, the straight moving property of the endless belt is increased. Accordingly, no zig-zag traveling of the endless belts occurs, and the positional irregularity problem of the side edge of the winding coil is solved.

No pulleys are used, the apparatus width is reduced, and a space for installing the apparatus is reduced. Accordingly, the tension device in the production line already installed is easily altered and installed.

A guide roll is located between the belt or tension pad type tensioner and the coiler thereby to cope with a variation of the outside diameter of the coil on the winding drum, which is caused by the winding of the band sheet. In the case of the belt type tensioner, it is necessary avoid that the outgoing band sheet comes in contact with the pulleys. Therefore, it is essential to horizontally draw the band sheet by use of the guide roll (called a deflector roll in this world). in the invention of the present patent application, even if the angle of the outgoing side of the band sheet varies as the result of the outside diameter of the coil varies by winding the band sheet. Since the strong structure of the semi-circular drum supports the band sheet, the coiling work is possible without the deflector roll. Therefore, cost to install the deflector roll is reduced as a matter of course, and further the production line length is reduced since the space for installing it is not required. Generally, as the distance from the tensioner to the coiler is shorter, the positional irregularity problem of the coil edge on the coiler is more lessened to thereby lead to the coil quantity improvement. Also, in the band sheet coiling tension applying apparatus, belt reversing parts have each a plurality of belt reversing guide members arranged thereon at given intervals of which the contact surfaces to be in contact with the endless belts are circular as viewed from side, and are each disposed such that a contact locus of each the belt reversing part with the endless belts is arcuate. Therefore, the belt reversing parts have good air permeability, and hence, the endless belts are air cooled.

The inner surface of the endless belt is formed with a woven fabric. Therefore, the fibers and sunken parts of the knit meshes of the woven fabric may be impregnated with a lubricant to thereby reduce a coefficient of friction thereof. The woven fabric is more flexible than a plate material. Accordingly, a rotation resistance of the endless belt installed onto the upper pressure applying member is small.

In the case of an endless belt as a complete round shaped member, a material constituting the belt must be sufficiently large in compressive elasticity and recovery property in the thickness direction, and the belt utilizes a compression elastic strain of the belt in its pressed state at a contact of the complete round shaped member, which is close to its linear contact. When comparing with this belt, a pressed area of the belt pressing part is considerably large in the invention of the present patent application. Therefore, a friction resistance (tension) comparable with that by the complete round can be secured by a low surface pressure. And in the invention, there is no need of a compression strain deformation resistance, which is essential to the case of the complete round shaped member. Accordingly, the endless belt has satisfactory functions by using combined synthetic resin materials of relatively thin and small compressive elasticity. Further, the fibers and the sunken parts of the knit meshes of the woven fabric may be impregnated with a lubricant in advance. Therefore, there is no limit of the material of the endless belt to the front and back surfaces of the endless belt of which the friction coefficients are different from each other. In the band sheet coiling tension applying apparatus of the invention, unlike the device for applying circular metallic strip with tensile force (Japanese patent No. 2651891), a pressing area of the upper pressure applying member may be broaden. Therefore, there is no need of using a material having a sufficient compressive elasticity and recovery property in the thickness direction. Further, if the sunken parts of the knit meshes of the woven fabric is impregnated with a lubricant in advance. Therefore, there is no limit of the material of the endless belt to a combination of the material of the inner surface and the material of the outer surface of the endless belt of which the friction coefficients are different from each other.

Further, the invention provides an endless belt Lubricant for lubricating the inner surfaces of endless belts used by the band sheet coiling tension applying device. In the conventional apparatus, a lubricant oil is directly applied to the inner surface 1*a* of the endless belt in a dropping manner. To drop the lubricant oil, it is necessary to stop the production line operation. This leads to decrease of the productivity. In the invention, a bar-like non-woven fabric or porous foam is put in a container containing molten solid paraffin which is solid at normal temperature and becomes liquid when it is heated to be in excess of its melting point of, for example, 40° C. or higher, whereby it is impregnated with the paraffin. The paraffin contained bar-like member is disposed in contact with the inner surface 1*a* of the endless belt. The paraffin oozes out of the bar-like member by the friction heat generated by the rotation of the endless belt, and it lubricates inner surface of the endless belt. The non-woven fabric or porous foam allow the paraffin to penetrate thereinto. Further, the principle of the capillary phenomenon also acts, and hence, a long term use of it is allowed. Therefore, there is no interruptive work of stopping the production line for the oil feeding, and hence, the productivity is improved.

As seen from the foregoing description, the novel and unique band sheet coiling tension applying apparatus of the invention produces the following advantages.

The invention succeeds in providing the band sheet coiling tension applying apparatus having the belt type function or a combination of the belt type and felt type functions, which can handle the band sheets which are distributed over a broad range of thickness values, and can be manufactured at low cost.

In the case of the conventional BELTBRIDELE apparatus using the pulleys, to switch the belt side is switched to the tension pad side and vice verse, it is necessary to remove the upper and lower coupling jigs. The work of moving up and down the heavy things is dangerous. In the apparatus of the invention, such a switching is easily achieved by merely turning the same element by 180°. Accordingly, there is eliminated a danger of the accident by falling in the case of plural stages frames. The band sheet coiling tension applying apparatus is easy to handle and operable at high speed. A reliable operation of the apparatus is realized.

In the BELTBRIDELE apparatus of the combination type, the felt side and the belt side are disposed in the upper and lower parts. Accordingly, it is impossible to exchange those one for the other in a state that the slit band sheets are set in the apparatus. In the band sheet coiling tension applying apparatus of the invention, the belt side and the felt side can be exchanged from one for the other in a state that the slit band sheets are set in the apparatus. Therefore, at the middle of long band sheets (coil), the belt side and the felt side can be exchanged from one for the other without any restrictions according to a change of a surface state of the band sheets (coil). In a case where the surface finishing and processing state on the front surface of the band sheets (coil) are different from those on the back surface, an appropriate belt-felt combination may be selected from among "belt-belt", "felt-belt", "upper belt-lower felt", and "lower belt-upper felt" combination. Under this condition, the ban passing operation may be carried out. This feature greatly and advantageously contributes to the quality control, productivity improvement, and reduction of maintenance cost of belts, felts and others.

Pressure applying members with the endless belts, which are put on the outer periphery of the pressure applying members, are disposed on and under a band sheet. With this feature, there is no necessity of a large number of pulleys and parts associated with the pulleys, and this leads to cost reduction.

The structure of the band sheet coiling tension applying apparatus is much simpler than that of the conventional BELTBRIDLE apparatus using the pulleys. Accordingly, the cost to manufacture is reduced, maintenance work after the apparatus is installed is easy, and hence, maintenance cost is reduced.

Since the friction heat is efficiently removed, service life of the endless belts is increased, maintenance cost is reduced, time taken for replacing the endless belts is short, the number of endless belt replacements is small, and the productivity is improved. Further, the length of the endless belt is reduced and cost of the belts is reduced.

Since the guide distance of the endless belts is shorter than that in the case using the pulleys, the straight moving property of the endless belt is increased. Accordingly, no zig-zag traveling of the endless belts occurs, and the positional irregularity problem of the side edge of the winding coil is solved.

No pulleys are used, the apparatus width is reduced, and a space for installing the apparatus is reduced. Accordingly, the tension device in the production line already installed is easily altered and installed.

Also, in the band sheet coiling tension applying apparatus, belt reversing parts have each a plurality of belt reversing guide members arranged thereon at given intervals of which the contact surfaces to be in contact with the endless belts are circular as viewed from side, and are each disposed such that a contact locus of each of the belt reversing part with the endless belts is arcuate. Therefore, the belt reversing parts have good air permeability, and hence, the endless belts are air cooled.

What is claimed is:

1. A band sheet coiling tension applying apparatus comprising:

two sets of endless belts disposed oppositely upper and lower, each set of endless belts including a plurality of endless belts laterally arranged side by side and two, upper and lower, pressure applying members which hold each of said set of endless belts in a state that said endless belts freely circulate in an oval shape state, and which press inner surfaces of said endless belts, and which are inserted in an inner part of said endless belts, respectively;

wherein each said pressure applying member comprises at least a belt pressing part which has a linear shaped in sectional side for directly pressing said inner surfaces of said endless belts; and belt reversing parts being arcuate in cross section, belt reversing parts being provided on both sides of the belt pressing part; and a plurality of belt guide protrusions for separately guiding said endless belts being arranged side by side on said belt reversing parts, wherein a coefficient of friction of an outer surface of each said endless belt is larger than that of said inner surface thereof, wherein said endless belts are pressed against both surfaces of slit band sheets which are passed between the outer surfaces of said upper and lower side, oppositely arranged endless belts by said pressure applying members which are inserted in the inner part of said endless belts, whereby said endless belts are driven to move by a friction engagement between said endless belts and said slit band sheets to independently circulate said endless belts in an oval shape fashion in unison with said slit band sheets, and a tension is generated in said band sheets by a friction force between said pressure applying members and inner surfaces of said endless belts, wherein for each of said upper and lower pressure applying members, a first cooling chamber is disposed within said belt pressing part and a second cooling chamber is disposed inside each said belt reversing part.

2. The band sheet coiling tension applying apparatus according to claim 1, wherein sheet-pressing-surface non-movable pressure applying members are further provided across said endless belts and oppositely to one linear shaped side of said upper and lower pressure applying members respectively, the sheet-pressing-surfaces non-movable pressure applying members having sheet-pressing surfaces on the out side of the endless belts, the sheet-pressing surfaces being connected to the pressure applying members through the gaps between the adjacent endless belts;

and said upper and lower pressure applying members provided with said sheet-pressing-surface non-movable pressure applying members are supported such that sheet-pressing-surface movable belt pressure applying members are rotatable about a horizontal axis, and the pressing operation of said slit band sheets is interchangeable with said sheet-pressing-surface movable belt pressure applying members or said sheet-pressing-surface non-movable pressure applying members by their rotation.

3. The band sheet coiling tension applying apparatus according to claim 2, wherein the pressure applying members are supported by a stand structure, at least one pressure applying member being supported by the stand structure in liftable and pressure type manner.

4. The band sheet coiling tension applying apparatus according to claim 3, wherein said at least one pressure applying members being supported on the stand structure is connected to a lifting device on the stand structure.

5. The band sheet coiling tension applying apparatus according to claim 4, wherein a hydraulic cylinder device is provided on the base part of the stand structure with a piston rod of the hydraulic cylinder extending upward and being connected to the pressure applying member; or said hydraulic cylinder device is suspended under the upper lateral beam of the stand structure with the piston rod extending downward and being connected to one end of lifting rods which are connected to the pressure applying member.

6. A band sheet coiling tension applying apparatus comprising:

two sets of endless belts disposed oppositely upper and lower, each set of endless belts including a plurality of endless belts laterally arranged side by side, and two, upper and lower, pressure applying members which hold each of said set of said endless belts in a state that said endless belts freely circulate in an oval shape state, and which press inner surfaces of said endless belts, and which are inserted in an inner part of said endless belts, respectively;

wherein each said pressure applying member comprises at least a belt pressing part which has a linear shaped in sectional side for directly pressing said inner surfaces of said endless belts; and belt reversing parts being arcuate in cross section, belt reversing parts being provided on both sides of the belt pressing part; and a plurality of belt guide protrusions for separately guiding said endless belts being arranged side by side on said belt reversing parts, wherein a coefficient of friction of an outer surface of each said endless belt is larger than that of said inner surface thereof, wherein said endless belts are pressed against both surfaces of slit band sheets which are passed between the outer surfaces of said upper and lower side, oppositely arranged endless belts by said pressure applying members which are inserted in the inner part of said endless belts, whereby said endless belts are driven to move by a friction engagement between said endless belts and said slit band sheets to independently circulate said endless belts in an oval shape fashion in unison with said slit band sheets, and a tension is generated in said band sheets by a friction force between said pressure applying members and inner surfaces of said endless belts, wherein sheet-pressing-surface non-movable pressure applying members are further provided across said endless belts and oppositely to one linear shaped side of said upper and lower pressure applying members respectively, the sheet-pressing-surfaces non-movable pressure applying members having sheet-pressing surfaces on the out side of the endless belts, the sheet-pressing surfaces being connected to the pressure applying members through the gaps between the adjacent endless belts; and said upper and lower pressure applying members provided with said sheet-pressing-surface non-movable pressure applying members are supported such that sheet-pressing-surface movable belt pressure applying members are rotatable about a horizontal axis, and the pressing operation of said slit band sheets is interchangeable with said sheet-pressing-surface movable belt pressure applying members or said sheet-pressing-surface non-movable pressure applying members by their rotation.

* * * * *